US005250406A

United States Patent [19]

Yamamoto et al.

[11] Patent Number: 5,250,406

[45] Date of Patent: Oct. 5, 1993

[54] SILVER HALIDE COLOR PHOTOGRAPHIC MATERIAL

[75] Inventors: Mitsuru Yamamoto; Hidetoshi Kobayashi, both of Minami-ashigara, Japan

[73] Assignee: Fuji Photo Film Co., Ltd., Kanagawa, Japan

[21] Appl. No.: 772,701

[22] Filed: Oct. 7, 1991

[30] Foreign Application Priority Data

Oct. 9, 1990 [JP] Japan ..... 2-271602

[51] Int. Cl.[5] ..... G03C 7/36

[52] U.S. Cl. ..... 430/544; 430/556; 430/557

[58] Field of Search ..... 430/556, 557, 544

[56] References Cited

U.S. PATENT DOCUMENTS

| | | | |
|---|---|---|---|
| 2,184,303 | 12/1939 | Jennings | 430/556 |
| 3,379,529 | 4/1968 | Porter et al. | 430/957 |
| 3,639,417 | 2/1972 | Porter et al. | 260/308 D |
| 4,171,223 | 10/1979 | Odenwilder et al. | 430/957 |
| 4,226,943 | 10/1980 | Tsurushige et al. | 521/73 |
| 4,268,591 | 5/1981 | Tschopp | 430/556 |
| 4,684,604 | 8/1987 | Harder | 430/223 |
| 4,770,982 | 9/1988 | Ichijima et al. | 430/544 |

*Primary Examiner*—Richard L. Schilling
*Attorney, Agent, or Firm*—Birch, Stewart, Kolasch & Birch

[57] ABSTRACT

There is disclosed a silver halide color photographic material comprising a photosensitive silver halide emulsion layer that contains an acylacetamide yellow dye-forming coupler whose acyl group is represented by formula (Y-I) and a compound represented formula (I).

Formula (Y-I)

wherein $R_1$ represents a monovalent group, O represents a group of nonmetallic atoms required to form together with C a 3- to 5-membered hydrocarbon ring or a 3- to 5-membered heterocyclic ring that contains a hetero atom selected from the group consisting of N, O, S, and P, provided that $R_1$ is not a hydrogen atom and it does not bond to Q to form a ring.

$$A\text{-}(L)_n\text{-}(G)_m\text{-}(Time)_t\text{-}X$$

Formula (I)

wherein A represents an oxidation-reduction (redox) residue or its precursor, which is an atomic group that allows $\text{-}(Time)_t\text{-}X$ be released only upon oxidation during the photographic development processing, Time represents a group that will release X after being split off from the oxidized product of A, X represents a development retarder, L represents a bivalent linking group, G represents a polarizable group, and n, m, and t each are 0 or 1.

20 Claims, No Drawings

SILVER HALIDE COLOR PHOTOGRAPHIC MATERIAL

FIELD OF THE INVENTION

The present invention relates to a silver halide color photographic material excellent in sharpness and color reproduction.

BACKGROUND OF THE INVENTION

In silver halide color photographic materials, development of technologies to improve the image quality is an important subject. In recent year, means for attaining high quality with a small format have been developed successively, but the means are still unsatisfactory and a further improvement in technology is required.

On the other hand, although DIR compounds are generally used at present particularly to improve the edge effect, the generally used ones are DIR couplers that cause a coupling reaction with the oxidized product of a color-developing agent to release a development retarder imagewise forming a color dye.

However, when DIR couplers are used, if the dye formed in the coupling reaction is different from the dye obtained from the major coupler, color contamination occurs, which is not preferable in view of color reproduction. To prevent this, it is required to develop DIR couplers which form dyes having hues equivalent to those of dyes formed from major couplers of yellow, magenta, and cyan; that is, to develop as many as three types of DIR couplers having optimum reactivity, and since this means an increase in the cost for the development and synthesis, development of non-dye-forming DIR compounds is demanded.

Depending on the type of reaction with the oxidized product of color-developing agents, non-dye-forming DIR compounds are classified into two types: the coupling type and the oxidation-reduction type. The coupling type includes compounds described, for example, in JP-B ("JP-B" means examined Japanese patent publication) Nos. 16141/1976 and 16142/1976 and U.S. Pat. Nos. 4,226,943 and 4,171,223, and the oxidation-reduction type includes DIR hydroquinone compounds described, for example, in U.S. Pat. Nos. 3,379,529 and 3,639,417, JP-A ("JP-A" means unexamined published Japanese patent application) Nos. 129536/1974 and 546/1989, and Japanese Patent Application No. 21127/1990 or DIR hydrazide compounds described, for example, in JP-A Nos. 213847/1986 and 88451/1989 and U.S. Pat. No. 4,684,604.

When non-dye-forming DIR compounds are applied to color reversal photographic materials whose processing step consists of B/W development (first development) and color development (second development), the retarder is preferably released from a DIR compound in the first development. This is because the second development is quite high in silver-developing speed, since the second development is intended to rapidly develop all the silver halide that has not been developed in the first development. Therefore, if it is intended to work the development-retarding effect imagewise in the second development, the silver development is retarded and instability of the processing in the color development is involved, which is not preferable. Accordingly it is preferable that DIR compounds are reacted in the first development, but in that case it becomes essential to use an oxidation-reduction-type DIR compound capable of reacting with the oxidized product of the developing agent for the B/W development.

However, if an oxidation-reduction DIR compound is used in addition to the conventional yellow coupler, problems arise that the improvement in the edge effect becomes quite small and that the performance of the photographic material are liable to change during storage under heat and humidity conditions.

SUMMARY OF THE INVENTION

Therefore, the object of the present invention is to increase the edge effect in the silver halide color photographic materials, which is otherwise adversely affected when a conventionally used yellow coupler is used, and to increase the preservation stability with time.

The above and other objects, features, and advantages of the invention will be appear more fully from the following description.

DETAILED DESCRIPTION OF THE INVENTION

The object of the present invention has been attained by the following silver halide color photographic material:

A silver halide color photographic material comprising a support having thereon at least one silver halide emulsion layer, which comprises at least one layer constituting said photographic material that contains at least one acylacetamide yellow coupler whose acyl group is represented by the following formula (Y-I):

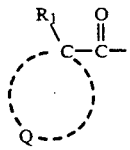

Formula (Y-I)

wherein $R_1$ represents a monovalent group and Q represents a group of nonmetallic atoms required to form together with the C a 3- to 5-membered cyclic hydrocarbon group or a 3- to 5-membered heterocyclic group, having therein at least one hetero atom selected from the group consisting of N, O, S, and P, provided that $R_1$ is a substituent other than a hydrogen atom and does not bond to Q to form a ring, and at least one layer constituting said photographic material that contains at least one compound represented by the following formula (I):

$$A\text{-}(L)_n\text{-}(G)_m\text{-}(Time)_t\text{-}X \qquad \text{Formula (I)}$$

wherein A represents an oxidation-reduction (redox) residue or its precursor, which is an atomic group that allows $\text{-}(Time)_t\text{-}X$ to be released only upon oxidation during the photographic development processing, Time represents a group that will release X after being split off from the oxidized product of A, X represents a development retarder, L represents a bivalent linking group, G represents a polarizable group, and n, m, and t each are 0 or 1.

Formula (Y-1) will be described below in detail.

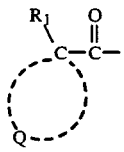

Formula (Y-I)

wherein $R_1$ represents a monovalent group, Q represents a group of non-metallic atoms required to form together with the C a 3- to 5-membered cyclic hydrocarbon group or a 3- to 5-membered heterocyclic group having in the group at least one hetero atom selected from the group consisting of N, O, S, and P, provided that $R_1$ is not a hydrogen atom and it does not bond to Q to form a ring.

Preferably, the acylacetamide yellow coupler of the present invention is represented by the following formula (Y-II):

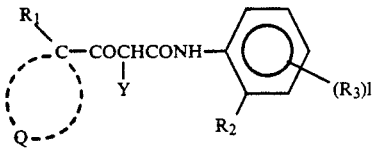

Formula (Y-II)

wherein $R_1$ represents a monovalent substituent other than hydrogen; Q represents a group of non-metallic atoms required to form together with the C a substituted or unsubstituted 3- to 5-membered cyclic hydrocarbon group or a substituted or unsubstituted 3- to 5-membered heterocyclic group having in the group at least one hetero atom selected from a group consisting of N, O, S, and P; $R_2$ represents a hydrogen atom, a halogen atom (e.g., F, Cl, Br, and I, which is applied hereinafter to the description of formula (Y-II)), an alkoxy group, an aryloxy group, an alkyl group, or an amino group; $R_3$ represents a group capable of substitution onto a benzene ring; Y represents a hydrogen atom or an atom or group capable of being released upon a coupling reaction with the oxidized product of primary amine developing agent (hereinafter referred to as a split-off group); l is an integer of 0 to 4, and when l is 2 or more, the $R_3$ groups may be the same or different.

When any of the substituents in formula (Y-II) is an alkyl group or contains an alkyl group, unless otherwise specified the alkyl group is a straight-chain or branched chain or cyclic alkyl group that may be substituted and may contain an unsaturated bond such as methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifluoromethyl, hydroxymethylmethoxyethyl, ethoxycarbonylmethyl, and phenoxyethyl. Moreover, unless otherwise specified the alkyl group contains 1 to 30 carbon atoms (exclusive of any substituents).

When any of the substituents in formula (Y-II) is an aryl group or contains an aryl group, unless otherwise specified the aryl group is a monocyclic or condensed ring aryl group containing 3 to 8 ring members selected from carbon, oxygen, nitrogen and sulfur. The aryl groups may be further substituted and include aryl groups, such as phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidophenyl, and 3,4-dichlorophenyl.

When the substituent in formula (Y-II) is a heterocyclic group or contains a heterocyclic ring, unless otherwise specified the heterocyclic ring group is a 3- to 8-membered monocyclic or condensed ring heterocyclic group that contains at least one hetero atom selected from the group consisting of O, N, S, P, Se, and Te, and contains from 2 to 36 carbon atoms and may be substituted such as 2-furyl, 2-pyridyl, 4-pyridyl, 1-pyrazolyl, 1-imidazolyl, 1-benzotriazolyl, 2-benzotriazolyl, succinimido, phthalimido, and 1-benzyl-2,4-imidazolidinedione-3-yl.

Substituents preferably used in formula (Y-II) will now be described below.

$R_1$ in formula (Y-II) preferably represents a halogen atom, a cyano group, a monovalent aliphatic-type group that may be substituted and has a total number of carbon atoms (hereinafter, abbreviated as a total C-number) of 1 to 30 (e.g., an alkyl group and an alkoxy group), or a monovalent aryl-type group that may be substituted and has a total C-number of 6 to 30 (e.g., an aryl group and an aryloxy group), and examples of substituents therefor are a halogen atom, an alkyl group (straight, branched or cyclic), an alkoxy group, a nitro group, an amino group, a carbonamido group, a sulfonamido group, and an acyl group.

Preferably Q in formula (Y-II) represents a group of non-metallic atoms which forms together with the C (carbon atom), substituted or unsubstituted, a 3- to 5-membered hydrocarbon ring having a total C-number of 3 to 30, or a 3- to 5-membered, substituted or unsubstituted, heterocyclic ring moiety having in the ring at least one hetero atom selected from the group consisting of N, O, S, and P, and having a total C-number of 2 to 30, and preferably containing from 1 to 3 hetero atom ring members. The ring formed by Q together with the C may have an unsaturated bond in the ring. As examples of the ring formed by Q together with the C are a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring. Examples of a substituent for the rings include a halogen atom, a hydroxyl group, an alkyl group, an aryl group, an acyl group, an alkoxy group, an aryloxy group, a cyano group, an alkoxycarbonyl group, an alkylthio group, and an arylthio group.

$R_2$ in formula (Y-II) preferably represents a halogen atom, an alkoxy group that may be substituted and has a total C-number of 1 to 30, an aryloxy group that may be substituted and has a total C-number of 6 to 30, an alkyl group that may be substituted and has a total C-number of 1 to 30, or an amino group that may be substituted and has a total C-number of 0 to 30 and the substituent is, for example, a halogen atom, an alkyl group, an alkoxy group, or an aryloxy group.

Preferably, $R_3$ in formula (Y-II) is a halogen atom, an alkyl group (as defined above), an aryl group (as defined above), an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an arylsulfonyl group, a ureido group, a sulfamoylamino group, an alkoxycarbonylamino group, an alkoxysulfonyl group, an acyloxy group, a nitro group, a heterocyclic group (as defined above), a cyano group, an acyl group, an acyloxy group, an alkylsulfonyloxy group, and an arylsulfonyloxy group, and examples of the split-off group are a heterocyclic group (as defined above) bonded to the coupling active site through the nitrogen atom, an aryloxy group, an arylthio group, an acyloxy group, an alkylsulfonyloxy group, an arylsulfonyloxy group, a heterocyclic oxy group (wherein heterocyclic is as defined above), and a halogen atom.

$R_3$ in formula (Y-II) preferably represents a halogen atom, an alkyl group that may be substituted and has a total C-number of 1 to 30, more preferably 1 to 18, an aryl group that may be substituted and has a total C-number of 6 to 30, more preferably 6 to 24, an alkoxy group that may be substituted and has a total C-number of 1 to 30, more preferably 1 to 18, an aryloxy group that may be substituted and has a total C-number 6 to 30, more preferably 6 to 24, an alkoxycarbonyl group that may be substituted and has a total C-number of 2 to 30, more preferably 2 to 19, an aryloxycarbonyl group that may be substituted and has a total C-number of 7 to 30, more preferably 7 to 24, a carbonamido group that may be substituted and has a total C-number of 1 to 30, more preferably 1 to 20, a sulfonamido group that may be substituted and has a total C-number of 1 to 30, more preferably 1 to 24, a carbamoyl group that may be substituted and has a total C-number of 1 to 30, more preferably 1 to 20, a sulfamoyl group that may be substituted and has a total C-number of 0 to 30, more preferably 1 to 24, an alkylsulfonyl group that may be substituted and has a total C-number of 1 to 30, more preferably 1 to 20, an arylsulfonyl group that may be substituted and has a total C-number of 6 to 30, more preferably 6 to 24, a ureido group that may be substituted and has a total C-number of 1 to 30, more preferably 1 to 20, a sulfamoylamino group that may be substituted and has a total C-number of 0 to 30, preferably 0 to 20, an alkoxycarbonylamino group that may be substituted and has a total C-number of 2 to 30 preferably 2 to 20, a heterocyclic group (as defined above) that may be substituted and has a total C-number of 1 to 30, preferably 1 to 20, an acyl group that may be substituted and has a total C-number of 1 to 30, preferably 1 to 20, an alkylsulfonyloxy group that may be substituted and has a total C-number of 1 to 30, preferably 1 to 20, or an arylsulfonyloxy group that may be substituted and has a total C-number of 6 to 30, preferably 6 to 24; and examples of the substituents for these $R_3$ moieties include a halogen atom, an alkyl group, an aryl group, a heterocyclic group (as defined above), an alkoxy group, an aryloxy group, a heterocyclic oxy group (wherein heterocyclic is as defined above), an alkylthio group, an arylthio group, a heterocyclic thio group (wherein heterocyclic is as defined above), an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, a cyano group, a nitro group, an acyloxy group, an alkoxycarbonyl group, an aryloxycarbonyl group, an alkylsulfonyloxy group, and an arylsulfonyloxy group.

In formula (Y-II), preferably l is an integer of or 2 and the position of the substitution of $R_3$ is preferably in a meta-position in an ortho-position relative to

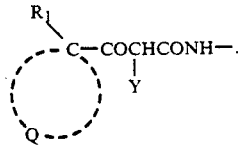

In formula (Y-II), preferably Y represents a heterocyclic group (as defined above) bonded to the coupling active site through a nitrogen atom or an aryloxy group.

When Y represents a heterocyclic group, Y is most preferably a heterocyclic group (as defined above) comprising a 5- to 7-membered monocyclic group or condensed ring group that may be substituted. Exemplary of such groups are succinimido, maleinimido, phthalimido, diglycolimido, pyrrole, pyrazole, imidazole, 1,2,4-triazole, tetrazole, indole, indazole, benzimidazole, benztriazole, imidazolidin-2,4-dione, oxazolidin-2,4-dione, thiazolidin-2,4-dione, imidazolidin-2-one, oxazolidin-2-one, thiazolidin-2-one, benzimidazolin-2-one, benzoxazolidin-2-one, benzothiazolin-2-one, 2-pyrrolin-5-one, 2-imidazolin-5-one, indolin-2,3-dione, 2,6-dioxypurine, parabanic acid, 1,2,4-triazolidin-3,5-dione, 2-pyridone, 4-pyridone, 2-pyrimidone, 6-pyridazone-2-pyrazone, 2-amino-1,3,4-thiazolidine, 2-imino-1,3,4-thiazolidin-4-one and the like, any of which heterocyclic ring groups may be substituted. Examples of the substituent of these heterocyclic rings include a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, a ureido group, an alkoxycarbonylamino group, and a sulfamoylamino group. When Y represents an aryloxy group, preferably Y represents an aryloxy group having a total C-number of 6 to 30 which may be substituted by a substituent selected from the group consisting of the substituents mentioned above for the heterocyclic ring represented by Y. Most preferably, the substituent of the aryloxy group is a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, or a cyano group.

Particularly preferable substituents used in formula (Y-II) will now be described.

Particularly preferably $R_1$ is a halogen atom or an alkyl group (as defined above) and most preferably a methyl group.

Particularly preferably Q represents a group of non-metallic atoms required to form together with the C a 3- to 5- membered hydrocarbon ring, for example,

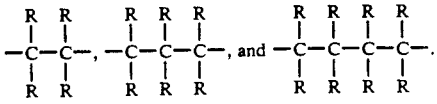

R represents a halogen atom, a hydrogen atom, or an alkyl group (as defined above). The groups R may be the same or different. Most preferably Q forms together with the C a 3-membered ring, that is, represented by

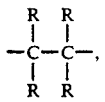

wherein R is as defined above.

Particularly preferably $R_2$ represents a chlorine atom, a fluorine atom, a substituted or unsubstituted alkyl group having C-number of 1 to 6 (e.g., halogen substituted $C_{1-6}$ alkyl, methyl, trifluoromethyl, ethyl, isopropyl, and t-butyl) exclusive of its substituents, an alkoxy group having a C-number of 1 to 8 (e.g., methoxy, ethoxy, methoxyethoxy, and butoxy), or an aryloxy group having C-number of 6 to 24 (e.g., phenoxy, p-tolyloxy, and p-methoxyphenoxy); with a chlorine atom, a methoxy group, or a trifluoromethyl group most preferred.

Particularly preferably $R_3$ represents a halogen atom, an alkoxy group, an alkoxycarbonyl group, an aryloxycarbonyl group, a carbonamido group, a sulfonamido group, a carbamoyl group, or a sulfamoyl group, with an alkoxy group, an alkoxycarbonyl group, a carbonamido group, or a sulfonamido group most preferred.

Particularly preferably Y is a group represented by the following formula (Y-III), (Y-IV), or (Y-V):

Formula (Y-III)

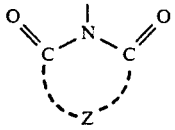

In formula (Y-III), Z represents

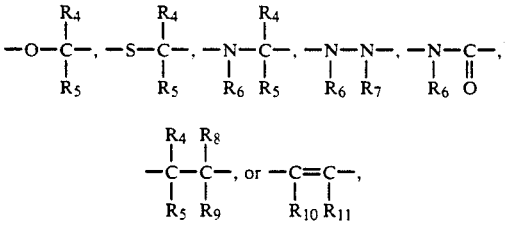

wherein $R_4$, $R_5$, $R_8$ and $R_9$, same or different, each represent a hydrogen atom, an alkyl group (as defined above), an aryl group (as defined above), an alkoxy group having C-number of 1 to 24, an aryloxy group having C-number of 6 to 24, an alkylthio group having C-number of 1 to 24, an arylthio group having C-number of 6 to 24, an alkylsulfonyl group having C-number of 1 to 24, an arylsulfonyl group having C-number of 6 to 24, or an amino group, any of which may be substituted (except hydrogen); $R_6$ and $R_7$ each represent a hydrogen atom, an alkyl group (as defined above), an aryl group (as defined above), an alkylsulfonyl group having C-number of 1 to 24, an arylsulfonyl group having C-number of 6 to 24, or an alkoxycarbonyl group having C-number of 1 to 24, any of which may be substituted (except hydrogen); $R_{10}$ and $R_{11}$ each represent a hydrogen atom, an alkyl group (as defined above), or an aryl group (as defined above), $R_{10}$ and $R_{11}$ may bond together to form a benzene ring, and $R_4$ and $R_5$, $R_5$ and $R_6$, $R_6$ and $R_7$, or $R_4$ and $R_8$ may bond together to form a 3 to 8 membered heterocyclic or hydrocarbon ring (e.g., cyclobutane, cyclohexane, cycloheptane, cyclohexene, pyrrolidine, and piperidine), any of which groups may be substituted (except hydrogen).

Among the heterocyclic groups represented by formula (Y-III), particularly preferable ones are heterocyclic groups wherein Z represent

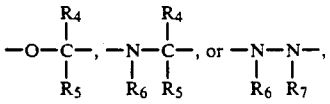

and $R_4$, $R_5$, $R_6$ and $R_7$, same or different are as defined above.

The total number of carbon atoms of the heterocyclic group represented by formula (Y-III) is 2 to 30, preferably 4 to 20, and more preferably 5 to 16.

Formula (Y-IV)

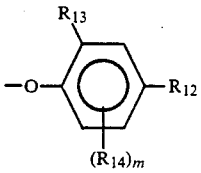

In formula (Y-IV), at least one of $R_{12}$ and $R_{13}$ represents a group selected from a halogen atom, a cyano group, a nitro group, a trifluoromethyl, a carboxyl group, or one of the following groups, any of which may be substituted (except hydrogen), an alkoxycarbonyl group having C-number of 2 to 24, a carbonamido group having C-number of 1 to 24, a sulfonamido group having C-number of 1 to 24, a carbamoyl group having C-number of 1 to 24, a sulfamoyl group having C-number of 0 to 24, an alkylsulfonyl group having C-number of 1 to 24, an arylsulfonyl group having C-number of 6 to 24, and an acyl group having C-number of 1 to 24 and the other is a hydrogen atom, an alkyl group (as defined above), or an alkoxy group having C-number of 1 to 24; $R_{14}$ has the same meaning as that of $R_{12}$ or $R_{13}$; and m is an integer of 0 to 2. The total number of carbon atoms of the aryloxy group represented by formula (Y-IV) is 6 to 30, preferably 6 to 24, and more preferably 6 to 15.

Formula (Y-V)

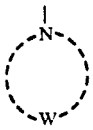

wherein W together with the N represents a group of nonmetallic atoms required to form a pyrrole ring, a pyrazole ring, an imidazole ring, or a triazole ring and the ring represented by

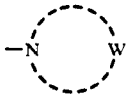

may be substituted (examples of the substituent are preferably a halogen atom, a nitro group, a cyano group, an alkoxycarbonyl group, an alkyl group, an aryl group, an amino group, an alkoxy group, an aryloxy group, and a carbamoyl group). The total C-number of the heterocyclic group represented by formula (Y-V) is 2 to 30, preferably 2 to 24, and more preferably 2 to 16.

Most preferably Y is a group represented by formula (Y-III).

The coupler represented by formula (Y-II) may form a dimer or higher polymer by bonding through a divalent or higher valent group at the substituent $R_1$, Q, X, or

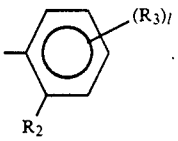

In that case, the total C-number may fall outside the range of the total C-number stated in each of the above substituents.

Specific examples of yellow coupler represented by formula (Y-II) are shown below:

Y-1

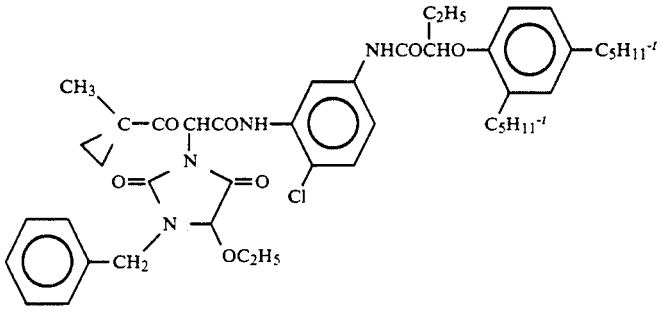

Y-2

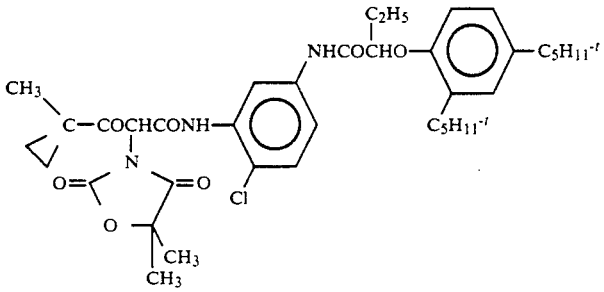

Y-3

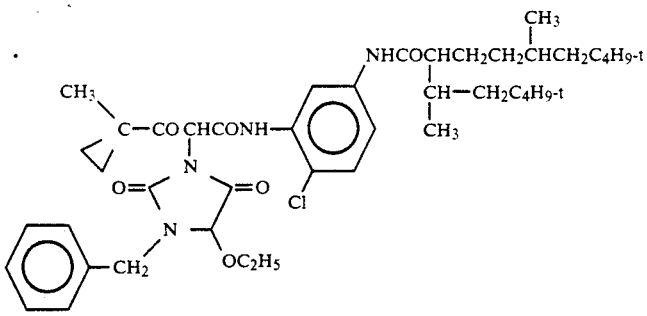

Y-4

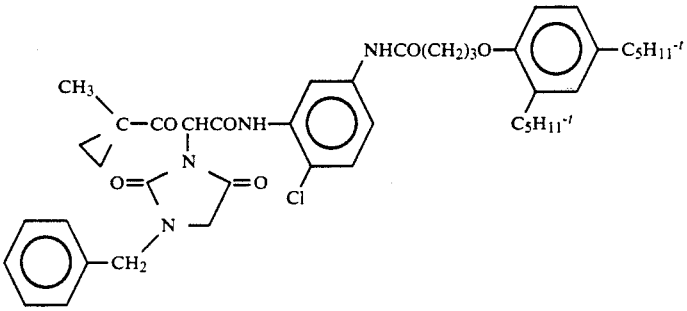

-continued
Y-5
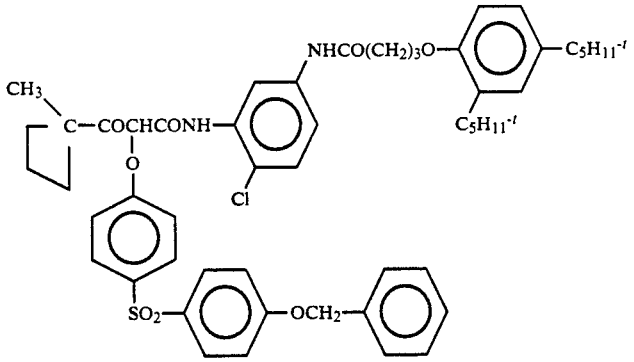
Y-6
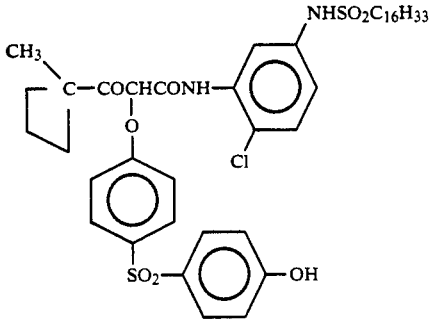
Y-7
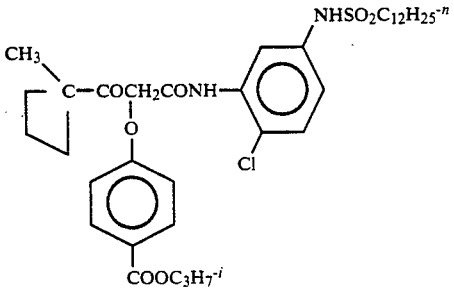
Y-8
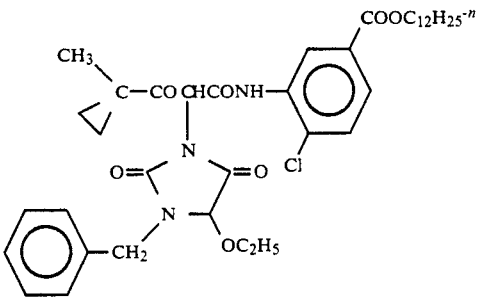
Y-9
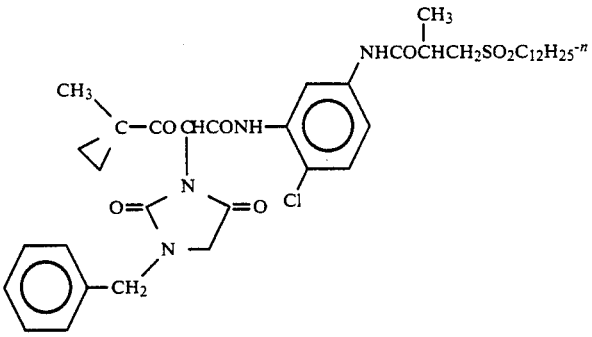
Y-10
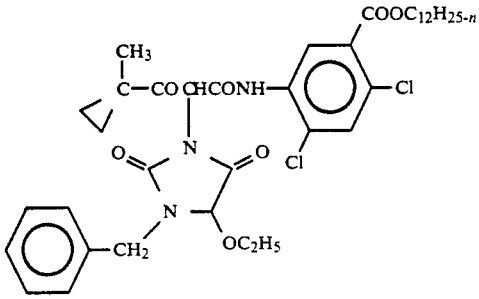
Y-11
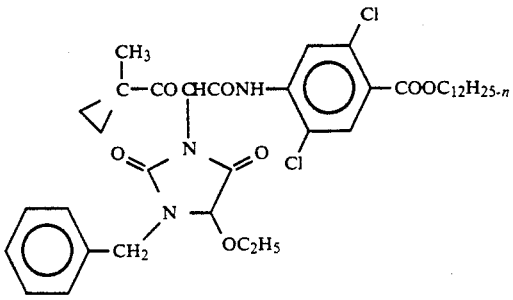

-continued
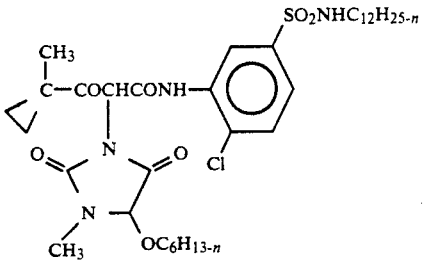
Y-12
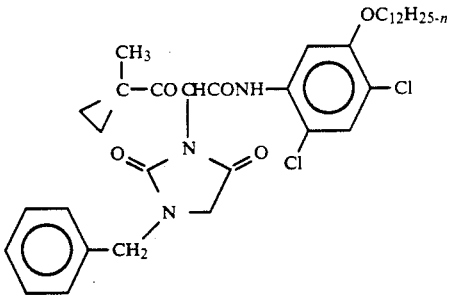
Y-13
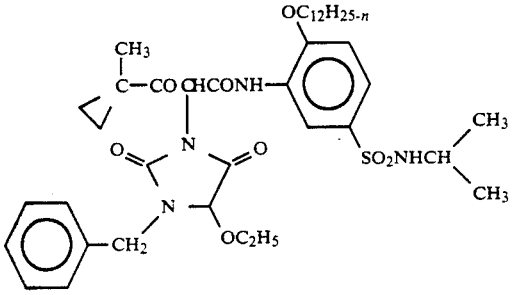
Y-14
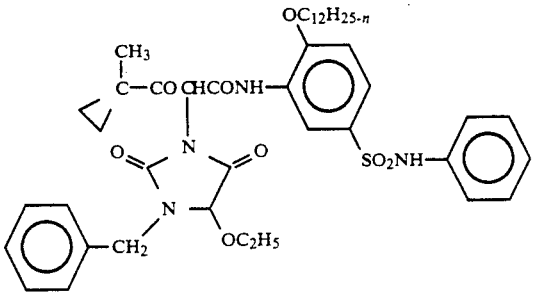
Y-15
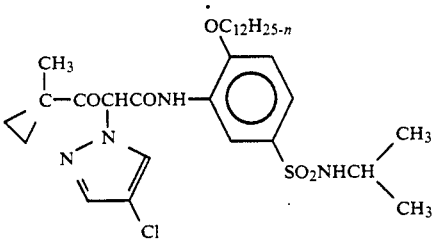
Y-16
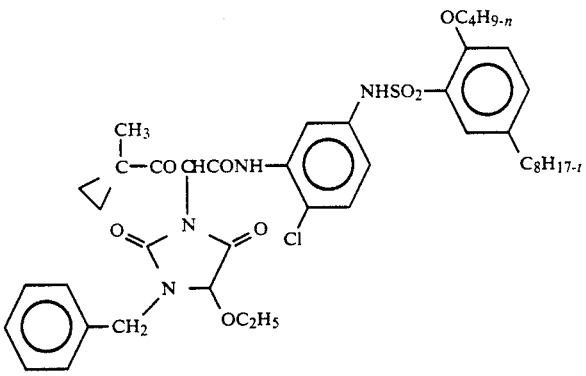
Y-17
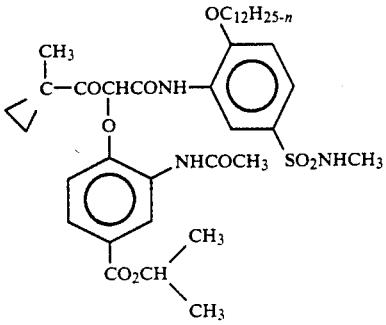
Y-18
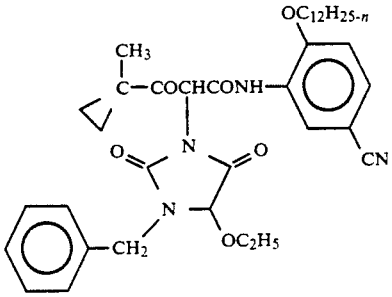
Y-19

-continued
Y-20
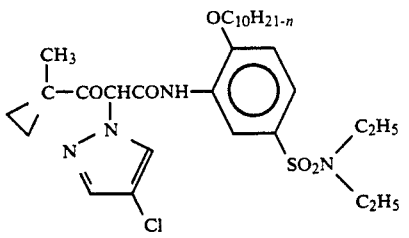
Y-21
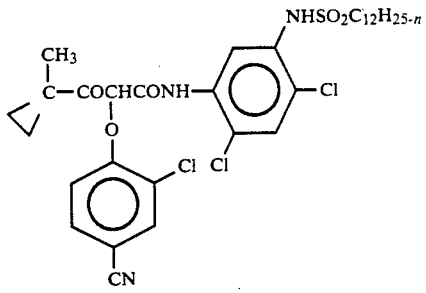
Y-22
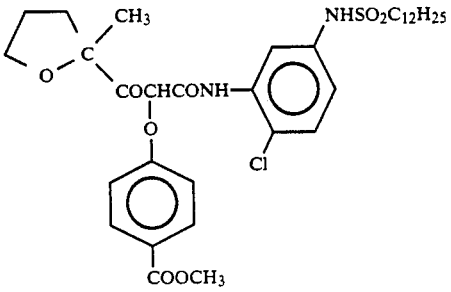
Y-23
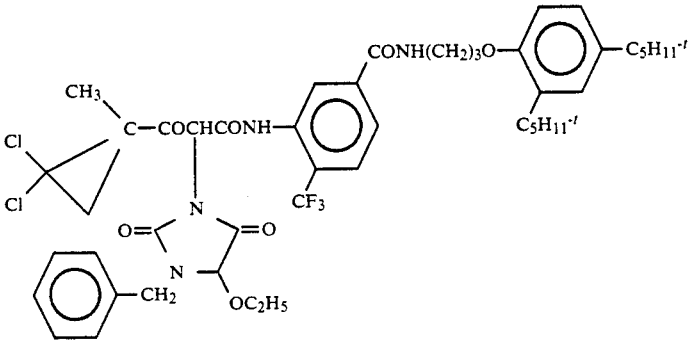
Y-24
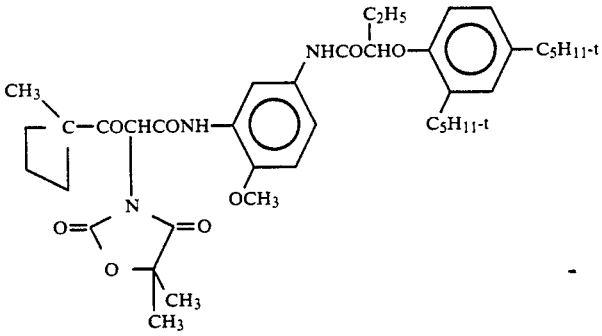
Y-25
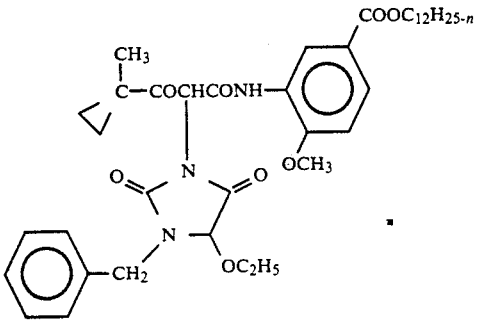
Y-26
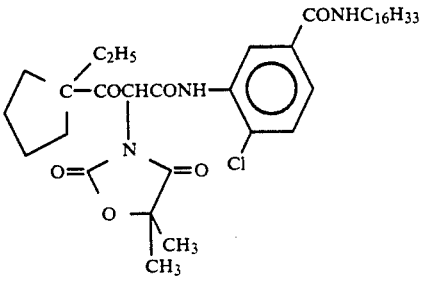

-continued
Y-27
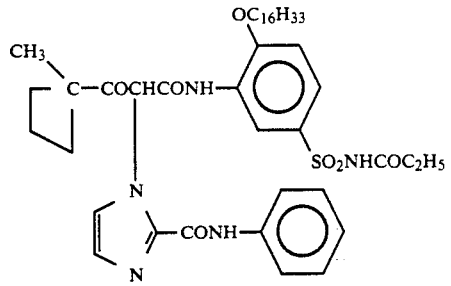
Y-28
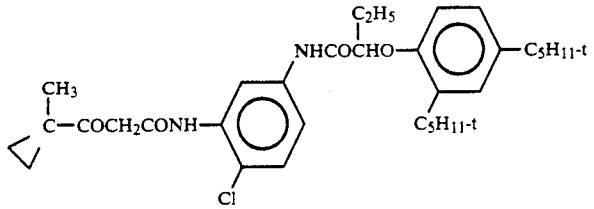
Y-29
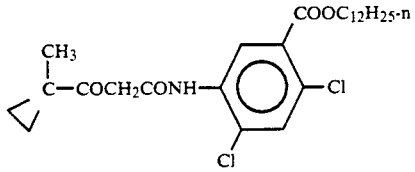
Y-30
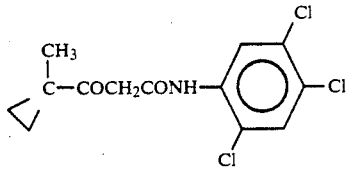
Y-31
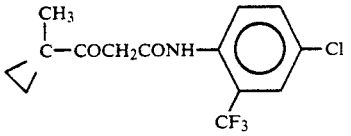
Y-32
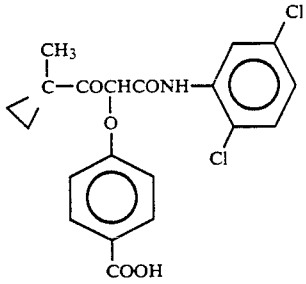
Y-33
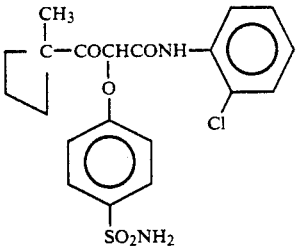
Y-34
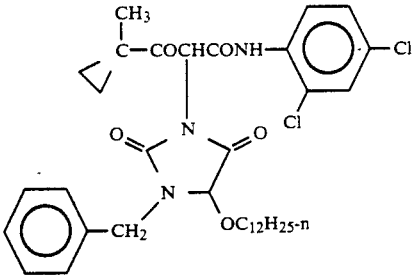
Y-35
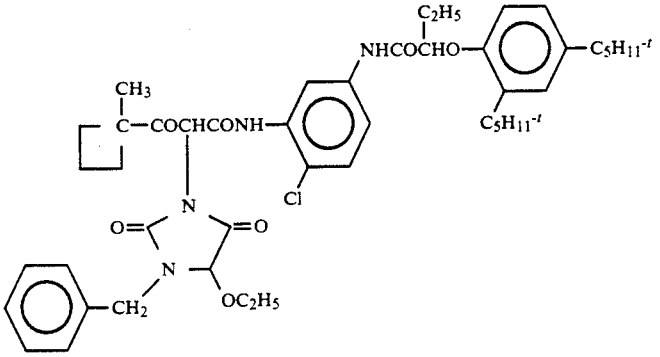

-continued
Y-36
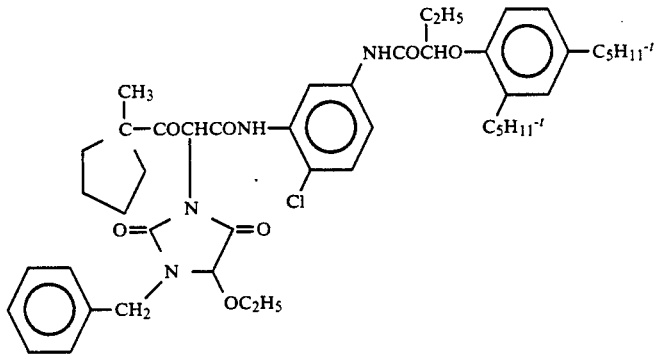
Y-37
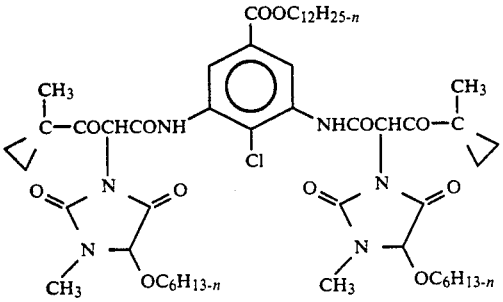
Y-38
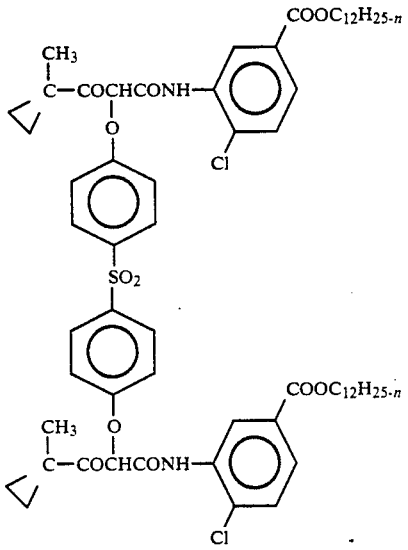
Y-39
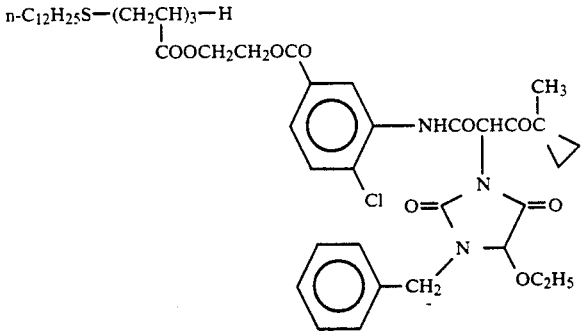
Y-40
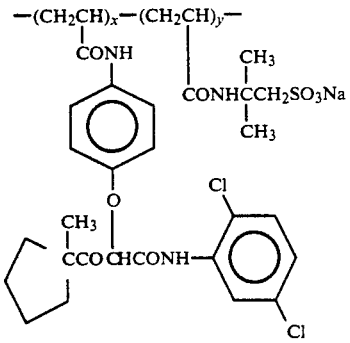
x:y = 80:20 (in wt. ratio)
Number-av. mol. wt. = 70,000
Y-41
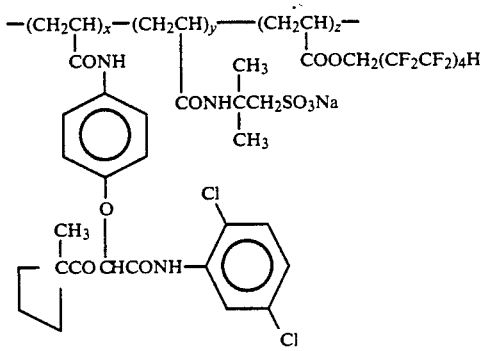
x:y:z = 50:30:20 (in wt. ratio)
Number-av. mol. wt. = 70,000

The yellow coupler represented by formula (Y-II) of the present invention can be synthesized according to the following synthesis route.

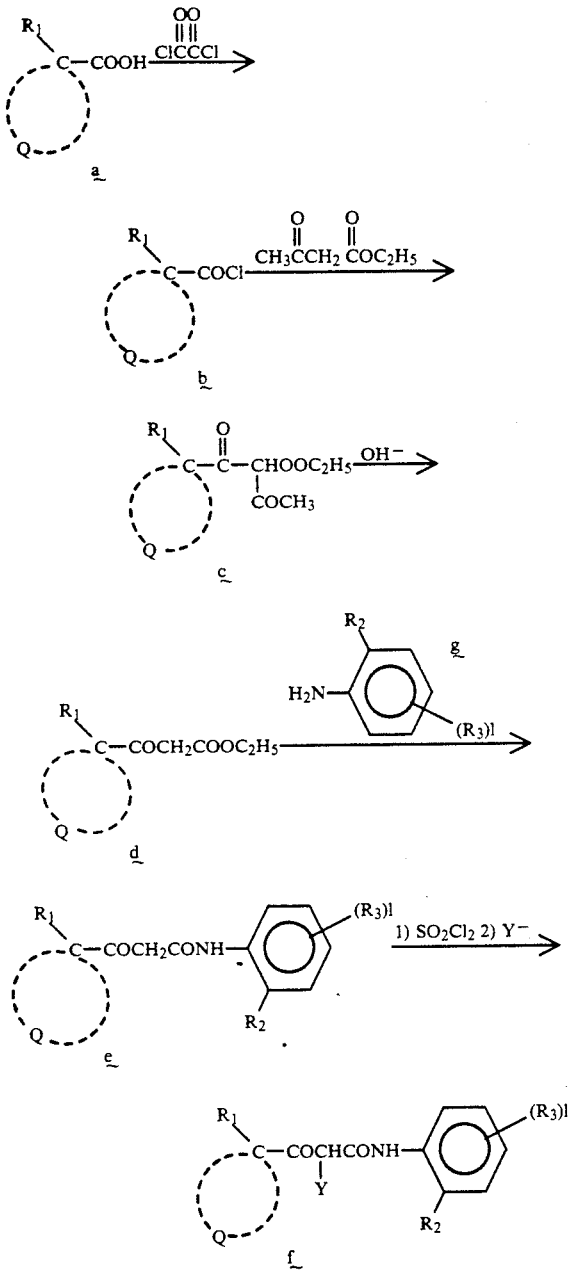

The compound a is synthesized by processes described, for example, in *J. Chem. Soc.* (C), 1968, 2548; *J. Am. Chem. Soc.*, 1934, 56, 2710; *Synthesis*, 1971, 258; *J. Org Chem.*, 1978, 43, 1729, and CA, 1960, 66, 18533y.

Compounds b, c, d, e and f, can be synthesized by conventionally known methods. Synthesis examples of couplers of the present invention will be described below.

Synthesis Example 1

Synthesis of Exemplified Compound Y-28

38.1 g of oxyalyl chloride was added dropwise to a mixture of 25 g of 1-methylcyclopropanecarboxylic acid synthesized according to the method described by Gotkis, D., et al. in *J. Am. Chem. Soc.*, 1934, 56, 2710, 100 ml of methylene chloride, and 1 ml of N,N-dimethylformamide over 30 min at room temperature. After the addition, the reaction was continued for 2 hours at room temperature and then the methylene chloride and excess oxalyl chloride were removed under reduced pressure by an aspirator, thereby obtaining an oil of 1-methylcyclopropanecarbonyl chloride.

100 ml of methanol was added dropwise to a mixture of 6 g of magnesium and 2 ml of carbon tetrachloride over 30 min at room temperature, and after the mixture was refluxed for 2 hours by heating, 32.6 g of ethyl 3-oxobutyrate was added dropwise over 30 min under heating and reflux. After the addition, the heating was continued for 2 hours and then the methanol was distilled off completely under reduced pressure by an aspirator. 100 ml of tetrahydrofuran was added to the reaction product to disperse the reaction product, and the previously prepared 1-methylcyclopropanecarbonyl chloride was added dropwise at room temperature. After the reaction was continued for 30 min, the reaction liquid was subjected to extraction with 30 ml of ethyl acetate and a dilute aqueous sulfuric acid solution, then after washing with water, the organic layer was dried over anhydrous sodium sulfate and the solvent was distilled off, thereby obtaining 55.3 g of an oil of ethyl 2-(1-methylcyclopropanecarbonyl)-3-oxobutyrate.

While a solution of 55 g of the ethyl 2-(1-methylcyclopropanecarbonyl)-3-oxobutyrate and 160 ml of ethanol was stirred, 60 ml of 30% aqueous ammonia was added dropwise thereto over 10 min. Thereafter, stirring was continued for 1 hour, extraction with 300 ml of ethyl acetate and a dilute aqueous hydrochloric acid solution was carried out, and after neutralization and washing with water, the organic layer was dried over anhydrous sodium sulfate and the solvent was distilled off, thereby obtaining 43 g of an oil of ethyl (1-methylcyclopropanecarbonyl)acetate.

34 g of the ethyl (1-methylcyclopropanecarbonyl)acetate and 44.5 g of N-(3-amino-4-chlorophenyl)-2-(2,4-di-t-pentylphenoxy)butaneamide were heated under reflux and reduced pressure by an aspirator with the internal temperature kept at 100° to 120° C. After the reaction was continued for 4 hours, the reaction liquid was purified by column chromatography using a mixed solvent of n-hexane and ethyl acetate, thereby obtaining 49 g of a viscous oil of Exemplified Compound Y-28. The structure of the compound was identified by MS spectrum, NMR spectrum, and elemental analysis.

Synthesis Example 2

Synthesis of Exemplified Compound Y-1

22.8 g of the Exemplified Compound Y-28 was dissolved in 300 ml of methylene chloride, and 5.4 g of sulfuryl chloride was added to the solution over 10 min under cooling with ice. After the reaction had continued for 30 min, the reaction liquid was washed well with water, dried over anhydrous sodium sulfate, and condensed, thereby obtaining the chloride of the Exemplified Compound Y-28. The solution of the thus obtained chloride of the Exemplified Compound Y-28 was dissolved in 50 ml of N,N-dimethylformamide and was added dropwise to a solution of 18.7 g of 1-benzyl-5-ethoxyhydantoin in 11.2 ml of triethylamine and 50 ml of N,N-dimethylformamide over 30 min at room temperature.

Thereafter the reaction was allowed to continue for 4 hours at 40° C., and after the reaction liquid was extracted with 300 ml of ethyl acetate, thereafter washed with water and then washed with 300 ml of a 2% aqueous triethylamine solution. This was followed by neutralization with a dilute aqueous hydrochloric acid solution. After the organic layer was dried over anhydrous sodium sulfate, the solvent was distilled off, to obtain an oil, and the oil was subjected to crystallization from a mixed solvent of n-hexane and ethyl acetate. The deposited crystals were washed with a mixed solvent of n-hexane and ethyl acetate and then dried, to obtain 22.8 of crystals of the Exemplified Compound Y-1.

The structure of the compound was identified by MS spectrum, NMR spectrum, and elemental analysis. The melting point was 132° to 133° C.

The yellow coupler whose acyl group is represented by formula (Y-I) of the present invention may be used in the range from 1.0 to $1.0\times10^{-3}$ mol, preferably $5.0\times10^{-1}$ to $5.0\times10^{-2}$ mol, more preferably $4.0\times10^{-1}$ to $2.0\times10^{-2}$ mol, per mol of silver halide.

The yellow couplers whose acyl group is represented by formula (Y-I) of the present invention may be used as a mixture of two or more, and they also may be used in combination with other known couplers.

The coupler whose acyl group is represented by formula (Y-I) of the present invention can be introduced into a color photographic material by various known dispersing techniques.

In the oil-in-water dispersion method, a fine dispersion of the yellow coupler may be applied by using a low-boiling organic solvent (e.g., ethyl acetate, butyl acetate, methyl ethyl ketone, and isopropanol), so that the low-boiling organic solvent may not substantially remain in the dry film. If a high-boiling organic solvent is used, any one having a boiling point of 175° C. or higher at normal pressures may be used, and a mixture of two or more high-boiling organic solvents may be used. The weight ratio of the coupler of the present invention to the high-boiling organic solvent may be varied widely, but it will be in the range of 1 g of the coupler to 5.0 g or below, preferably 0 to 2.0, more preferably 0.01 to 1.0, of the high-boiling organic solvent.

The below-mentioned latex dispersion method can also be applied.

The coupler of the present invention may be used as a mixture with various couplers described below or may be present together with them.

The compound of formula (I) will now be described in detail.

$$A\text{-}(L)_n\text{-}(G)_m\text{-}(Time)_t\text{-}X \qquad \text{Formula (I)}$$

wherein A represents an oxidation-reduction (redox) residue or its precursor, which is an atomic group that allows $\text{-}(Time)_t$ to be released only upon oxidization during the photographic development processing, Time represents a group that will release X after being split off from the oxidized product of A, X represents a development retarder, L represents a bivalent linking group, G represents a polarizable group, and n, m, and t each are 0 or 1.

The oxidation-reduction residue represented by A is one according to Kendall-Pelz law and includes hydroquinone, catechol, p-aminophenol, o-aminophenol, 1,2-naphthalenediol, 1,4-naphthalenediol, 1,6-naphthalenediol, 1,2-aminonaphthol, 1,4-aminonaphthol, 1,6-aminonaphthol, a gallic acid ester, a gallic acid amide, hydrazine, hydroxylamine, pyrazolidone, and reductone.

Preferably, the amino group of the oxidation reduction residue is substituted by a sulfonyl group having 1 to 25 carbon atoms or an acyl group having 1 to 25 carbon atoms. As the sulfonyl group, a substituted or unsubstituted aliphatic sulfonyl group or aromatic sulfonyl group can be mentioned. As the acyl group, a substituted or unsubstituted aliphatic acyl group or aromatic acyl group can be mentioned. The hydroxyl group or amino group that forms the oxidation-reduction residue of A may be protected by a protecting group that can be released at the time of development processing. As examples of the protecting group, an acyl group, an alkoxycarbonyl group, and a carbamoyl group that have 1 to 25 carbon atoms, and protecting groups described in JP-A Nos. 197037/1984 and 201057/1984 can be mentioned. If possible, the protecting group may bond to the below-mentioned substituent of A to form a 5-, 6-, or 7-membered ring.

The oxidation-reduction residue represented by A may be substituted by a substituent in a substitutable position. As examples of the substituent can be mentioned those having carbon atom numbers of 25 or below, for example, an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, a cyano group, a halogen atom, an acyl group, a carboxyl group, a sulfo group, a nitro group, a heterocyclic residue, and $\text{-}(L)_n(G)_m(Time)_t\text{-}X$, which may be substituted by the substituent mentioned above. If possible, these substituents may bond together to form a saturated or unsaturated carbon ring or heterocyclic ring.

Preferable examples of A are hydroquinone, catechol, p-aminophenol, o-aminophenol, 1,4-naphthalenediol, 1,4-aminonaphthol, a gallic acid ester, a gallic acid amide, and hydrazine. More preferably A represents hydroquinone, catechol, p-aminophenol, o-aminophenol, or hydrazine, with hydroquinone and hydrazine being most preferable.

L represents a bivalent linking group and preferably includes alkylene, alkenylene, arylene, oxyalkylene, oxyarylene, aminoalkyleneoxy, aminoalkenyleneoxy, aminoaryleneoxy, and an oxygen atom.

G represents an acidic group and preferably $$-\overset{O}{\overset{\|}{C}}-,\ -\overset{O}{\overset{\|}{C}}-\overset{O}{\overset{\|}{C}}-,\ -\overset{S}{\overset{\|}{C}}-,\ -SO-,\ -SO_2-,$$

$$-\overset{O}{\overset{\|}{\underset{\underset{OR^{15}}{|}}{P}}}-,\ \text{or}\ -\overset{N-R^{16}}{\overset{\|}{C}}-,$$

wherein $R^{15}$ represents alkyl, aryl, or a heterocyclic ring and $R^{16}$ represents a hydrogen atom or has the same meaning as $R^{15}$. Preferably G represents

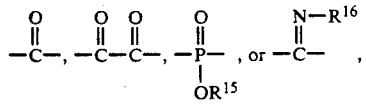

more preferably

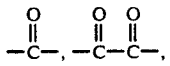

most preferably

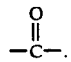

n and m each are 0 or 1, the preference depending on the type of A. For example, if A represents hydroquinone, catechol, aminophenol, naphthalenediol, aminonaphthol, or a gallic acid, n is preferably 0 and more preferably n=m=0. If A represents hydrazine or hydroxylamine, preferably n=0 and m=1, and if A represents pyrazolidone, preferably n=m=1.

$\text{-}(\text{Time})_T\text{X}$ is a group that will be released as $\ominus\ \text{-}(\text{Time})_T\text{-X}$ only when the oxidation-reduction residue represented by A in formula (I) undergoes cross oxidation reaction at the time of development to be converted to the oxidized product.

Time preferably is linked to G through a sulfur atom, a nitrogen atom, an oxygen atom, or a selenium atom.

Time represents a group that can release X afterward, and Time may have a timing-adjusting function and may be a coupler that can release X upon reaction with the oxidized product of a developing agent or an oxidation-reduction group.

When Time is a group having a timing-adjusting function, examples are those described, for example, in U.S. Pat. Nos. 4,248,962 and 4,409,323, British Patent No. 2,096,783, U.S. Pat. No. 4,146,396, and JP-A Nos. 146828/1976 and 56837/1982. Time may comprise a combination of two or more selected from those described therein.

Preferable examples of the timing adjusting group are:

(1) Groups that use cleavage reaction of the hemiacetal.

Such groups are described, for example, in U.S. Pat. No. 4,146,396 and JP-A Nos. 249148/1985 and 249149/1985 and are represented by the following formula:

Formula (T-1)

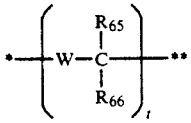

wherein a mark * indicates the position where it is bonded to the left side in formula (I), a mark ** indicates the position where it is bonded to the right side in formula (I), W represents an oxygen atom, a sulfur atom, or

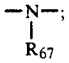

$R_{65}$ and $R_{66}$ each represent a hydrogen atom or a substituent; $R_{67}$ represents a substituent, t is 1 or 2; and when t is 2, two

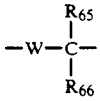

may be the same or different; typical examples of the substituents represented by $R_{65}$, $R_{66}$, and $R_{67}$ each include, for example, a $_{69}$ group, $_{69}CO$— group, a $_{69}SO_2$— group,

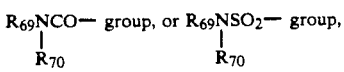

in which $_{69}$ represents an aliphatic group, an aromatic group, or a heterocyclic group, $R_{70}$ represents an aliphatic group, an aromatic group, a heterocyclic group; or a hydrogen atom, and $R_{65}$, $R_{66}$, and $R_{67}$ represent each a bivalent group and may bond together to form a cyclic structure.

(2) Groups that cause cleavage reaction by using intramolecular nucleophilic substitution.

Examples are timing groups that are described, for example, in U.S. Pat. No. 4,248,962 and can be represented by the following formula:

*—Nu—Link—E—** Formula (T-2)

wherein a mark * indicates the position where it is bonded to the left side in formula (I), a mark  o-, indicates the position where it is bonded to the right side in formula (I), Nu represents a nucleophilic group such as an oxygen atom or a sulfur atom, E represents an electrophilic group, that can be nucleophilically attacked from Nu to cleave the bond to the mark , and Link represents such a linking group that relates sterically Nu and E so that they may undergo intramolecular nucleophilic substitution.

(3) Groups that cause cleavage reaction by using electron transfer reaction along the conjugated system. Such groups are described, for example, in U.S. Pat. Nos. 4,409,323 and 4,421,845 and are represented by the following formula:

Formula (T-3)

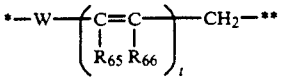

wherein a mark *, a mark **, W, $R_{65}$, $R_{66}$, and t have the same meanings as those described for (T-1).

(4) Groups that use cleavage reaction by hydrolysis of esters.

Examples are linking groups described in German Patent (OLG) No. 2,626,315 and include the following groups:

Formula (T-4)

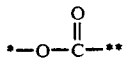

Formula T-5)

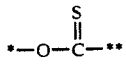

wherein marks * and ** have the same meanings as those described for formula (T-1).

(5) Groups that use cleavage reaction of iminoketals.

Examples are linking groups that are described, for example, in U.S. Pat. No. 4,546,073 and are represented by the following structure:

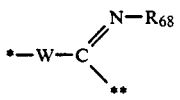

Formula (T-6)

wherein marks * and ** and W have the same meanings as those described for (T-1) and $R^{68}$ has the same meaning as $R_{67}$.

Examples of groups wherein the group represented by D is a coupler or oxidation-reduction group are the following.

In the case wherein the coupler is a phenol coupler, those can be mentioned which are bonded to G of formula (I) at the oxygen atom by removing the hydrogen atom of the hydroxyl group. In the case of a 5-pyrazolone coupler, those can be mentioned which are bonded to G at the oxygen atom by removing the hydrogen atom from the hydroxyl group tautomerized to 5-hydroxypyrazole. Only when these are split from G do they function as couplers and react with the oxidized product of a developing agent to release X bonded to their coupling position Preferable examples wherein Time is a coupler have the following formulas (C-1) to (C-4):

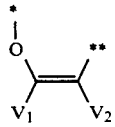

Formula (C-1)

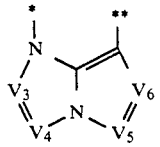

Formula (C-2)

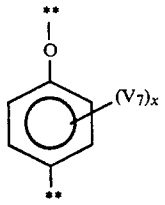

Formula (C-3)

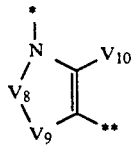

Formula (C-4)

wherein $V_1$ and $V_2$ each represent a substituent, $V_3$, $V_4$, and $V_6$ each represent a nitrogen atom or a substituted or unsubstituted methine group, $V_7$ represents a substituent, x is an integer of 0 to 4, when x is 2 to 4, groups $V_7$ may be the same or different and two $V_7$s may bond together to form a cyclic structure, $V_8$ represents a —CO— group, a —$SO_2$— group, an oxygen atom, or a substituted imino group, $V_9$ represents a group of nonmetalic atoms required to form a 5- to 8-membered ring together with

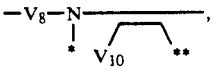

and $V_{10}$ represents a hydrogen atom or a substituent.

If the group represented by Time in formula (I) is an oxidation-reduction group, preferably the group is represented by the following formula (R-1):

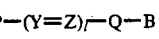

Formula (R-1)

wherein P and Q each independently represent an oxygen atom or a substituted or unsubstituted imino group, at least one of Y and Z that are l in number represents a methine group having X as a substituent and the remaining Y and Z each represent a substituted or unsubstituted methine group or a nitrogen atom, l is an integer of 1 to 3 (Y and Z that are l in number may be the same or different), B represents a hydrogen atom or a group removable by an alkali, and any two of substituents represented by P, Y, Z, Q, and B may bond together to form a cyclic structure. For example, $(Y=Z)_l$ forms a benzene ring or a pyridine ring.

When P and Q each represent a substituted or unsubstituted imino group, preferably it is an imino group substituted by a sulfonyl group or an acyl group.

In that case, P and Q can be represented as follows:

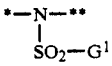

Formula (N-1)

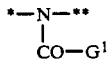

Formula (N-2)

wherein a mark * indicates the position where it is bonded to G of formula (I) or B of formula (R-1), a mark ** indicates the position where it is bonded to one of the free valences of $(Y=Z)_l$—, and $G^1$ represents an aliphatic group, an aromatic group, or a heterocyclic group.

Particularly preferable groups of the groups represented by formula (R-1) can be represented by the following formula (R-2) or (R-3):

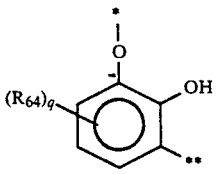

Formula (R-2)

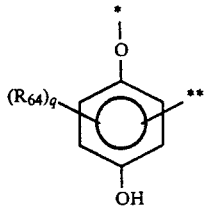

Formula (R-3)

wherein a mark * indicates the position where it is bonded to G of formula (I), a mark ** indicates the position where it is bonded to X, $R_{64}$ represents a substituent, q is an integer of 1 to 3; when q is 2 or over, two or more $R_{64}$s may be the same or different, and when two $R_{64}$s are substituents on adjacent carbon atoms, they may be divalent groups to bond together to form a cyclic structure.

X stands for a development retarder. Preferable examples of X include compounds having a mercapto group bonded to a heterocycle represented by formula (X-1) or heterocyclic compounds capable of forming imino silver represented by formula (X-2):

Formula (X-1)

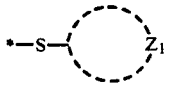

Formula (X-2)

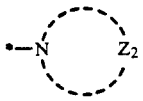

wherein $Z_1$ represents a group of nonmetallic atoms required to form a monocyclic or condensed heterocyclic ring and $Z_2$ represents a group of nonmetallic atoms required to form together with the N a monocyclic or condensed heterocyclic ring, which heterocyclic rings each may have a substituent, and * indicates the position where it is bonded to Time. More preferably, the heterocyclic rings formed by $Z_1$ and $Z_2$ are 5- to 8-membered, most preferably 5- to 6-membered, heterocyclic rings having at least one of nitrogen, oxygen, sulfur, and selenium as a hetero atom.

Examples of the heterocyclic ring represented by $Z_1$ are azoles (e.g., tetrazole, 1,2,4-triazole, 1,2,3-triazole, 1,3,4-thiadiazole, 1,3,4-oxadiazole, 1,3-thiazole, 1,3-oxazole, imidazole, benzothiazole, benzoxazole, benzimidazole, pyrrole, pyrazole, and indazole), azaindenes (e.g., tetrazaindene, petazaindene, and triazaindene), and azines (e.g., pyrimidine, triazine, pyradine, and pyridazine).

Examples of the heterocyclic ring represented by $Z_2$ include triazoles (e.g., 1,2,4-triazole, benzotriazole, and 1,2,3-triazole), indazole, benzimidazole, and azaindenes (e.g., tetrazaindene and pentazaindene), and tetrazole.

Preferable substituents possessed by the development retarders represented by formulas (X-1) and (X-2) include a group $R_{77}$, a group $R_{78}O$—, a group $R_{77}S$—, a group $R_{77}OCO$—, a group $R_{77}OSO_2$—, a halogen atom, a cyano group, a nitro group, a group $R_{77}SO_2$—, a group $R_{78}CO$—, a group $R_{77}COO$—

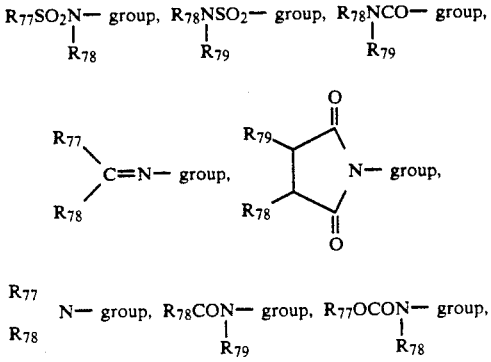

-continued

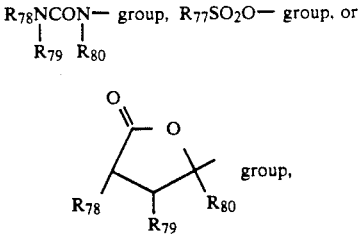

represents an aliphatic group, an aromatic group, or a heterocyclic group, $R_{78}$, $R_{79}$, and $R_{80}$ each represent an aliphatic group, an aromatic group, a heterocyclic group, or a hydrogen atom, and when there are two or more $R_{77}$, $R_{78}$, and $R_{80}$ in the molecule, they may be bonded to form a ring (e.g., a benzene ring). Examples of the compound represented by formula (X-1) include substituted or unsubstituted mercaptoazoles (e.g., 1-phenyl-5-mercaptotetrazole, 1-propyl-5-mercaptotetrazole, 1-butyl-5-mercaptotetrazole, 2-methylthio-5-mercapto-1,3,4-thiadiazole, 3-methyl-4-phenyl-5-mercapto-1,2,4-triazole, 1-(4-ethylcarbamoylphenyl)-2-mercaptoimidazole, 2-mercaptobenzoxazole, 2-mercaptobenzimidazole, 2-mercaptobenzothiazole, 2-mercaptobenzoxazole, 2-phenyl-5-mercapto-1,3,4-oxadiazole, 1-{3-(3-methylureido)phenyl)}-5-mercaptotetrazole, 1-(4-nitrophenyl)-5-mercaptotetrazole, and 5-(2-ethylhexanoylamino)-2-mercaptobenzimidazole), substituted or unsubstituted mercaptoazaindenes (e.g., 6-methyl-4-mercapto-1,3,3a,7-tetrazaindene and 4,6-dimethyl-2-mercapto-1,3,3a,7-tetrazaindene), and substituted or unsubstituted mercaptopyrimidines (e.g., 2-mercaptopyrimidine and 2-mercapto-4-methyl-6hydroxypyrimidine).

Heterocyclic compounds capable of forming imino silver include, for example, substituted or unsubstituted triazoles (e.g., 1,2,4-triazole, benztriazole, 5-methylbenzotriazole, 5-nitrobenzotriazole, 5-bromobenzotriazole, 5-n-butylbenzotriazole, and 5,6-dimethylbenzotriazole), substituted or unsubstituted indazoles (e.g., indazole, 5-nitroindazole, 3-nitroindazole, and 3-chloro-5-nitroindazole), and substituted or unsubstituted benzimidazoles (e.g., 5-nitrobenzimidazole and 5,6-dichlorobenzimidazole).

X may be one which can split from Time of formula (I) to form once a compound having development retarding property and then to undergo a certain chemical reaction with a component in a developing solution to change to a compound having substantially no development retarding property or having remarkably reduced developing retarding property. As functional groups that undergo such a chemical reaction, for example, an ester group, a carbonyl group, an imino group, an immonium group, a Michael addition accepting group, and an imido group can be mentioned.

As examples of such deactivation type development retarders, development retarder residues can be mentioned which are described, for example, in U.S. Pat. No. 4,477,563 and JP-A Nos. 218644/1985, 221750/1985, 233650/1985, and 11743/1986.

Among these, those having an ester group are particularly preferable and specific examples are 1-(3-phenoxycarbonylphenyl)-5-mercaptotetrazole, 1-(4-phenoxycarbonylphenyl)-5-mercaptotetrazole, 1-(3-maleinimidophenyl)-5-mercaptotetrazole, 5-phenoxycarbonylbenzotriazole, 5-(4-cyanophenoxycarbonyl)- benzotriazole, 2-phenoxycarbonylmethylthio-5-mercapto-1,3,4-thiadiazole, 5-nitro-3-phenoxycarbonylimidazole, 5-(2,3-dichloropropyloxycarbonyl)-benzotriazole, 1-(4-benzoyloxyphenyl)-5-mercaptotetrazole, 5-(2-methanesulfonylethoxycarbonyl)-2-mercaptobenzothiazole, 5-cinnamoylaminobenzoyltriazole, 1-(3-vinylcarbonylphenyl)-5-mercaptotetrazole, 5-succinimidomethylbenzotriazole, 2-{4-succinimidophenyl}-5-mercapto-1,3,4-oxadiazole, 6-phenoxycarbonyl-2-mercaptobenzoxazole, 2-(1-methoxycarbonylethylthio)-5-mercapto-1,3,4-thiadiazole, 2-butoxycarbonylmethoxycarbonylmethylthio-5-mercapto-1,3,4-thiadiazole, 2-(N-hexylcarbamoylmethoxycarbonylmethylthio)-5-mercapto-1,3,4-thiadiazole, and 5-butoxycarbonylmethoxycarbonylbenzotriazle.

Among the compounds represented by formula (I), compounds represented by the following formulas (II) and (III) are more preferable.

Formula (II)

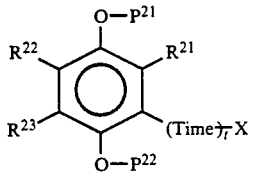

wherein $R^{21}$ and $R^{23}$ each represent a hydrogen atom or a group substitutable on the hydroquinone nucleus, $P^{21}$ and $P^{22}$ each represent a hydrogen atom or a protecting group that can be released at the time of development processing, and Time, X, and t have the meanings defined in formula (I).

Formula (III)

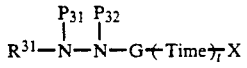

wherein $R^{31}$ represents an aryl group, a heterocyclic group, an alkyl group, an aralkyl group, an alkenyl group, or an alkynyl group, $P^{31}$ and $P^{32}$ each represent a hydrogen atom or a protecting group that can be released at the time of development processing, and G, Time, X, and t have the meanings defined in formula (I).

Formula (II) will be described in more detail. As the substituents represented by $R^{21}$ to $R^{23}$, for example, those substituents on A of formula (I) described above can be mentioned. Preferably, $R^{22}$ and $R^{23}$ each represent a hydrogen atom, an alkylthio group, an arylthio group, an alkoxy group, an aryloxy group, an amido group, a sulfonamido group, an alkoxycarbonylamino group, and a ureido group, more preferably a hydrogen atom, an alkylthio group, an alkoxy group, an amido group, a sulfonamido group, an alkoxycarbonylamino group, or a ureido group.

Preferably, $R^{21}$ represents a hydrogen atom, a carbamoyl group, an alkoxycarbonyl group, a sulfamoyl group, a sulfonyl group, a cyano group, an acyl group, and a heterocyclic group; more preferably a hydrogen atom, a carbamoyl group, an alkoxycarbonyl group, a sulfamoyl group, or a cyano group. $R^{22}$ and $R^{23}$ may bond together to form a ring.

As examples of the protecting groups represented by $P^{21}$ and $P^{22}$, for example, those protective groups for the hydroxyl group of A of formula (I) described above can be mentioned. Preferable examples are hydrolyzable groups, such as an acyl group, an alkoxycarbonyl group, an aryloxycarbonyl group, a carbamoyl group, an imidoyl group, an oxazolyl group, and a sulfonyl group; precursor groups described in U.S. Pat. No. 4,009,029, which use reverse Michael reaction; precursor groups described in U.S. Pat. No. 4,310,612, which use as an intramolecular nucleophilic group an anion that is produced after ring cleavage reaction; precursor groups described in U.S. Pat. Nos. 3,674,478, 3,932,480, and 3,993,661, which cause cleavage reaction by electron transfer of an anion through a conjugated system; precursor groups described in U.S. Pat. No. 4,335,200, which cause cleavage reaction by electron transfer of an anion reacted after ring cleavage; and precursor groups described in U.S. Pat. Nos. 4,363,865 and 4,410,618, which use an imidomethyl group.

Preferably $P^{21}$ and $P^{22}$ each represent a hydrogen atom.

Preferably X represents a mercaptoazole or a benzotriazole. As the mercaptoazole, a mercaptotetrazole, a 5-mercapto-1,3,4-thiadiazole, and a 5-mercapto-1,3,4-oxadiazole are more preferable.

Most preferably X represents a 5-mercapto-1,3,4-thiadiazole.

Out of the compounds represented by formula (II), those represented by the following formulas (IV) and (V):

Formula (IV)

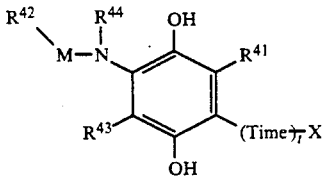

Formula (V)

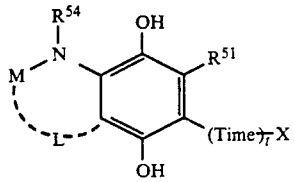

wherein $R^{42}$ represents an aliphatic group, an aromatic group, or a heterocyclic group, M represents

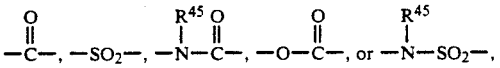

$R^{44}$, $R^{45}$, and $R^{54}$ each represent a hydrogen atom, an alkyl group, or an aryl group.

L represents a divalent linking group required to form a 5- to 7-membered ring. $R^{41}$ and $R^{51}$ each have meaning as $R^{23}$ in formula (II), and $\text{-(Time)}_t\text{-X}$ has the same meaning as $\text{-(Time)}_t\text{-X}$ in formula (II). In more detail, the aliphatic group represented by $R^{42}$ is a linear, branched, or cyclic alkyl, alkenyl, or alkynyl group having 1 to 30 carbon atoms. The aromatic group represented by $R^{42}$ is a phenyl or naphthyl group having 6 to 30 carbon atoms. The heterocyclic group represented by $R^{42}$ is a 3- to 12-membered heterocyclic ring containing at least one of nitrogen, oxygen, and sulfur. These groups may be substituted by substituents described for A.

Formula (III) will be further described in detail.

The aryl group represented by $R^{31}$ includes those that have 6 to 20 carbon atoms, such as a phenyl group and a naphthyl group. As the heterocyclic group can be mentioned a 5- to 7-membered heterocyclic group containing at least one of nitrogen, oxygen, and sulfur such as furyl and pyridyl. As the alkyl group, can be mentioned those which have 1 to 30 carbon atoms, such as methyl, hexyl, and octadecyl. As the aralkyl group can be mentioned those that have 7 to 30 carbon atoms, such as benzyl and trityl. As the alkenyl group can be mentioned those that have 2 to 30 carbon atoms, such as aryl. As the alkynyl group can be mentioned those that have 2 to 30 carbon atoms, such as propargyl. Preferably $R^{31}$ represents an aryl group, more preferably a phenyl group.

Preferably G represents

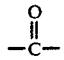

and X represents those described for formula (II).

$R^{21}$ to $R^{23}$ of formula (II) and $R^{31}$ of formula (III) may be substituted by a substituent. The substituent may have an adsorption group to a so-called ballasting group or silver halides for giving a nondiffusible property, and preferably the substituent has a ballasting group. When $R^{31}$ represents a phenyl group, the substituent is preferably an electron-donating group, such as a sulfonamido group, an amido group, an alkoxy group, and a ureido group. When $R^{21}$, $R^{22}$, $R^{23}$, or $R^{24}$ has a ballasting group, particularly preferably the molecule has therein a polar group, such as a hydroxyl group, a carboxyl group, and a sulfonyl group.

To describe the present invention more concretely, specific examples of the compound represented by formula (I) are shown below, but the present invention is not restricted to them.

I-1

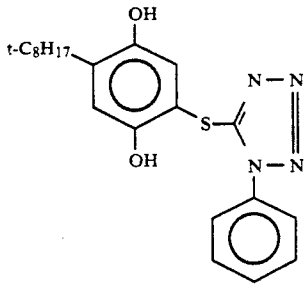

I-2

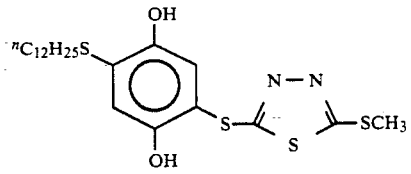

I-3

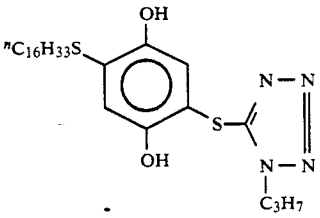

I-4

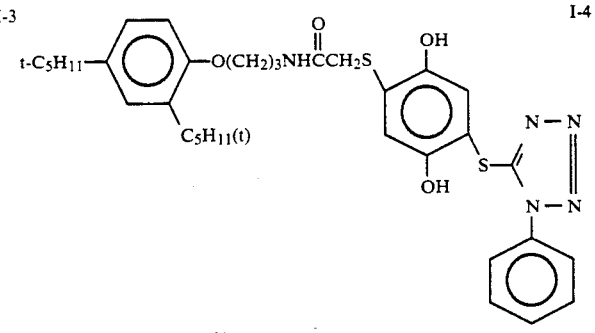

I-5

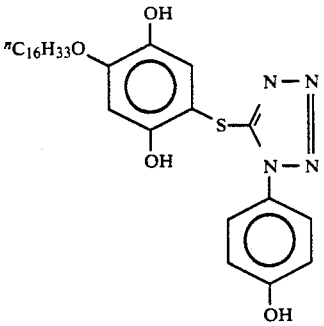

I-6

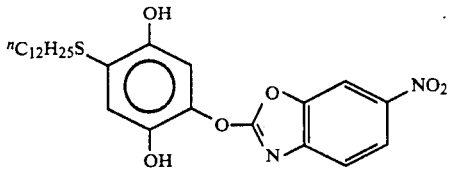

I-7

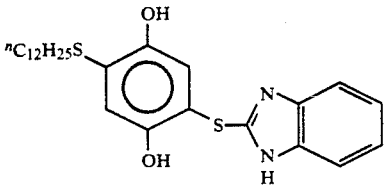

I-8

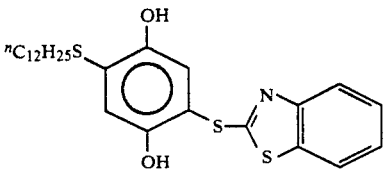

-continued
I-9
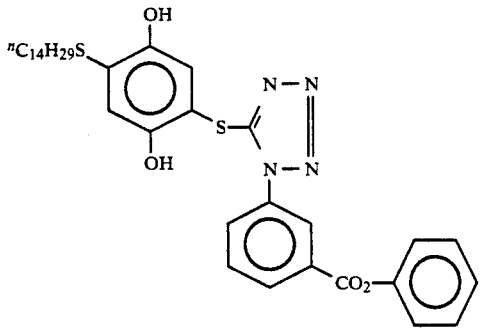
I-10
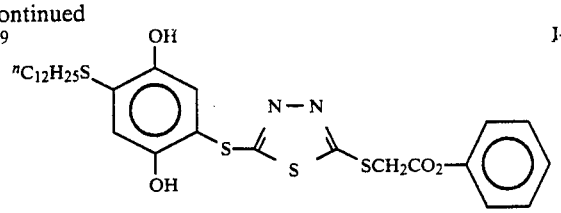
I-11
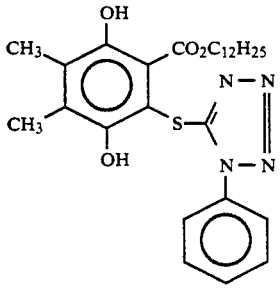
I-12
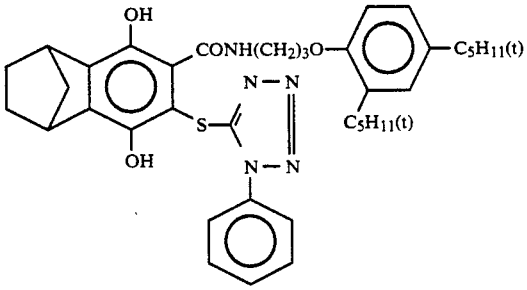
I-13
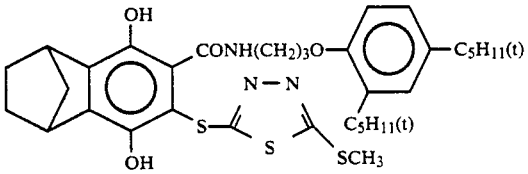
I-14
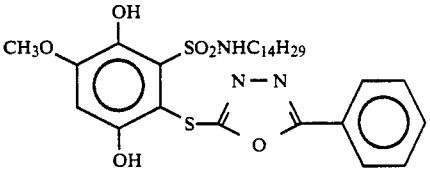
I-15
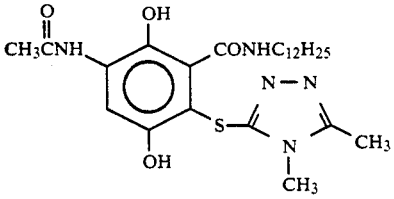
I-16
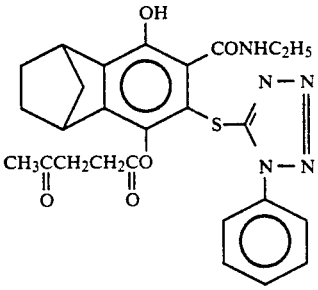
I-17
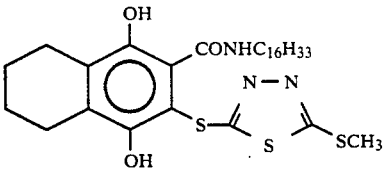
I-18
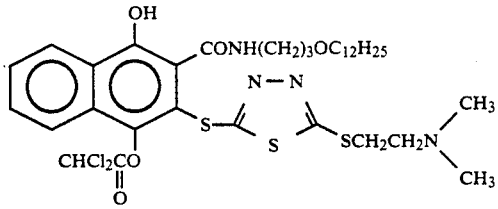
I-19
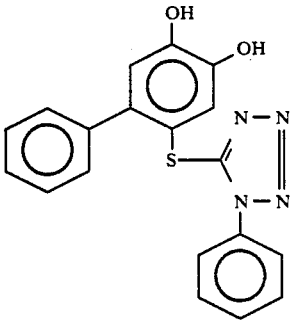
I-20
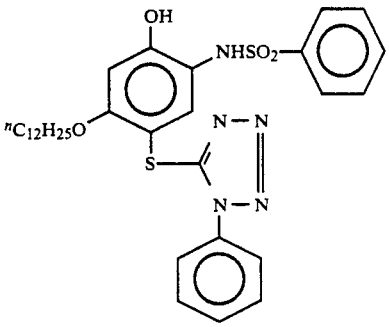

-continued
I-21
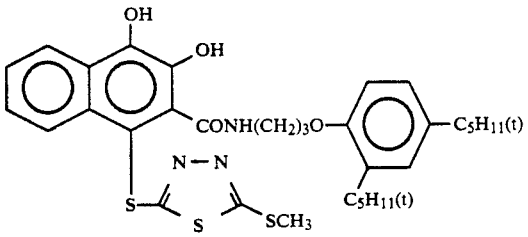
II-22
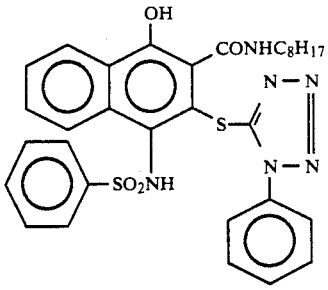
I-23
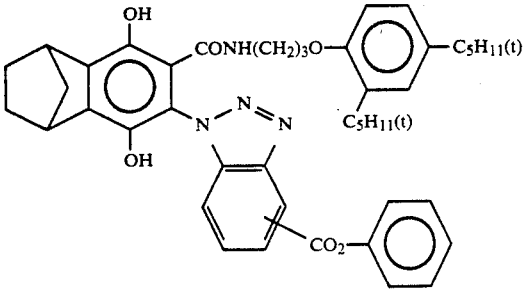
I-24
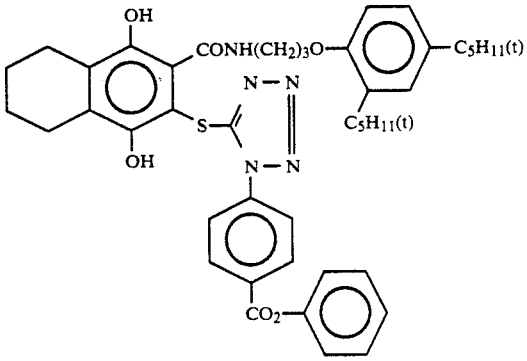
I-25
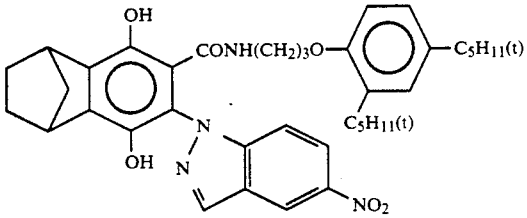
I-26
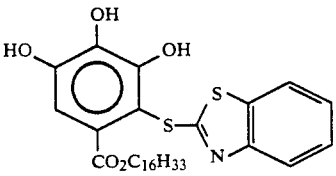
I-27
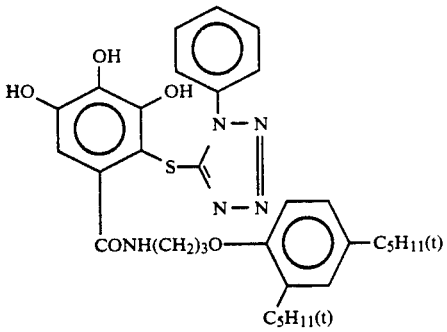
I-28
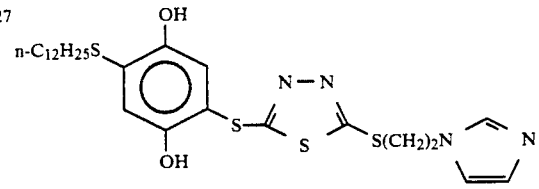
I-29
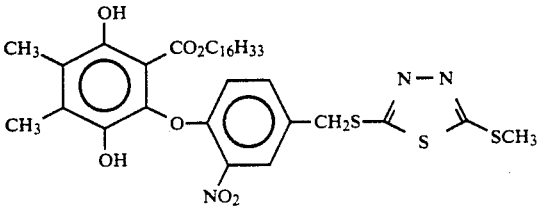

-continued
I-30
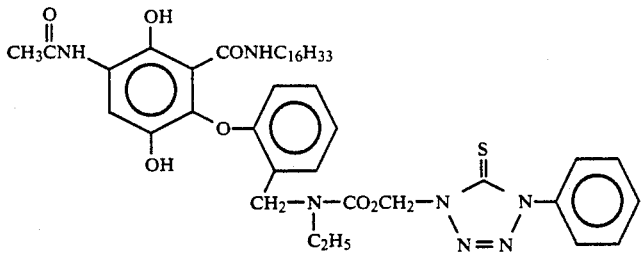
I-31
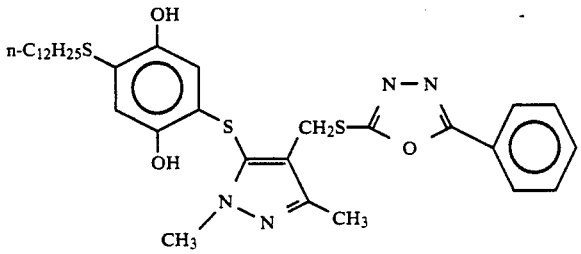
I-32
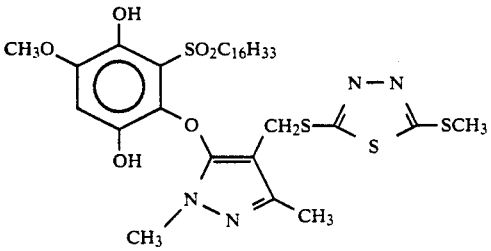
I-33
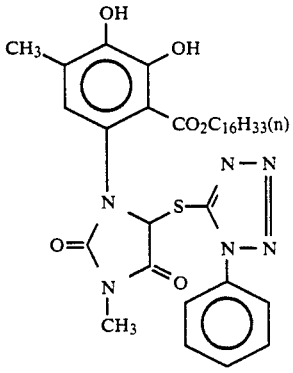
I-34
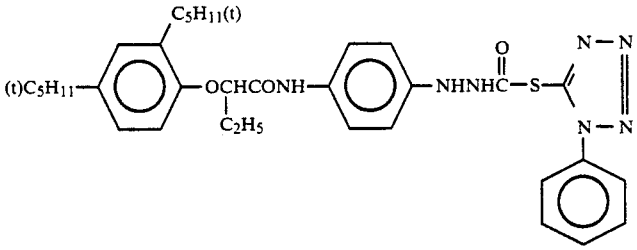
I-35
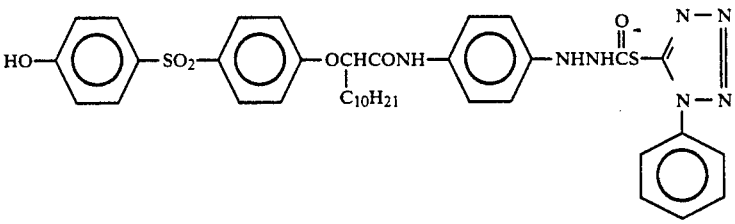
I-36
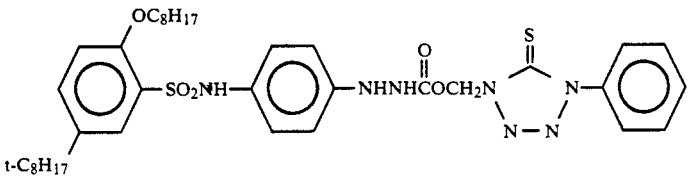

-continued
I-37
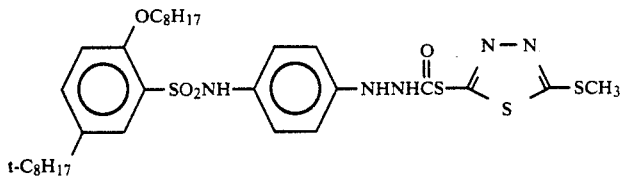
I-38
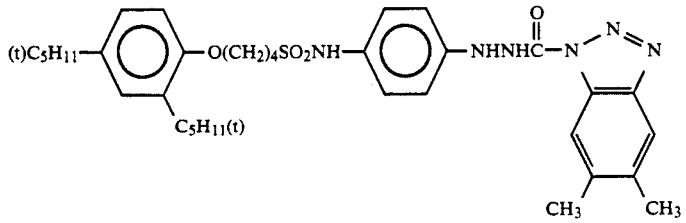
I-39
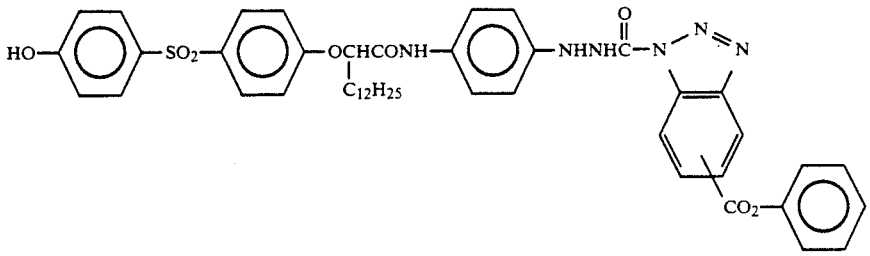
I-40
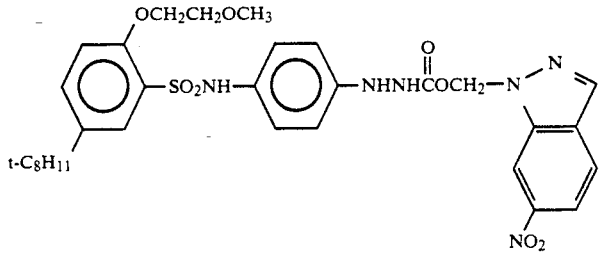
I-41
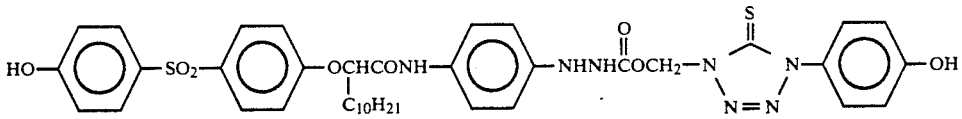
I-42
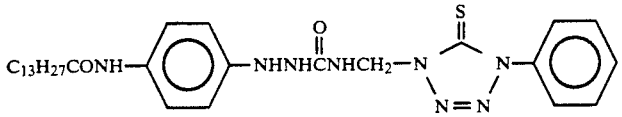
I-43
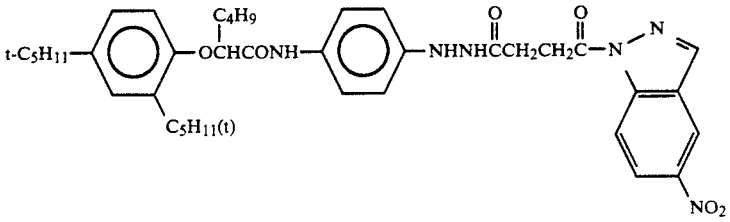

-continued
I-44
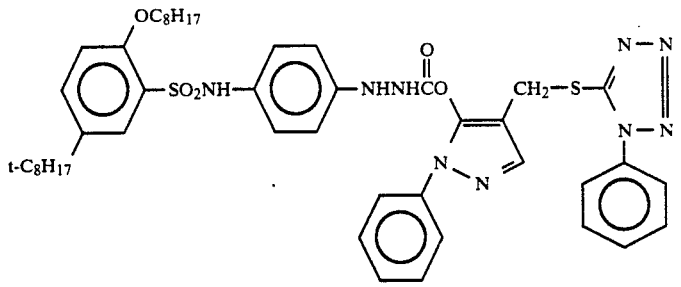
I-45
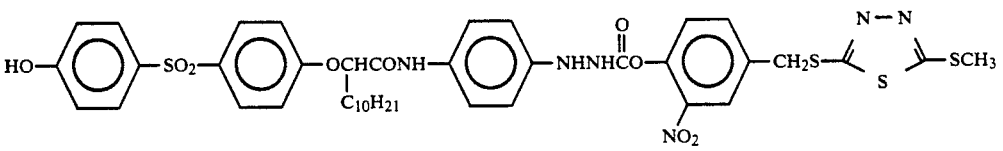
I-46
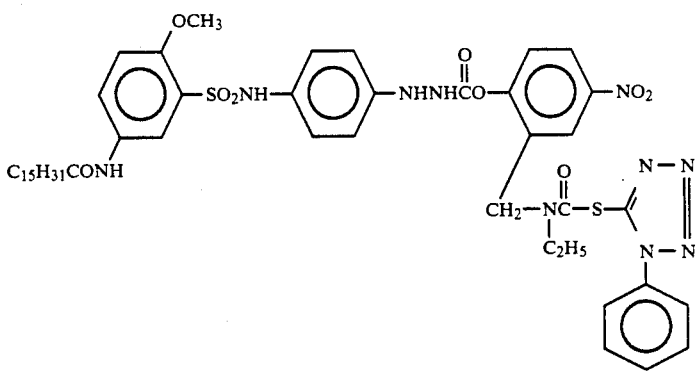
I-47
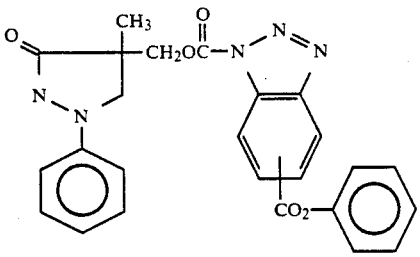
I-48
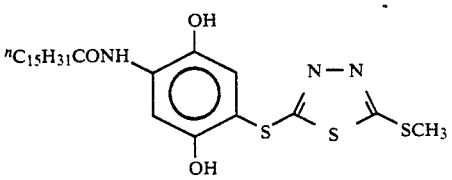
I-49
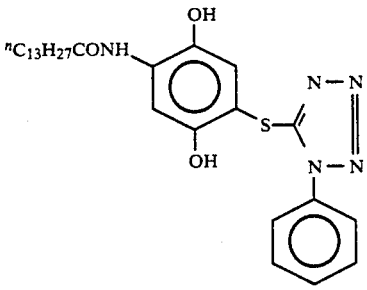
I-50
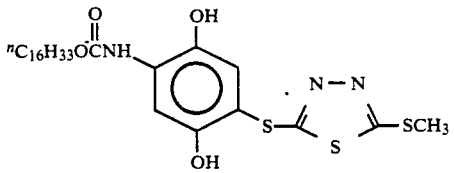
I-51
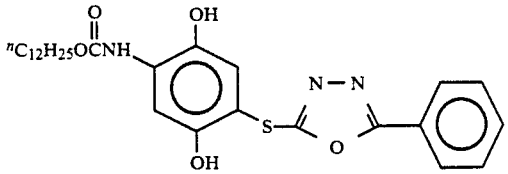

-continued
I-52
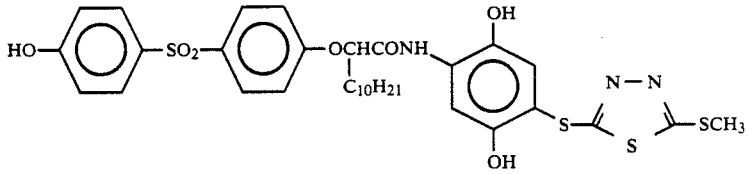
I-53
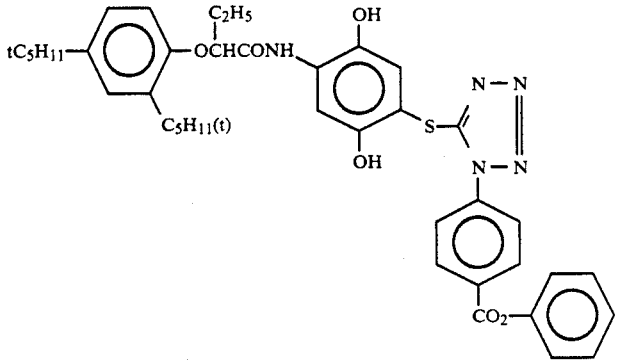
I-54
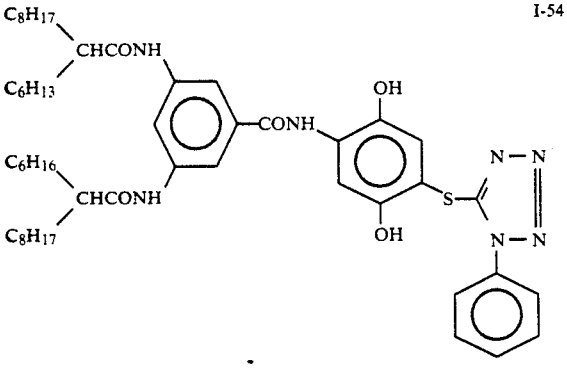
I-55
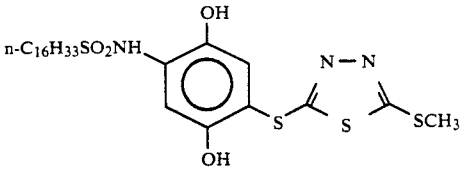
I-56
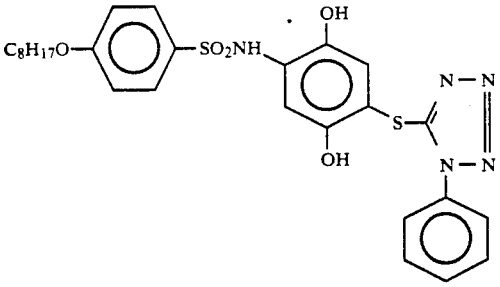
I-57
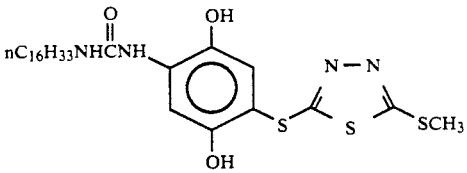
I-58
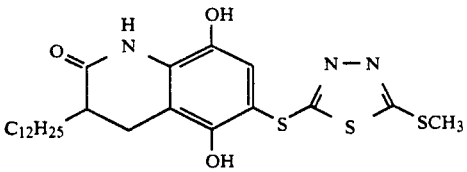
I-59
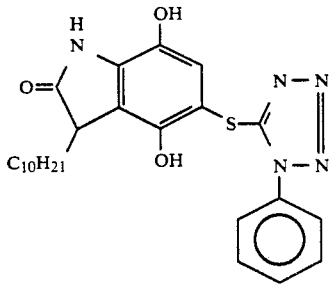

-continued
I-60
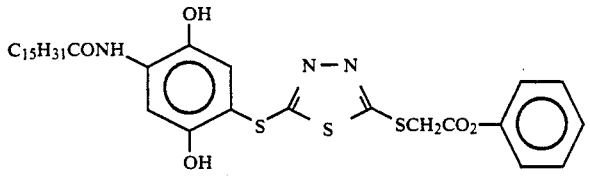
I-61
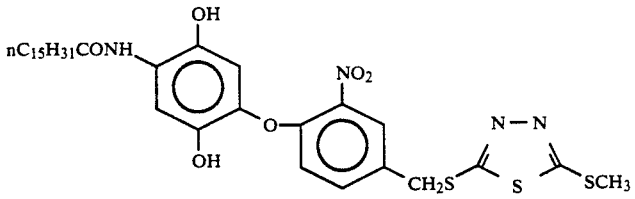
I-62
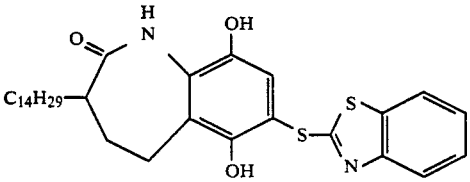
I-63
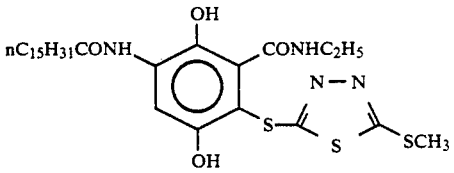
I-64
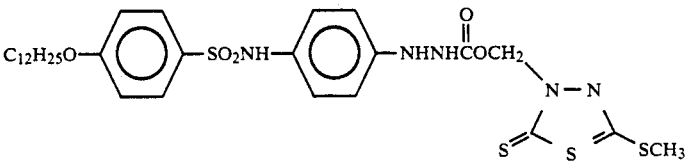
I-65
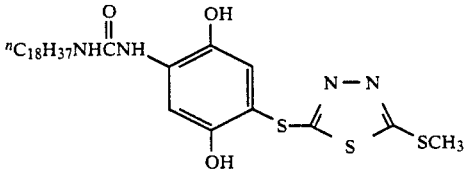
I-66
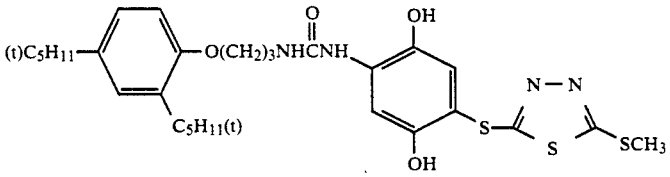
I-67
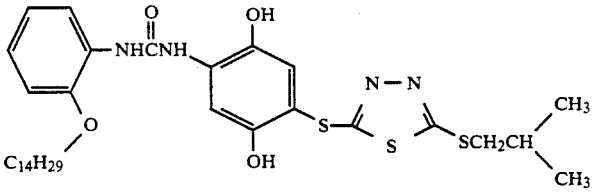
I-68
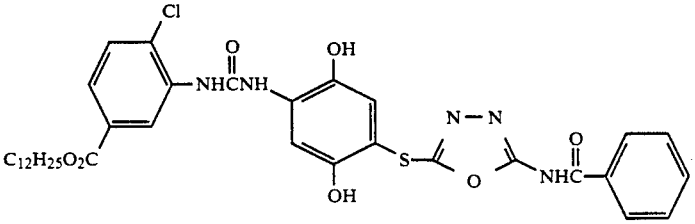

-continued
I-69
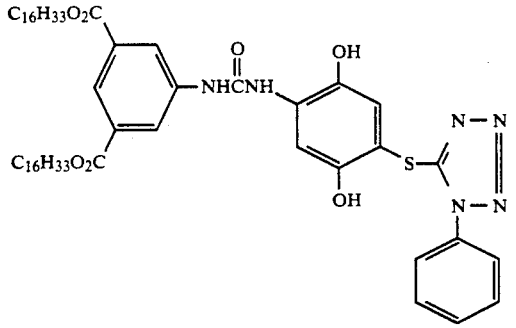
I-70
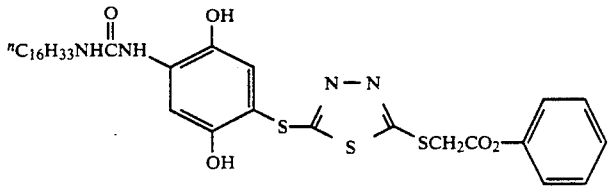
I-71
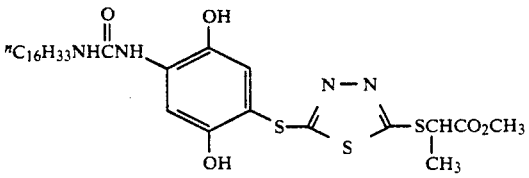
I-72
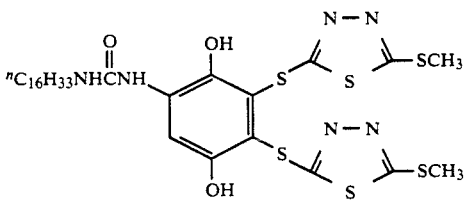
I-73
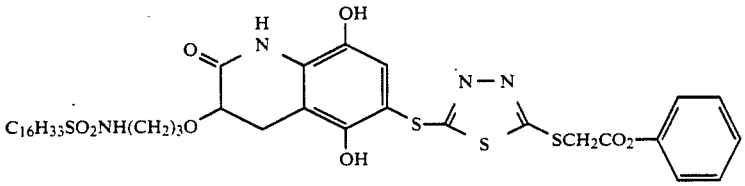
I-74
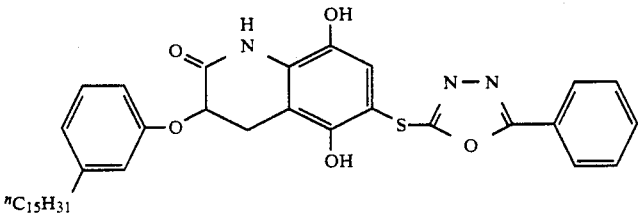
I-75
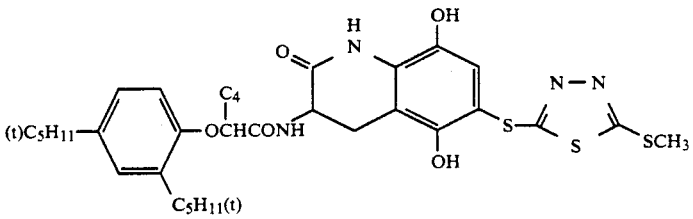
I-76
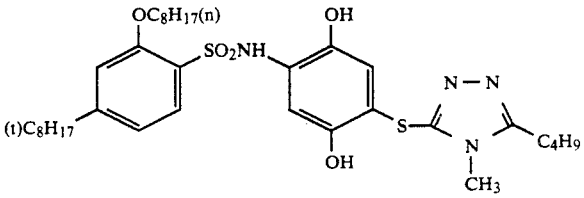

-continued
I-77
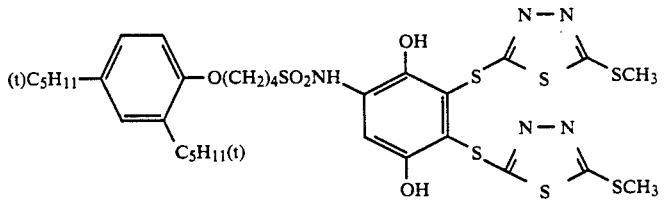
I-78
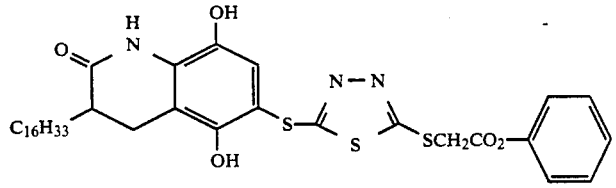
I-79
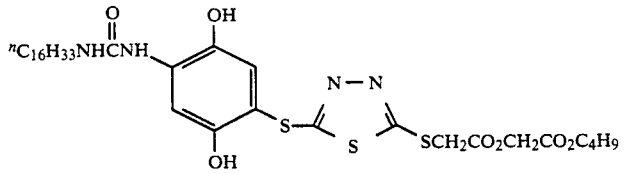
I-80
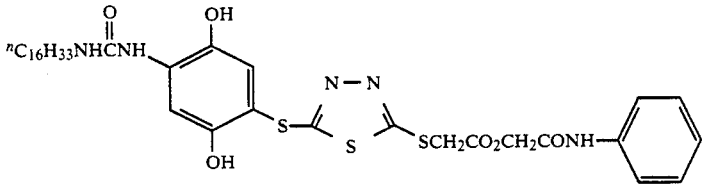
I-81
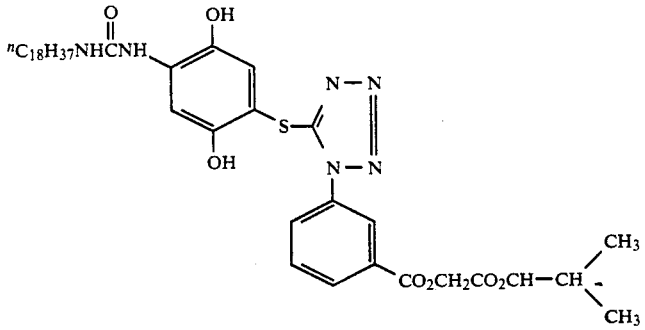
I-82
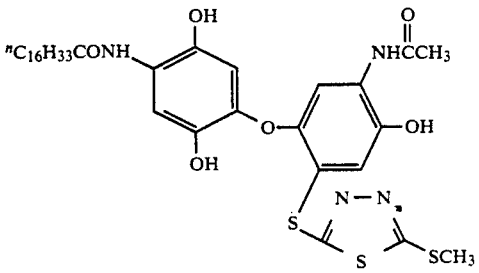
I-83
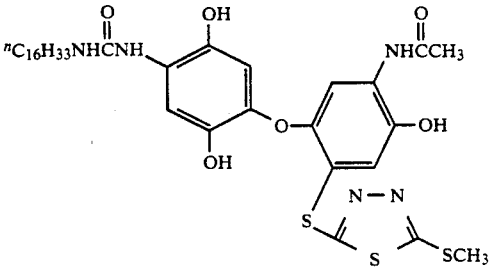

-continued

I-84

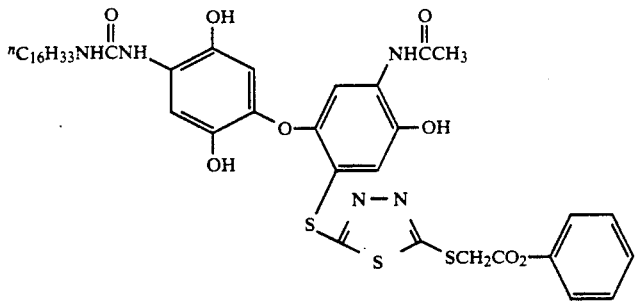

I-85

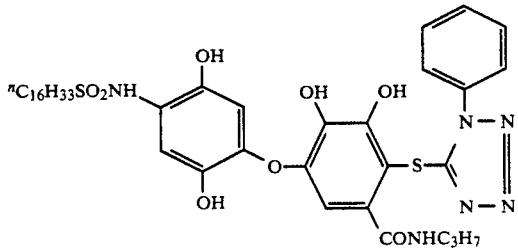

I-86

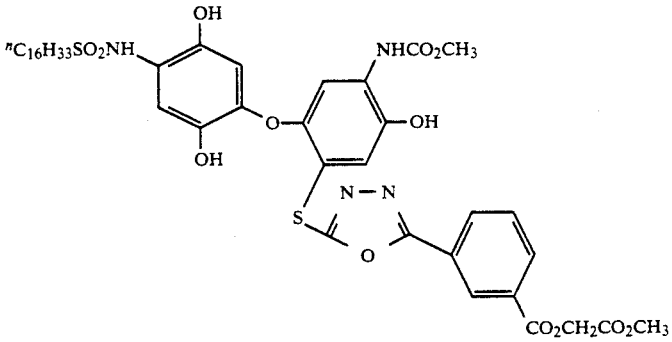

I-87

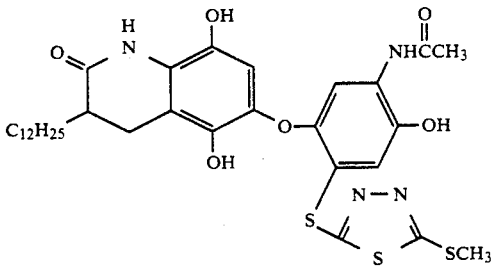

Compounds represented by formula (I) of the present invention can be synthesized according to a method as described in, for example, JP-A Nos. 129536/1974, 57828/1977, 21044/1985, 233642/1985, 233648/1985, 18946/1986, 156043/1986, 213847/1986, 230135/1986, 236549/1986, 62352/1987, and 103639/1987, and U.S. Pat. Nos. 3,379,529, 3,620,746, 4,332,828, 4,377,634, and 4,684,604.

The compound represented by formula (I) may be included in any one of emulsion layers and non-photosensitive layers or in both of them. The amount to be added is preferably in the range from 0.001 to 0.2 mmol/m$^2$, more preferably in the range from 0.01 to 0.1 mmol/m$^2$.

It is sufficient that the photographic material of the present invention has on a base at least one silver halide emulsion layer of a blue-sensitive layer, a green-sensitive layer, or a red-sensitive layer, and there is no particular restriction on the number of silver halide emulsion layers and nonsensitive layers or on the order of the layers. A typical example is a silver halide photographic material having on a base at least one photosensitive layer comprising multiple silver halide emulsion layers that have substantially the same color sensitivity but are different in photographic sensitivity, wherein said photosensitive layer is a unit photosensitive layer having color sensitivity to any one of blue light, green light, and red light. In the case of a multilayer silver halide color photographic material, generally the arrangement of unit photosensitive layers is such that a red-sensitive layer, a green-sensitive layer, and a blue-sensitive layer are placed in the stated order from the base side. However, the order of the arrangement may be reversed in accordance with the purpose, and between layers having the same color sensitivity there may be placed a different photosensitive layer.

A nonsensitive layer, such as various intermediate layers, may be placed between or on top of or beneath the above-mentioned silver halide photosensitive layers.

Said intermediate layers may contain couplers and DIR compound as described, for example, in JP-A Nos. 43748/1986, 113438/1984, 113440/1984, 20037/1986, and 20038/1986, within the range of not increasing Dmin remarkably, and also color-mix inhibitors as usually used.

Multiple silver halide emulsion layers constituting each unit photosensitive layer are preferably made up of two layers, i.e., a high-speed emulsion layer and a low-speed emulsion layer, as described, for example, in West German Patent No. 1,121,470 or British Patent No. 923,045. Generally, preferably the order of the layers is such that the sensitivities decrease successively toward the base, and a nonsensitive layer may be placed between halogen emulsion layers. A low-speed emulsion layer may be placed away from the base and a high-speed emulsion layer may be placed near the base, as described, for example, in JP-A Nos. 112751/1982, 200350/1987, 206541/1987, and 206543/1987.

In a specific example, a low-speed blue-sensitive layer (BL), a high-speed blue-sensitive layer (BH), a high-speed green-sensitive layer (GH), a low-speed green-sensitive layer (GL), a high-speed red-sensitive layer (RH), and a low-speed red sensitive layer (RL), or BH, BL, GL, GH, RH, and RL, or RH, BL, GH, GL, RL, and RH are arranged in the stated order toward a base.

As described in JP-B No. 34932/1980, a blue-sensitive layer, GH, RH, GL, and RL may be arranged in the stated order toward a base. Also, as described in JP-A Nos. 25738/1981 and 63936/1987, a blue-sensitive layer, GL, RL, GH, and RH are arranged in the stated order toward a base.

Also, as described in JP-B No. 15495/1974, an arrangement having three layers whose sensitivities are different and are decreased successively toward a base can be mentioned, wherein the top layer comprises a silver halide emulsion layer highest in sensitivity, the intermediate layer comprises a silver halide emulsion layer lower in sensitivity than the top layer, and the bottom layer comprises a silver halide emulsion layer lower in sensitivity than the intermediate layer. Even in such a case comprising three layers different in sensitivity, a medium-speed emulsion layer, a high-speed emulsion layer, and a low-speed emulsion layer may be arranged in the same color-sensitive layer in the stated order toward a base, as described in JP-A No. 202464/1984.

Further, for example, a high-speed emulsion layer, a low-speed emulsion layer, and a medium-speed emulsion layer, or a low-speed emulsion layer, a medium-speed emulsion layer, and a high-speed emulsion layer may be arranged in the stated order.

Further, as a preferred embodiment of the present invention, by providing a silver halide emulsion layer on the upper layer of photographic material layer to separate photographic material layer and emulsion layer the decrease of sensitivity due to light absorption of photographic material layer can be prevented.

As stated above, various layer constitutions and arrangements can be chosen in accordance with the purpose of each photographic material.

A preferable silver halide to be contained in the photographic emulsion layer of the photographic material utilized in the present invention is silver bromoiodide, silver chloroiodide, or silver bromochloroiodide containing up to about 30 mol % of silver iodide, particularly preferably silver bromochloroiodide containing about 2 to about 10 mol % of silver iodide.

The silver halide grains in the photographic emulsion may have a regular crystal form, such as a cubic shape, an octahedral shape, and a tetradecahedral shape, or a regular crystal shape, such as spherical shape or a tabular shape, or they may have a crystal defect, such as twin planes, or they may have a composite crystal form.

The silver halide grains may be fine grains having a diameter of about 0.2 μm or less, or coarse grains with the diameter of the projected area being down to about 10 μm. As a silver halide emulsion, a polydisperse emulsion or a monodisperse emulsion can be used.

The silver halide photographic emulsions that can be used in the present invention may be prepared suitably by known means, for example, by the methods described in *I. Emulsion Preparation and Types,* in *Research Disclosure* (RD) No. 17643 (December 1978), pp. 22–23, and ibid. No. 18716 (November 1979), p. 648, and ibid. No. 307105 (November, 1989), pp. 863–865; the methods described in P. Glafkides, *Chimie et Phisique Photographique,* Paul Montel (1967), in G. F. Duffin, *Photographic Emulsion Chemistry,* Focal Press (1966), and in V. L. Zelikman et al., *Making and Coating of Photographic Emulsion,* Focal Press (1964).

A monodisperse emulsion, such as described in U.S. Pat. Nos. 3,574,628 and 3,655,394, and in British Patent No. 1,413,748, is also preferable.

Tabular grains having an aspect ratio of 3 or greater can be used in the emulsion of the present invention. Tabular grains can be easily prepared by the methods described in, for example, Gutoof, *Photographic Science and Engineering,* Vol. 14, pp. 248–257 (1970), U.S. Pat. Nos. 4,434,226, 4,414,310, 4,433,048, and 4,439,520, and British Patent No. 2,112,157.

The crystal structure of silver halide grains may be uniform, the outer halogen composition of the crystal structure may be different from the inner halogen composition, or the crystal structure may be layered. Silver halides whose compositions are different may be joined by the epitaxial joint, or a silver halide may be joined, for example, to a compound other than silver halides, such as silver rhodanide, lead oxide, etc.

Although the above-described emulsions may be either a surface latent image-type that forms latent image mainly on the surface, an internal latent image-type that forms latent image at the inner part of grain, or a type that forms latent image both on the surface and at the inner part of grain, it is necessary to be a negative-type emulsion. Of internal latent image-type emulsions, an internal latent image-type emulsion of core/shell-type grain may be used. The preparation method of such internal latent image-type emulsion of core/shell-type grain is described in JP-A No. 264740/1988. The thickness of shell in such emulsion may be different according to a development process or the like, but a range of 3 to 40 nm is preferable, and a range of 5 to 20 nm is particularly preferable.

The silver halide emulsion may generally be physically ripened, chemically ripened, and spectrally sensitized. Additives that will be used in these steps are described in *Research Disclosure* No. 17643, and No. 18716 and ibid. No. 307105, and involved sections are listed in the Table shown below.

In the photographic material of the present invention, two or more kinds of emulsions in which at least one of characteristics, such as grain size of photosensitive silver halide emulsion, distribution of grain size, composition of silver halide, shape of grain, and sensitivity is different each other can be used in a layer in a form of mixture.

Silver halide grains the surface of which has been fogged as described in, for example, U.S. Pat. No. 4,082,553, and silver halide grains or colloidal silver grains the inner part of which has been fogged as described in, for example, U.S. Pat. No. 4,626,498 and JP-A No. 214852/1984 may be preferably used in a photosensitive silver halide emulsion layer and/or a substantially non-photosensitive hydrophilic colloid layer, in the photographic material of the present invention. "Silver halide emulsion the surface or inner part of which has been fogged" means a silver halide emulsion capable of being uniformly (non-image-wisely) developed without regard to unexposed part or exposed part to light of the photographic material. The method for preparing a silver halide emulsion the surface or inner part of which has been fogged are described in, for example, U.S. Pat. No. 4,626,498 and JP-A No. 214852/1984.

The silver halide composition forming inner nucleus of core/shell-type silver halide grain the inner part of which has been fogged may be the same or different. As a silver halide grain the surface or inner part of which has been fogged, any of silver chloride, silver chlorobromide, silver chloroiodobromide can be used. Although the grain size of such silver halide grains which has been fogged is not particularly restricted, the average grain size is preferably 0.01 to 0.75 μm, particularly preferably 0.05 to 0.6 μm. Further, the shape of grains is not particularly restricted, a regular grain or an irregular grain can be used, and although it may be a polydisperse emulsion or a monodisperse emulsion, a monodisperse emulsion (that contains at least 95% of silver halide grains in weight or in number of grains having grain diameter within ±40% of average grain diameter) is preferable.

In the present invention, it is preferable to use a non-photosensitive fine grain silver halide. "Non-photosensitive fine grain silver halide" means a silver halide grain that does not expose at an imagewise exposure to light to obtain a color image and is not developed substantially at a development processing, and preferably it is not fogged previously.

Fine grain silver halide has a silver bromide content of 0 to 100 mol %, and may contain silver chloride and/or silver iodide, if needed. Preferable ones contain silver iodide of 0.5 to 10 mol %.

The average grain diameter (average diameter of circle corresponding to projected area) of fine grain silver halide is preferably 0.01 to 0.5 μm, more preferably 0.02 to 0.2 μm.

The fine grain silver halide can be prepared in the same manner as an ordinary photosensitive silver halide. In this case, it is not necessary to optically sensitize the surface of the silver halide grain and also spectrally sensitizing is not needed. However, to add previously such a compound as triazoles, azaindenes, benzothiazoliums, and mercapto compounds or a known stabilizing agent, such as zinc compounds, is preferable. Colloidal silver is preferably contained in a layer containing this fine grain silver halide.

The coating amount in terms of silver of photographic material of the present invention is preferably 6.0 g/m$^2$ or below, most preferably 4.5 g/m$^2$ or below.

Known photographic additives that can be used in the present invention are also described in the above-mentioned three Research Disclosures, and involved sections are listed in the same Table below.

| | Additive | RD 17643 (December 1978) | RD 18716 (November 1979) | RD 307105 (November 1989) |
|---|---|---|---|---|
| 1 | Chemical sensitizer | p. 23 | p. 648 (right column) | p. 866 |
| 2 | Sensitivity-enhancing agent | — | P. 648 (right column) | — |
| 3 | Spectral sensitizers and Supertabilizers | pp. 23–24 | pp. 648– (right column) 649 (right column) | pp. 866–868 |
| 4 | Brightening agents | p. 24 | p. 647 (right column) | p. 868 |
| 5 | Antifogging agents and Stabilizers | pp. 24–25 | p. 649 (right column) | pp. 868–870 |
| 6 | Light absorbers, Filter dyes, and UV Absorbers | pp. 25–26 | pp. 649– (right column) 650 (left column) | p. 873 |
| 7 | Stain-preventing agent | p. 25 (right column) | p. 650 (left to right column) | p. 872 |
| 8 | Image dye stabilizers | p. 25 | p. 650 (left column) | p. 872 |
| 9 | Hardeners | p. 26 | p. 651 (left column) | pp. 874–875 |
| 10 | Binders | p. 26 | p. 651 (left column) | pp. 873–874 |
| 11 | Plasticizers and Lubricants Lubricants | p. 27 | p. 650 (right column) | p. 876 |
| 12 | Coating aids and Surface-active agents | pp. 26–27 | p. 650 (right column) | pp. 875–876 |
| 13 | Antistatic agents | p. 27 | p. 650 (right column) | pp. 876–877 |
| 14 | Matting agent | — | — | pp. 878–879 |

Further, in order to prevent the lowering of photographic performance due to formaldehyde gas, a compound described in, for example, U.S. Pat. Nos. 4,411,987 and 4,435,503 that is able to react with formaldehyde to immobilize it is preferably added to the photographic material.

In the photographic material of the present invention, a mercapto compound described in, for example, U.S. Pat. Nos. 4,740,454 and 4,788,132, and JP-A Nos. 8539/1987 and 283551/1989 is preferably contained.

In the photographic material of the present invention, a compound that releases a fogging agent, a development accelerator, a solvent for silver halide, or the precursor thereof, independent of the amount of silver formed by a development processing, described in, for example, JP-A No. 106052/1989 is preferably contained.

In the photographic material of the present invention, a dye dispersed by a method described in, for example, International Publication No. W088/04794 and Japanese Published Searched Patent Publication No.

502912/1989, or a dye described in, for example, European Patent No. 317,308A, U.S. Pat. No. 4,420,555, and JP-A No. 259358/1989 is preferably contained.

In the present invention, various color couplers can be used, and concrete examples of them are described in patents cited in the above-mentioned *Research Disclosure* No. 17643, VII-C to G, and ibid. No. 307105, VII-C to G.

As yellow couplers, for example, pivaloyl series and benzoyl series coupler may be used in a mixture or in a combination with other couplers as freely as not failing the effects of the present invention. As examples of compound those described in, for example, U.S. Pat. Nos. 3,933,501, 4,022,620, 4,326,024, 4,401,752, and 4,248,961, JP-B No. 10739/1983, British Patent Nos. 1,425,020 and 1,476,760, U.S. Pat. Nos. 3,973,968, 4,314,023, and 4,511,649, and European Patent No. 249,473A are preferable.

As magenta couplers, 5-pyrazolone-type magenta couplers and pyrazoloazole-series magenta couplers can be mentioned, and couplers described in, for example, U.S. Pat. Nos. 4,310,619 and 4,351,897, European Patent No. 73,636, U.S. Pat. Nos. 3,061,432 and 3,725,067, JP-A Nos. 35730/1985, 118034/1980, and 185951/1985, U.S. Pat. No. 4,556,630, and International Publication No. WO88/04795 are preferable, in particular.

As cyan couplers, phenol-type couplers and naphthol-type couplers can be mentioned, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, European Patent Nos. 121,365A and 249,453A, U.S. Pat. Nos. 3,446,622, 4,333,999, 4,775,616, 4,451,559, 4,427,767, 4,690,889, 4,254,212, and 4,296,199, and JP-A No. 42658/1986 are more preferable.

Typical examples of polymerized dye-forming coupler are described in, for example, U.S. Pat. Nos. 3,451,820, 4,080,211, 4,367,282, 4,409,320, and 4,576,910, British Patent No. 2,102,137, and European Patent No. 341,188A.

As a coupler which forms a dye having moderate diffusibility, those described in U.S. Pat. No. 4,366,237, British Patent No. 2,125,570, European Patent No. 96,570, and West German Patent Application (OLS) No. 3,234,533 are preferable.

As a colored coupler to rectify the unnecessary absorption of color-forming dyes, those couplers described in, paragraph VII-G of *Research Disclosure* No. 17643, paragraph VII-G of ibid. No. 307105, U.S. Pat. No. 4,163,670, JP-B No. 39413/1982, U.S. Pat. Nos. 4,004,929 and 4,138,258, and British Patent No. 1,146,368 are preferable. Further, it is preferable to use couplers to rectify the unnecessary absorption of color-forming dyes by a fluorescent dye released upon the coupling reaction as described in U.S. Pat. No. 4,774,181 and couplers having a dye precursor, as a group capable of being released, that can react with the developing agent to form a dye as described in U.S. Pat. No. 4,777,120.

A coupler that releases a photographically useful residue accompanied with the coupling reaction can be used favorably in this invention. As a DIR coupler that release a development retarder, those described in patents cited in paragraph VII-F of the above-mentioned *Research Disclosure* No. 17643 and in paragraph VII-F of ibid. No. 307105, JP-A Nos. 151944/1982, 154234/1982, 184248/1985, 37346/1988, and 37350/1988, and U.S. Pat. Nos. 4,248,962 and 4,782,012 are preferable.

As a coupler which releases, imagewisely, a nucleating agent or a development accelerator upon developing, those described in British Patent Nos. 2,097,140 and 2,131,188, and JP-A Nos. 157638/1984 and 170840/1984 are preferable. Further, compounds which release a fogging agent, a developing accelerator, or a solvent for silver halide by a oxidation-reduction reaction with the oxidized product of developing agent as described in JP-A Nos. 107029/1985, 252340/1985, 44940/1989, and 45687/1989 are also preferable.

Other couplers that can be incorporated in the photographic material of the present invention include competitive couplers described in U.S. Pat. No. 4,130,427, multi-equivalent couplers described in U.S. Pat. Nos. 4,283,472, 4,338,393, and 4,310,618, couplers which release a DIR redox compound, couplers which release a DIR coupler, and redox compounds which release a DIR coupler or a DIR redox as described in JP-A Nos. 185950/1985 and 24252/1987, couplers which release a dye to regain a color after releasing as described in European Patent Nos. 173,302A and 313,308A, couplers which release a bleaching-accelerator as described in *Research Disclosure* Nos. 11449 and 24241, and JP-A No. 201247/1986, couplers which release a ligand as described in U.S. Pat. No. 4,555,477, couplers which release a leuco dye as described in JP-A No. 75747/1988, and couplers which release a fluorescent dye as described in U.S. Pat. No. 4,774,181.

Couplers utilized in the present invention can be incorporated into a photographic material by various known methods.

Examples of high-boiling solvent for use in oil-in-water dispersion process are described in, for example, U.S. Pat. No. 2,322,027.

As specific examples of a high-boiling organic solvent having a boiling point of 175° C. or over at atmospheric pressure for use in oil-in-water dispersion process can be mentioned phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-diethylpropyl) phthalate), esters of phosphoric acid or phosphonic acid (e.g., triphenyl phosphate, tricrezyl phosphate, 2-ethylhexyldiphenyl phosphate, tricyclohexyl phophate, tri-2-ethylhexyl phosphate, tridodecyl phosphate, tributoxyethyl phosphate, trichloropropyl phosphate, and di-2-ethylhexylphenyl phosphate), benzoic esters (e.g., 2-ethylhexyl benzoate, dodecyl benzoate, and 2-ethylhexyl-p-hydroxy benzoate), amides (e.g., N,N-diethyldodecanamide, n,n-diethyllaurylamide, and N-tetradecylpyrrolidone), alcohols or phenols (e.g., isostearyl alcohol and 2,4-di-tert-amyl phenol), aliphatic carbonic acid esters (bis(2-ethylhexyl) sebacate, dioctyl azelate, glycerol tributylate, isostearyl lactate, and trioctyl citrate), aniline derivatives (N,N-dibutyl-2-butoxy-5-tert-octylaniline), and hydrocarbons (paraffin, dodecyl benzene, and diisopropyl naphthalene). Further, as a co-solvent an organic solvent having a boiling point of about 30° C. or over, preferably a boiling point in the range from 50° C. to about 160° C. can be used, and as a typical example can be mentioned ethyl acetate, butyl acetate, ethyl propionate, methylethyl ketone, cyclohexanone, 2-rthoxyethyl acetate, and dimethyl formamide.

Specific examples of a process and the effects of a latex dispersion method, and latices for impregnation are described in, for example, U.S. Pat. No. 4,199,363 and West German Patent Application (OLS) Nos 2,541,274 and 2,541,230.

In the photographic material of this invention, various antiseptics and antifungal agents, such as phenetyl alcohol, and 1,2-benzisothiazoline-3-one, n-butyl-p-hydroxybenzoate, phenol, 4-chloro-3,5-dimethylphenol, 2-phenoxyethanol, and 2-(4-thiazolyl)-bezimidazole as described in JP-A Nos. 257747/1988, 272248/1987, and 80941/1989 are preferably added.

The present invention can be adopted to various color photographic materials. Representative examples include a color negative film for general use or for cinema, a color reversal film for slide or for television, a color paper, a color positive film, and a color reversal paper.

Suitable bases to be used in the present invention are described in, for example, in the above-mentioned *Research Disclosure* No. 17643, page 28 and ibid. No. 18716, from page 647, right column to page 648, left column.

In the photographic material of the present invention, preferably the total layer thickness of all the hydrophilic colloid layers on the side having emulsion layers is 28 μm or below, more preferably 23 μm or below, further more preferably 20 μm or below, and particularly preferably 16 μm or below. Preferably the film swelling speed $T_{178}$ is 30 sec or below, more preferably 20 sec or below. The term "layer thickness" means layer thickness measured after moisture conditioning at 25° C. and a relative humidity of 55% for two days, and the film swelling speed $T_{178}$ can be measured in a manner known in the art. For example, the film swelling speed $T_{\frac{1}{2}}$ can be measured by using a swellometer (swell-measuring meter) of the type described by A. Green et al. in *Photographic Science and Engineering*, Vol. 19, No. 2, pp. 124–129, and $T_{178}$ is defined as the time required to reach a film thickness of ½ of the saturated film thickness that is 90% of the maximum swelled film thickness that will be reached when the film is treated with a color developer at 30° C. for 3 min 15 sec.

The film swelling speed $T_{\frac{1}{2}}$ can be adjusted by adding a hardening agent to the gelatin that is a binder or by changing the time conditions after the coating. Preferably the ratio of swelling is 150 to 400%. The ratio of swelling is calculated from the maximum swelled film thickness obtained under the above conditions according to the formula: (Maximum swelled film thickness—film thickness)/Film thickness.

It is preferable that the photographic material of the present invention is provided with a hydrophilic layer (designated as a back layer) having a total dried layer thickness of 2 μm to 20 μm at the opposite side having the emulsion layers. In such a layer, it preferably contains the above-mentioned light-absorbent, filter-dye, UV-absorbent, static preventer, film-hardener, binder, plasticizer, lubricant, coating auxiliary, and surface-active agent. The ratio of swelling of back layer is preferably 150 to 500%.

The photographic material in accordance with the present invention can be subjected to the development processing by an ordinary method as described in the above-mentioned *Research Disclosure* No. 17463, pp. 28–29, ibid. No. 18716, p. 651, from left column to right column, and ibid. No. 307105, pp. 880–881.

The various processing solutions used for the present invention may be used at 10° to 50° C. Although generally a temperature of 33° to 38° C. may be standard, a higher temperature can be used to accelerate the process to reduce the processing time, or a lower temperature can be used to improve the image quality or the stability of the processing solution.

Further, the silver halide photographic material of the present invention can be adopted to photographic materials for heat development described in, for example, U.S. Pat. No. 4,500,626, JP-A Nos. 133449/1985, 218443/1984, and 238056/1986, and European Patent No. 210,660A2.

The silver halide color photographic material of the present invention is large in the edge effect and is high in the preservation stability and in the sharpness.

Next, the present invention will be described in detail in accordance with examples, but the invention is not limited to them.

EXAMPLE 1

A multilayer color photographic material was prepared by multi-coating each layer having composition as shown below on a prime-coated triacetate cellulose film base having a thickness of 127 μm, and it was designated Sample 101. The figures provided indicate the amounts added in g/m². The effects of the compound added are not restricted to the shown usage.

| | |
|---|---|
| First layer: Halation-preventing layer | |
| Black colloidal silver | 0.25 g |
| Gelatin | 1.9 g |
| UV-absorbent U-1 | 0.04 g |
| UV-absorbent U-2 | 0.1 g |
| UV-absorbent U-3 | 0.1 g |
| UV-absorbent U-4 | 0.1 g |
| UV-absorbent U-6 | 0.1 g |
| High boiling organic solvent Oil-1 | 0.1 g |
| Second layer: Intermediate layer | |
| Gelatin | 0.40 g |
| High-boiling organic solvent Oil-3 | 0.1 g |
| Dye D-4 | 0.4 mg |
| Third layer: Intermediate layer | |
| Silver iodobromide emulsion of fine grains surface and inner part of which were fogged (av. grain diameter: 0.06 μm, deviation coefficient: 18%, AgI content: 1 mol %) silver | 0.05 g |
| Gelatin | 0.4 g |
| Fourth layer: Low sensitivity red-sensitive emulsion layer | |
| Emulsion A silver | 0.2 g |
| Emulsion B silver | 0.3 g |
| Gelatin | 0.8 g |
| Coupler C-1 | 0.15 g |
| Coupler C-2 | 0.05 g |
| Coupler C-9 | 0.05 g |
| High-boiling organic solvent Oil-2 | 0.1 g |
| Fifth layer: Medium sensitivity red-sensitive emulsion layer | |
| Emulsion B silver | 0.2 g |
| Emulsion C silver | 0.3 g |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| Sixth layer: High sensitivity red-sensitive emulsion layer | |
| Emulsion D silver | 0.4 g |
| Gelatin | 1.1 g |
| Coupler C-1 | 0.3 g |
| Coupler C-3 | 0.7 g |
| Additive P-1 | 0.1 g |
| Seventh layer: Intermediate layer | |
| Gelatin | 0.6 g |
| Additive M-1 | 0.3 g |
| Color-mix preventing agent Cpd-K | 2.6 mg |

-continued

| | |
|---|---|
| UV-absorbent U-1 | 0.1 g |
| UV-absorbent U-6 | 0.1 g |
| Dye D-1 | 0.02 g |
| Eighth layer: Intermediate layer | |
| Silver iodobromide emulsion of fine grains surface and inner part of which were fogged (av. grain diameter: 0.06 μm, deviation coefficient: 16%, AgI content: 0.3 mol %) silver | 0.02 g |
| Gelatin | 1.0 g |
| Additive P-1 | 0.2 g |
| Color-mix preventing agent Cpd-J | 0.1 g |
| Color-mix preventing agent Cpd-A | 0.1 g |
| Ninth layer: Low sensitivity green-sensitive emulsion layer | |
| Emulsion E silver | 0.3 g |
| Emulsion F silver | 0.1 g |
| Emulsion G silver | 0.1 g |
| Gelatin | 0.5 g |
| Coupler C-7 | 0.05 g |
| Coupler C-8 | 0.20 g |
| Compound Cpd-B | 0.03 g |
| Compound Cpd-E | 0.02 g |
| Compound Cpd-F | 0.02 g |
| Compound Cpd-G | 0.02 g |
| Compound Cpd-H | 0.02 g |
| High-boiling organic solvent Oil-1 | 0.1 g |
| High-boiling organic solvent Oil-2 | 0.1 g |
| Tenth layer: Medium sensitivity green-sensitive emulsion layer | |
| Emulsion G silver | 0.3 g |
| Emulsion H silver | 0.1 g |
| Gelatin | 0.6 g |
| Coupler C-7 | 0.2 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High-boiling organic solvent Oil-2 | 0.01 g |
| Eleventh layer: High sensitivity green-sensitive emulsion layer | |
| Emulsion I silver | 0.5 g |
| Gelatin | 1.0 g |
| Coupler C-4 | 0.3 g |
| Coupler C-8 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High-boiling organic solvent Oil-1 | 0.02 g |
| High-boiling organic solvent Oil-2 | 0.02 g |
| Twelfth layer: Intermediate layer | |
| Gelatin | 0.6 g |
| Dye D-1 | 0.1 g |
| Dye D-2 | 0.05 g |
| Dye D-3 | 0.07 g |
| Thirteenth layer: Yellow filter layer | |
| Yellow colloidal silver silver | 0.1 g |
| Gelatin | 1.1 g |
| Color-mix preventing agent Cpd-A | 0.01 g |
| High-boiling organic solvent Oil-1 | 0.01 g |

-continued

| | |
|---|---|
| Fourteenth layer: Intermediate layer | |
| Gelatin | 0.6 g |
| Fifteenth layer: Low sensitivity blue-sensitive emulsion layer | |
| Emulsion J silver | 0.4 g |
| Emulsion K silver | 0.1 g |
| Emulsion L silver | 0.1 g |
| Gelatin | 0.8 g |
| Coupler C-5 | 0.6 g |
| Sixteen layer: Medium sensitivity blue-sensitive emulsion layer | |
| Emulsion L silver | 0.1 g |
| Emulsion M silver | 0.4 g |
| Gelatin | 0.9 g |
| Coupler C-5 | 0.3 g |
| Coupler C-6 | 0.3 g |
| Seventeenth layer: High sensitivity blue-sensitivity emulsion layer | |
| Emulsion N silver | 0.4 g |
| Gelatin | 1.2 g |
| Coupler C-6 | 0.7 g |
| Eighteenth layer: First protective layer | |
| Gelatin | 0.7 g |
| UV-absorbent U-1 | 0.04 g |
| UV-absorbent U-2 | 0.01 g |
| UV-absorbent U-3 | 0.03 g |
| UV-absorbent U-4 | 0.03 g |
| UV-absorbent U-5 | 0.05 g |
| UV-absorbent U-6 | 0.05 g |
| High-boiling organic solvent Oil-1 | 0.02 g |
| Formalin scavenger Cpd-C | 0.2 g |
| Cpd-I | 0.4 g |
| Dye D-3 | 0.05 g |
| Nineteenth layer: Second protective layer | |
| Colloidal silver silver | 0.1 mg |
| Silver iodobromide emulsion of fine grains (av. grain diameter: 0.06 μm, AgI content: 1 mol %) silver | 0.1 g |
| Gelatin | 0.4 g |
| Twentieth layer: Third protective layer | |
| Gelatin | 0.4 g |
| Poly(methylmethacrylate) (av. grain diameter: 1.5 μm) | 0.1 g |
| Copolymer of methylmethacrylate and acrylic acid (4:6), (av. grain diameter: 1.5 μm) | 0.1 g |
| Silicone oil | 0.03 g |
| Surface-active agent W-1 | 3.0 mg |
| Surface-active agent W-2 | 0.03 g |

Further, to all emulsion layers, in addition to the above-described components, additives F-1 to F-8 were added. Further, to each layer, in addition to the above-described components, gelatin hardener H-1 and surface-active agents W-3 and W-4 for coating and emulsifying were added.

Further, as antifungal and antibacterial agents, phenol, 1,2-benzisothiazoline-3-one, 2-phenoxyethanol and phenetylalcol were added.

Silver iodobromide emulsions used are as follows:

| Emulsion | | Average grain-diameter (μm) | Deviation coefficient (%) | AgI content (%) |
|---|---|---|---|---|
| A | Monodisperse tetradecahedral grain | 0.25 | 16 | 3.7 |
| B | Monodisperse cubic internal latent image-type grain | 0.30 | 10 | 3.3 |
| C | Monodisperse tetradecahedral grain | 0.30 | 18 | 5.0 |
| D | Polydisperse twin crystal grain | 0.60 | 25 | 2.0 |
| E | Monodisperse cubic grain | 0.17 | 17 | 4.0 |
| F | Monodisperse cubic grain | 0.20 | 16 | 4.0 |
| G | Monodisperse cubic internal latent image-type grain | 0.25 | 11 | 3.5 |
| H | Monodisperse cubic internal latent image-type grain | 0.30 | 9 | 3.5 |
| I | Polydisperse tabular grain, average aspect ratio: 4.0 | 0.80 | 28 | 1.5 |
| J | Monodisperse tetradecahedral grain | 0.30 | 18 | 4.0 |
| K | Monodisperse tetradecahedral grain | 0.37 | 17 | 4.0 |
| L | Monodisperse cubic internal latent image-type grain | 0.46 | 14 | 3.5 |

-continued

| Emulsion | | Average grain-diameter (μm) | Deviation coefficient (%) | AgI content (%) |
|---|---|---|---|---|
| M | Monodisperse cubic grain | 0.55 | 13 | 4.0 |
| N | Polydisperse tabular grain, average aspect ratio: 7.0 | 1.00 | 33 | 1.3 |

Spectral-sensitizing of Emulsions A to N

| Emulsion | Spectral-sensitizing dye added | Amount of Added g per 1 mol of Silver Halide | Time when spectral-sensitizing dye added |
|---|---|---|---|
| A | S-1 | 0.025 | Immediately after chemical sensitization |
| | S-2 | 0.25 | Immediately after chemical sensitization |
| B | S-1 | 0.01 | Immediately after grain formation ended |
| | S-2 | 0.25 | Immediately after grain formation ended |
| C | S-1 | 0.02 | Immediately after chemical sensitization |
| | S-2 | 0.25 | Immediately after chemical sensitization |
| D | S-1 | 0.01 | Immediately after chemical sensitization |
| | S-2 | 0.10 | Immediately after chemical sensitization |
| | S-7 | 0.01 | Immediately after chemical sensitization |
| E | S-3 | 0.5 | Immediately after chemical sensitization |
| | S-4 | 0.1 | Immediately after chemical sensitization |
| F | S-3 | 0.3 | Immediately after chemical sensitization |
| | S-4 | 0.1 | Immediately after chemical sensitization |
| G | S-3 | 0.25 | Immediately after grain formation ended |
| | S-4 | 0.08 | Immediately after grain formation ended |
| H | S-3 | 0.2 | During grain formation |
| | S-4 | 0.06 | During grain formation |
| I | S-3 | 0.3 | Immediately before chemical sensitization |
| | S-4 | 0.07 | Immediately before chemical sensitization |
| | S-8 | 0.1 | Immediately before chemical sensitization |
| J | S-6 | 0.2 | During grain formation |
| | S-5 | 0.05 | During grain formation |
| K | S-6 | 0.2 | During grain formation |
| | S-5 | 0.05 | During grain formation |
| L | S-6 | 0.22 | Immediately after grain formation ended |
| | S-5 | 0.06 | Immediately after grain formation ended |
| M | S-6 | 0.15 | Immediately after chemical sensitization |
| | S-5 | 0.04 | Immediately after chemical sensitization |
| N | S-6 | 0.22 | Immediately after grain formation ended |
| | S-5 | 0.06 | Immediately after grain formation ended |

C-1

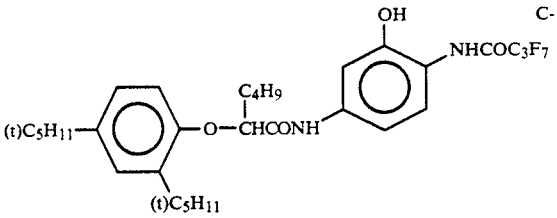

C-2

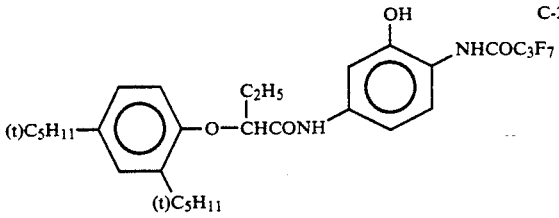

C-3

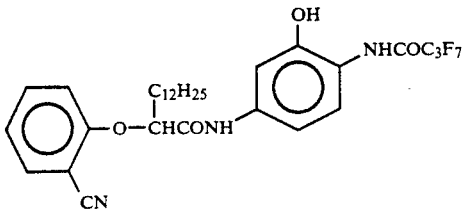

-continued

C-4

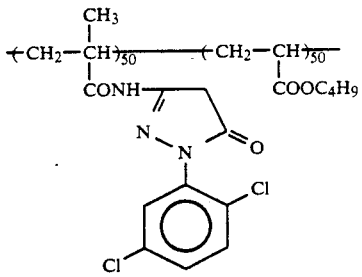

Figures represent wt.%
average mol. wt.:
ca. 25,000

C-5

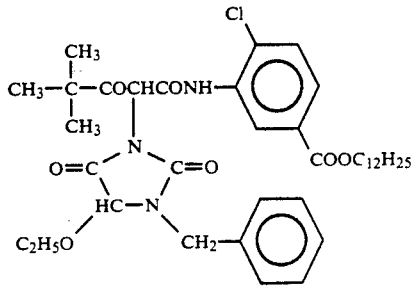

-continued
C-6
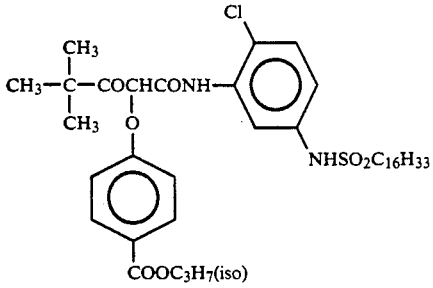
C-7
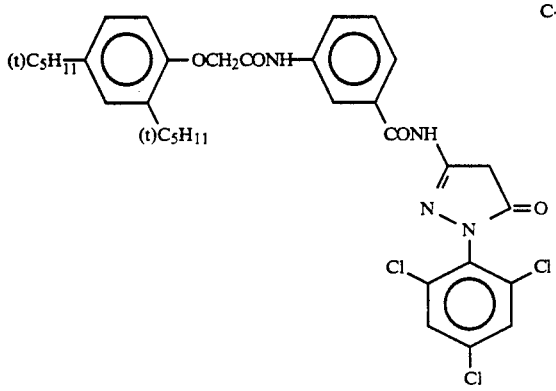
C-8
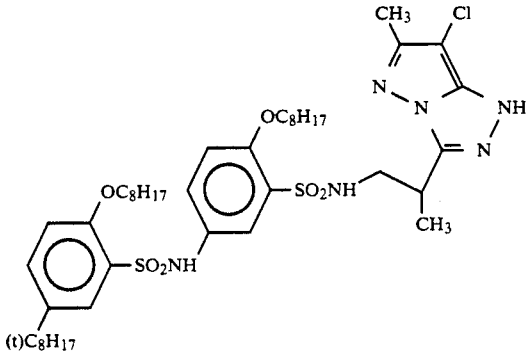
C-9
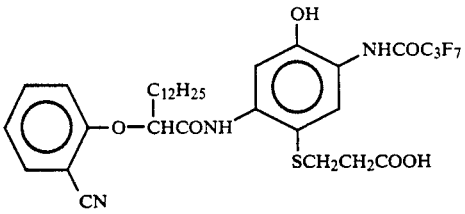
Dibutyl phthalate Oil-1
Tricrezyl phosphate Oil-2
Oil-3
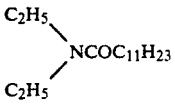
Cpd-A
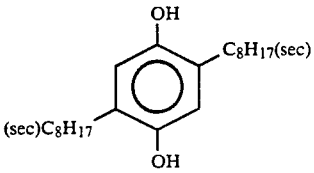
-continued
Cpd-B
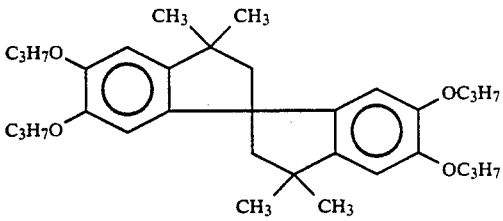
Cpd-C
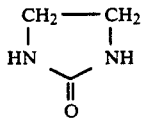
Cpd-E
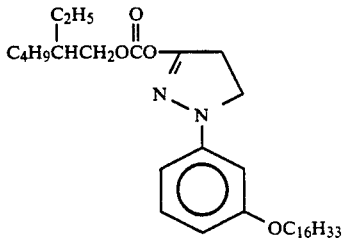
Cpd-F
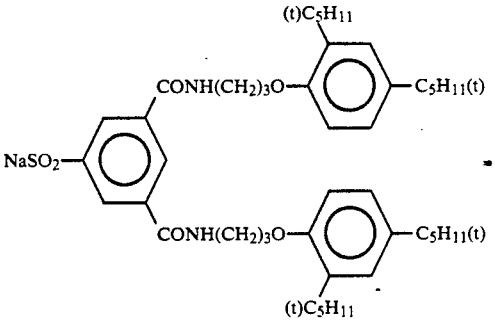
Cpd-G
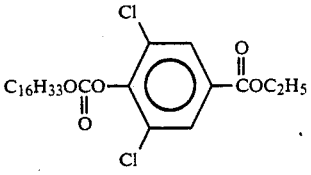
Cpd-H
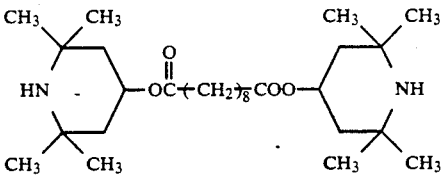
Cpd-I
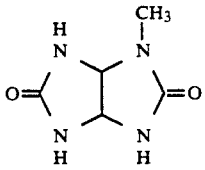
Cpd-J
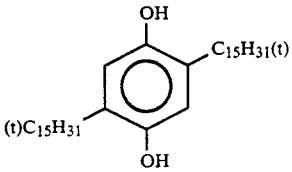

-continued
Cpd-K
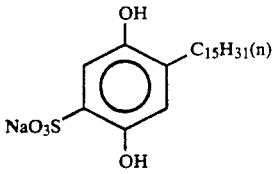
U-1
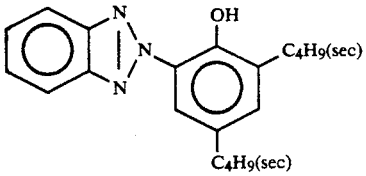
U-2
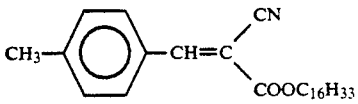
U-3
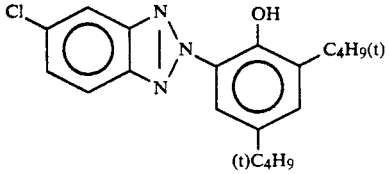
U-4
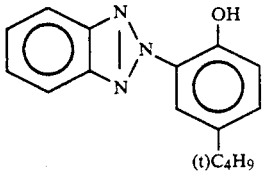
U-5
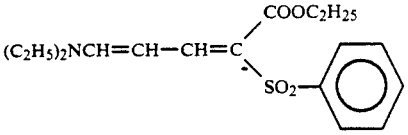
U-6
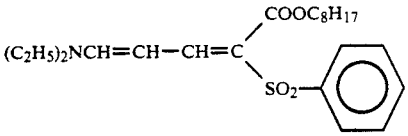
S-1
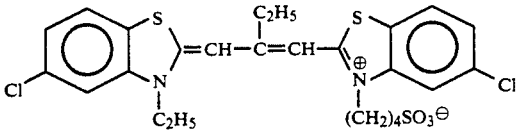
S-2
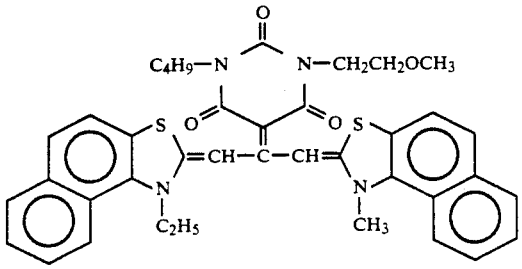
-continued
S-3
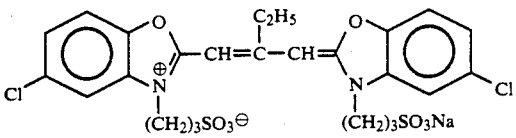
S-4
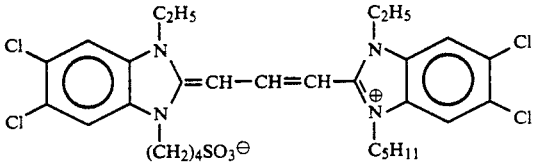
S-5
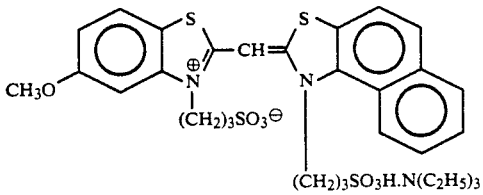
S-6
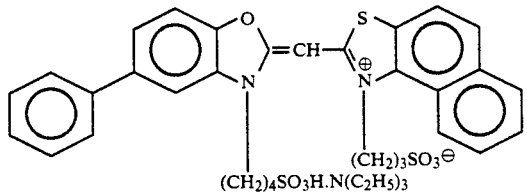
S-7
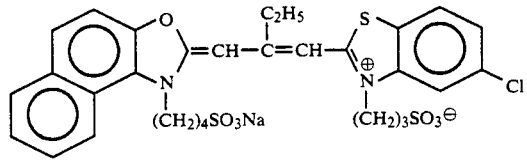
S-8
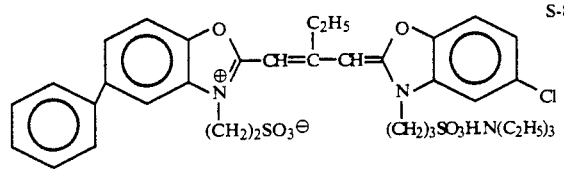
D-1
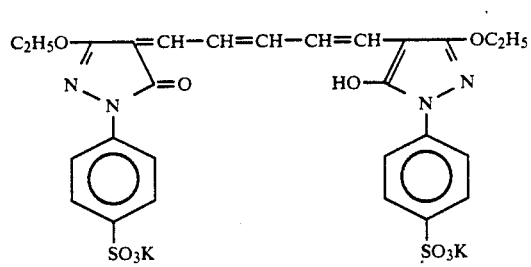
D-2
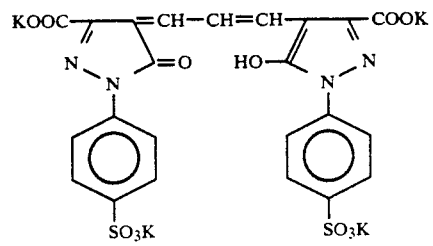

-continued
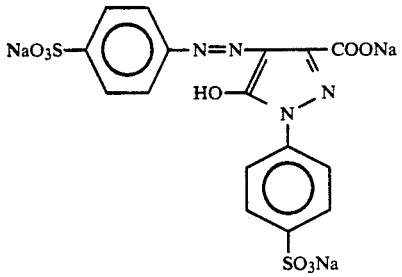
D-4
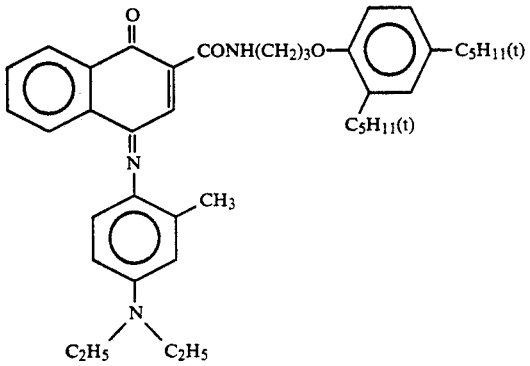
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_17SO_2NHCH_2CH_2CH_2OCH_2CH_2\overset{\oplus}{N}(CH_3)_3$
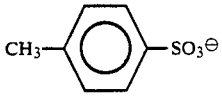
W-2
$C_8F_17SO_2N(C_3H_7)CH_2COOK$
W-3
$NaO_3S{-}CH(CH_2COOCH_2CH(C_2H_5)C_4H_9)COOCH_2CH(C_2H_5)C_4H_9$
W-4
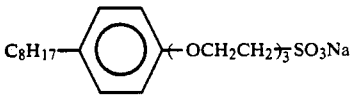
P-1
$\leftarrow CH_2{-}CH(CONHC_4H_9(t)) \rightarrow_n$
M-1
$\leftarrow CH_2{-}CH(COOC_4H_9) \rightarrow_n$
F-1
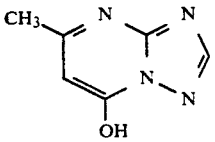
-continued
D-3
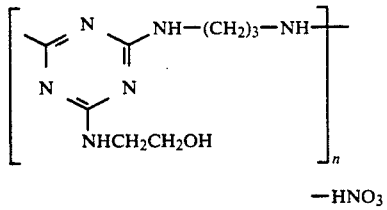
F-2
F-3
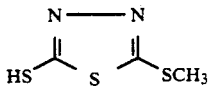
F-4
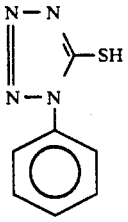
F-5
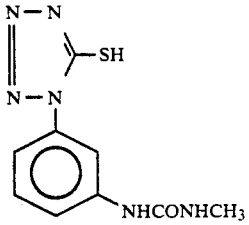
F-6
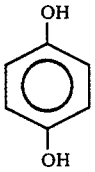
F-7
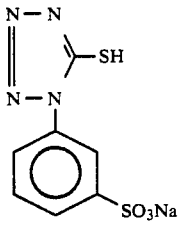
F-8
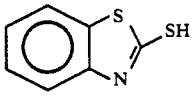
Comparative compound A
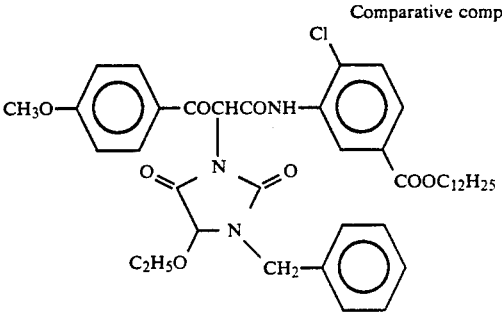

-continued

Comparative compound B

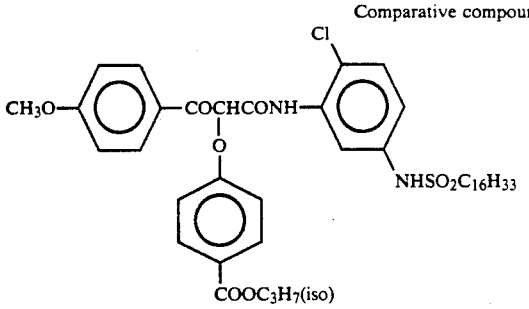

Preparation of Sample 102

Sample 102 was prepared in the same manner as Sample 101, except that coupler Y-7 of the present invention was added instead of coupler C-6 in the seventeenth layer in equimolar amount.

Preparation of Sample 103

Sample 103 was prepared in the same manner as Sample 101, except that in the second layer (intermediate layer) DIR compound I-2 of the present invention was added in an amount of 10 mg per square meter.

Other samples were prepared in the same manner as the above, except that compounds shown Table 1 were used.

The thus prepared samples 101 to 132 were cut into strips to evaluate edge effect. Edge effect was determined as follows:

Each sample was subjected to an exposure to soft X-ray through a slit of 1 mm and a slit of 20 μm, and then it was subjected to development processing as shown below. After the processing, the obtained image was measured by micro-densitometer through a blue filter and the value of edge effect was represented by the density ratio of 20 μm to 1 mm.

| | Processing process | | | |
|---|---|---|---|---|
| Process | Time | Temperature | Tank volume | Replenisher amount |
| B&W development | 6 min | 38° C. | 12 liter | 2.2 l/m² |
| 1st Water-washing | 2 min | 38° C. | 4 liter | 7.5 l/m² |
| Reversal | 2 min | 38° C. | 4 liter | 1.1 l/m² |
| Color development | 6 min | 38° C. | 12 liter | 2.2 l/m² |
| Compensating | 2 min | 38° C. | 4 liter | 1.1 l/m² |
| Bleaching | 6 min | 38° C. | 12 liter | 0.22 l/m² |
| Fixing | 4 min | 38° C. | 8 liter | 1.1 l/m² |
| 2nd water-washing | 4 min | 38° C. | 8 liter | 7.5 l/m² |
| Stabilizing | 1 min | 25° C. | 2 liter | 1.1 l/m² |

Compositions of processing solutions were used as follows:

| B/W (Black and white) developer | Mother solution | Replenisher |
|---|---|---|
| Pentasodium nitrilo-N,N,N-trimethylenephosphonate | 2.0 g | 2.0 g |
| Sodium sulfite | 30 g | 30 g |
| Hydroquinone potassium monosulfonate | 20 g | 20 g |
| Sodium carbonate | 33 g | 33 g |
| 1-Phenyl-4-methyl-4-hydroxymethyl-3-pyrazolydone | 2.0 g | 2.0 g |
| Potassium bromide | 2.5 g | 1.4 g |
| Potassium thiocyanate | 1.2 g | 1.2 g |
| Potassium iodide | 2.0 mg | — |
| Water to make | 1,000 ml | 1,000 ml |
| pH | 9.60 | 9.60 |
| (pH was adjusted by using hydrochloric acid or potassium hydroxide) | | |

| Reversal solution | (Both mother solution and replenisher) |
|---|---|
| Pentasodium nitrilo-N,N,N-trimethylenephosphonate | 3.0 g |
| Stannous chloride (dihydrate) | 1.0 g |
| p-Amylphenol | 0.1 g |
| Sodium hydroxide | 8 g |
| Glacial acetic acid | 15 ml |
| Water to make | 1,000 ml |
| pH | 6.00 |
| (pH was adjusted by using hydrochloric acid or sodium hydroxide) | |

| Color developer | Mother solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Sodium tertiary phosphate (12-hydrate) | 36 g | 36 g |
| Potassium bromide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamido-ethyl)-3-methyl-4-aminoaniline sulfate | 11 g | 11 g |
| 3,6-Dithia-1,8-octane diol | 1.0 g | 1.0 g |
| Water to make | 1,000 ml | 1,000 ml |
| pH | 11.80 | 12.00 |
| (pH was adjusted by using hydrochloric acid or potassium hydroxide) | | |

| Compensating solution | (Both mother solution and replenisher) |
|---|---|
| Sodium ethylenediaminetetraacetate (dihydrate) | 8.0 g |
| Sodium sulfite | 12 g |
| 1-Thioglycerin | 0.4 ml |
| Sorbitan ester* | 0.1 g |
| Water to make | 1,000 ml |
| pH | 6.20 |
| (pH was adjusted by using hydrochloric acid or sodium hydroxide) | |

| Bleaching solution | Mother solution | Replenisher |
|---|---|---|
| Disodium ethylenediaminetetraacetate (dihydrate) | 2.0 g | 4.0 g |
| Iron (III) ammonium ethylenediamine-tetraacetate (dihydrate) | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |
| (pH was adjusted by using hydrochloric acid or sodium hydroxide) | | |

| Fixing solution | (Both mother solution and replenisher) |
|---|---|
| Ammonium thiosulfate | 8.0 g |
| Sodium sulfite | 5.0 g |
| Sodium bisulfite | 5.0 g |
| Water to make | 1,000 ml |
| pH | 6.60 |
| (pH was adjusted by using hydrochloric acid or aqueous ammonia) | |
| Stabilizing solution | |
| Formalin (37%) | 5.0 ml |
| Polyoxyethylene-p-monononyl phenyl ether (av. mol. Wt.:10) | 0.5 ml |
| Water to make | 1,000 ml |

-continued

| pH | (not adjusted) |
|---|---|

*Sorbitan.ester

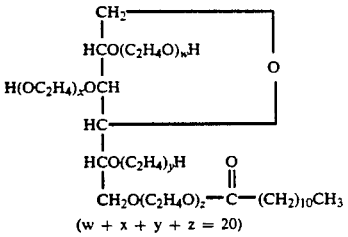

(w + x + y + z = 20)

Results are shown in Table 1.

TABLE 1

| Sample No. | Coupler in 17th layer | DIR compound in 2nd layer | Edge effect | Remarks |
|---|---|---|---|---|
| 101 | C-6 | — | 1.03 | Comparative example |
| 102 | Y-6 | — | 1.03 | Comparative example |
| 103 | C-6 | I-2 | 1.07 | Comparative example |
| 104 | Y-7 | I-2 | 1.19 | This invention |
| 105 | Compound A* | — | 1.03 | Comparative example |
| 106 | Compound B* | — | 1.02 | Comparative example |
| 107 | Y-8 | — | 1.03 | Comparative example |
| 108 | Y-16 | — | 1.04 | Comparative example |
| 109 | Y-36 | — | 1.03 | Comparative example |
| 110 | Y-41 | — | 1.03 | Comparative example |
| 111 | Compound A* | I-2 | 1.07 | Comparative example |
| 112 | Compound B* | I-2 | 1.06 | Comparative example |
| 113 | Y-8 | I-2 | 1.19 | This invention |
| 114 | Y-16 | I-2 | 1.18 | This invention |
| 115 | Y-36 | I-2 | 1.19 | This invention |
| 116 | Y-41 | I-2 | 1.17 | This invention |
| 117 | C-6 | I-57 | 1.09 | Comparative example |
| 118 | Y-7 | I-57 | 1.23 | This invention |
| 119 | Compound A* | I-57 | 1.09 | Comparative example |
| 120 | Compound B* | I-57 | 1.08 | Comparative example |
| 121 | Y-8 | I-57 | 1.23 | This invention |
| 122 | Y-16 | I-57 | 1.22 | This invention |
| 123 | Y-36 | I-57 | 1.24 | This invention |
| 124 | Y-41 | I-57 | 1.23 | This invention |
| 125 | C-6 | I-78 | 1.08 | Comparative example |
| 126 | Y-7 | I-78 | 1.22 | This invention |
| 127 | Compound A* | I-78 | 1.08 | Comparative example |
| 128 | Compound B* | I-78 | 1.07 | Comparative example |
| 129 | Y-8 | I-78 | 1.22 | This invention |
| 130 | Y-16 | I-78 | 1.21 | This invention |
| 131 | Y-36 | I-78 | 1.23 | This invention |
| 132 | Y-41 | I-78 | 1.21 | This invention |

Note;
*Comparative compound

As is apparent from the results in Table 1, the edge effect is large only in the case of combined use of the coupler of the present invention with DIR compound of the present invention.

Further, separately, Samples 101 to 132 were stored for 5 days under the atmosphere of 45° C. and 80% RH, and then the same treatment as the above described was conducted. As the a result, it was found that samples of the present invention have smaller degrees in sensitivity and maximum density.

EXAMPLE 2

Preparation of Sample 201

A color photographic material was prepared by multilayer coating the first layer to the twelfth layer as described below on a paper support polyethylene-laminated on both sides thereof, and named Sample 201. In the polyethylene film of the first layer coated side there was included 15 wt. % of anatase titanium white as a white pigment and a slight amount of ultramarine as a bluing dye.

(Composition of photosensitive layer)

Constituents and the coating amounts in g/m$^2$ thereof are shown below. The coating amount of silver halide is shown in terms of silver.

| | |
|---|---|
| First layer (Gelatin layer) | |
| Gelatin | 1.30 |
| Second layer (Anti-halation layer) | |
| Black colloidal silver | 0.10 |
| Gelatin | 0.70 |
| Third layer (Low sensitivity red-sensitive emulsion layer) | |
| Silver chloroiodobromide emulsion (silver chloride: 1 mol %, silver iodide: 4 mol %, av. grain size: 0.3 μm, distribution of grain size: 10%, cubic, core/shell of core: iodide) spectrally sensitized by red-sensitive sensitizing dyes (ExS-1, -2, and -3) | 0.06 |
| Silver iodobromide emulsion (silver iodide: 4 mol %, av. grain size: 0.5 μm, distribution of grain size: 15%, cubic) spectrally sensitized by red-sensitive sensitizing dyes (ExS-1, -2, and -3) | 0.10 |
| Gelatin | 1.00 |
| Cyan coupler (ExC-1) | 0.14 |
| Cyan coupler (ExC-2) | 0.07 |
| Discoloration inhibitor (Cpd-2, -3, and -4 in equivalent amounts) | 0.12 |
| Coupler dispersive medium (Cpd-6) | 0.03 |
| Coupler solvent (Solv-1, -2, and -3 in equivalent amounts) | 0.06 |
| Development accelerator (Cpd-13) | 0.05 |
| Fourth layer (High sensitivity red-sensitive emulsion layer) | |
| Silver iodobromide emulsion (silver iodide: 6 mol %, av. grain size: 0.8 μm, distribution of grain size: 20%, tabular (aspect ratio: 8, core: iodide)) spectrally sensitized by red-sensitive sensitizing dyes (ExS-1, -2, and -3) | 0.15 |
| Gelatin | 1.00 |
| Cyan coupler (ExC-1) | 0.20 |
| Cyan coupler (ExC-2) | 0.10 |
| Discoloration inhibitor (Cpd-2, -3, and -4 in equivalent amounts) | 0.15 |
| Coupler dispersive medium (Cpd-6) | 0.03 |
| Coupler solvent (Solv-1, -2, and -3 in equivalent amounts) | 0.10 |
| Fifth layer (Intermediate layer) | |
| Magenta colloidal silver | 0.02 |
| Gelatin | 1.00 |
| Color-mix inhibitor (Cpd-7 and -16) | 0.08 |
| Color-mix inhibitor solvent (Solv-4 and -5) | 0.16 |
| Polymer latex (Cpd-8) | 0.10 |
| Sixth layer (Low sensitivity green-sensitive emulsion layer) | |
| Silver chloroiodobromide emulsion (silver chloride: 1 mol %, silver iodide: 2.5 mol %, av. grain size: 0.28 μm, distribution of grain size: 8%, cuboc, core/shell of core: iodide) spectrally sensitized by green-sensitive sensitizing dyes (ExS-1, -2, and -3) | 0.04 |
| Silver iodobromide emulsion (silver iodide: 2.5 mol %, av. grain size: 0.48 μm, distribution of grain size: 12%, cubic) spectrally sensitized by green-sensitive sensitizing dyes (ExS-3 and -4) | 0.06 |
| Gelatin | 0.80 |
| Magenta coupler (ExM-1 and 2 in equivalent amounts) | 0.10 |
| Discoloration inhibitor (Cpd-9) | 0.10 |
| Stain inhibitor (Cpd-10 and -11 in equivalent amounts) | 0.01 |
| Stain inhibitor (Cpd-5) | 0.001 |
| Stain inhibitor (Cpd-12) | 0.01 |
| Coupler dispersive medium (Cpd-6) | 0.05 |
| Coupler solvent (Solv-4 and -6) | 0.15 |
| Seventh layer (High sensitivity green-sensitive | |

-continued

| | |
|---|---|
| emulsion layer) | |
| Silver iodobromide emulsion (silver iodide: 3.5 mol %, av. grain size: 1.0 μm, distribution of grain size: 21%, tabular (aspect ratio: 9, uniform iodide-type)) spectrally sensitized by green-sensitive sensitizing dye (ExS-3 and -4) | 0.10 |
| Gelatin | 0.80 |
| Magenta coupler (ExM-1 and -2 in equivalent amounts) | 0.10 |
| Discoloration inhibitor (Cpd-9) | 0.10 |
| Stain inhibitor (Cpd-10, 11, and -22 in equivalent amounts) | 0.01 |
| Stain inhibitor (Cpd-5) | 0.001 |
| Stain inhibitor (Cpd-12) | 0.01 |
| Coupler dispersive medium (Cpd-6) | 0.05 |
| Coupler solvent (Solv-4 and -6) | 0.15 |
| Eighth layer (Yellow-filter layer) | |
| Yellow colloidal silver | 0.20 |
| Gelatin | 1.00 |
| Color-mix inhibitor (Cpd-7) | 0.06 |
| Color-mix inhibitor solvent (Solv-4 and -5) | 0.15 |
| Polymer latex (Cpd-8) | 0.10 |
| Ninth layer (Low sensitivity blue-sensitive emulsion layer) | |
| Silver chloroiodobromide emulsion (silver chloride: 2 mol %, silver iodide: 2.5 mol %, av. grain size: 0.38 μm, distribution of grain size: 8%, cubic, core/shell of core: iodide) spectrally sensitized by blue-sensitive sensitizing dyes (ExS-5 and -6) | 0.07 |
| Silver iodobromide emulsion (silver iodide: 2.5 mol %, av. grain size: 0.55 μm, distribution of grain size: 11%, cubic) spectrally sensitized by blue-sensitive sensitizing dyes (ExS-5 and -6) | 0.10 |
| Gelatin | 0.50 |
| Yellow coupler (ExY-1 and -2 in equivalent amounts) | 0.20 |
| Stain inhibitor (Cpd-5) | 0.001 |
| Discoloration inhibitor (Cpd-14) | 0.10 |
| Coupler dispersive medium (Cpd-6) | 0.05 |

-continued

| | |
|---|---|
| Coupler solvent (Solv-2) | 0.05 |
| Tenth layer (High sensitivity blue-sensitive emulsion layer) | |
| Silver iodobromide emulsion (silver iodide: 2.5 mol %, av. grain size: 1.4 μm, distribution of grain size: 21%, tabular (aspect ratio: 14) spectrally sensitized by green-sensitive sensitizing dye (ExS-5 and -6) | 0.25 |
| Gelatin | 1.00 |
| Yellow coupler (ExY-1 and -2 in equivalent amounts) | 0.40 |
| Stain inhibitor (Cpd-5) | 0.002 |
| Discoloration inhibitor (Cpd-14) | 0.10 |
| Coupler dispersive medium (Cpd-6) | 0.15 |
| Coupler solvent (Solv-2) | 0.10 |
| Eleventh layer (Ultraviolet ray absorbing layer) | |
| Gelatin | 1.50 |
| UV-absorbent (Cpd-1, -2, -4, and -15 in equivalent amounts) | 1.00 |
| Color-mix inhibitor (Cpd-7 and -16) | 0.06 |
| Dispersive medium (Cpd-6) | 0.15 |
| UV-absorbent solvent (Solv-1 and -2) | 0.15 |
| Irradiation preventing dye (Cpd-17 and -18) | 0.02 |
| Irradiation preventing dye (Cpd-19 and -20) | 0.02 |
| Twelfth layer (Protective layer) | |
| Fine particle silver chlorobromide (silver chloride: 97 mol %, av. grain size: 0.2 μm) | 0.07 |
| Modified Poval | 0.02 |
| Gelatin | 1.50 |
| Gelatin hardener (H-1 and -2 in equivalent amounts) | 0.17 |

Further, in each layer Alkanol XC (du Pont Co.) and sodium alkylibenzenesulfonate as emulsifying dispersing aids, succinate and Magefac F-120 (tradename, manufactured by Dai-Nippon Ink Co.) as coating aids were added. In silver halide containing layer or colloidal silver containing layer, Cpd-21, -22, and -23 were used as a stabilizing agent.

Compounds used in this Example are shown below.

ExS-1

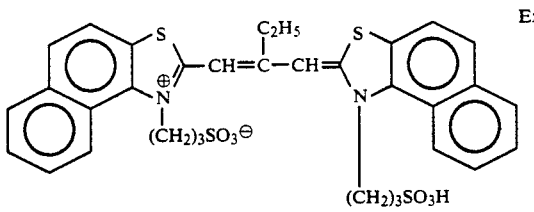

ExS-2

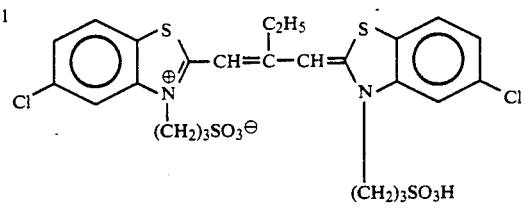

ExS-3

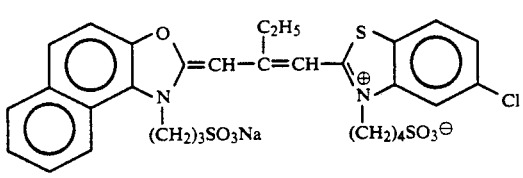

ExS-4

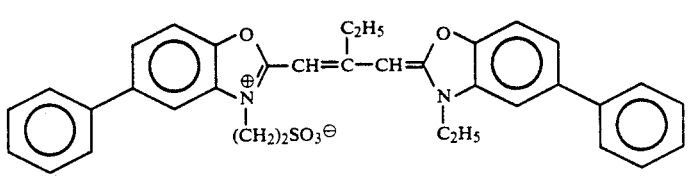

-continued
ExS-5
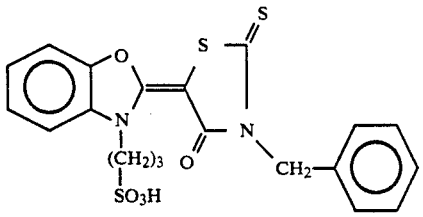
ExS-6
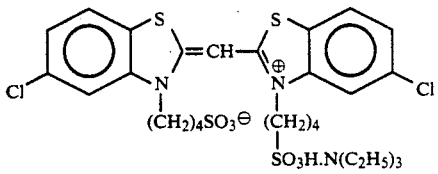
Cpd-1
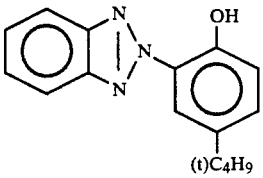
Cpd-2
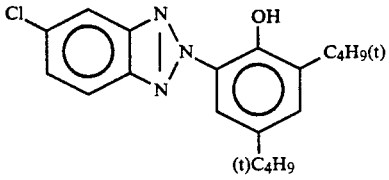
Cpd-3
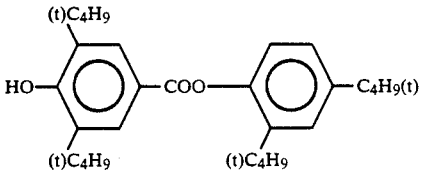
Cpd-4
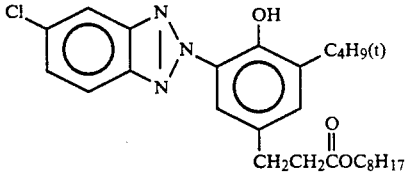
Cpd-5
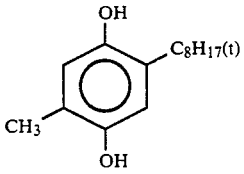
Cpd-6
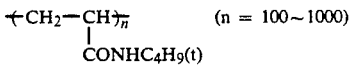
(n = 100~1000)
Cpd-7
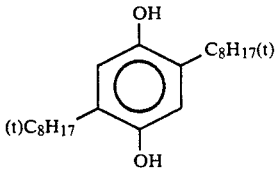
Cpd-8
Poly(ethyl acrylate)
(MW = 10,000~100,000)
Cpd-9
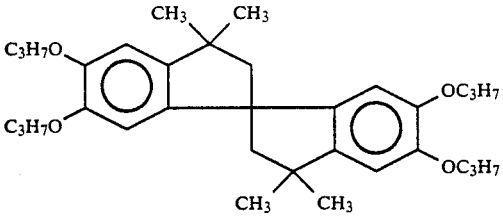
Cpd-10
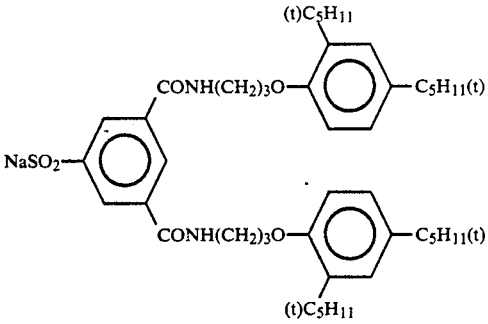
Cpd-11
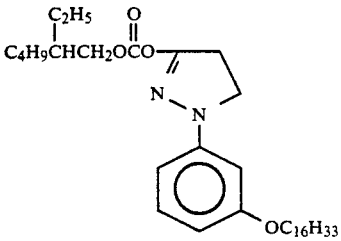
Cpd-12
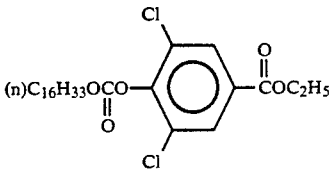

-continued
Cpd-13
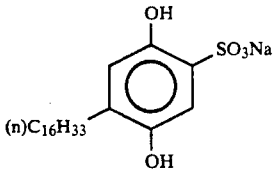
Cpd-14
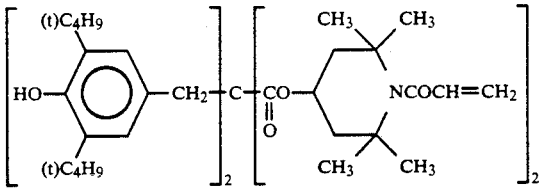
Cpd-15
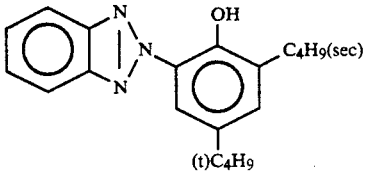
Cpd-16
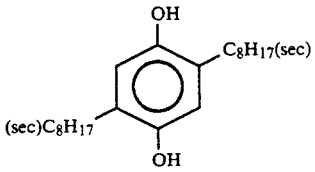
Cpd-17
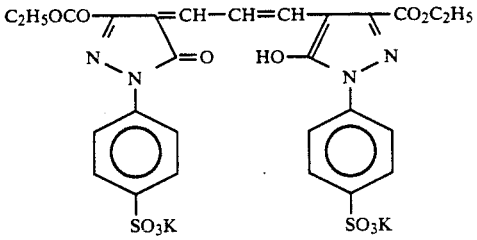
Cpd-18
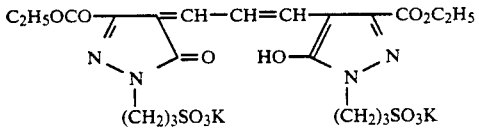
Cpd-19
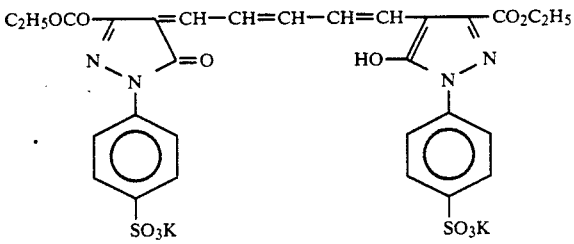
Cpd-20
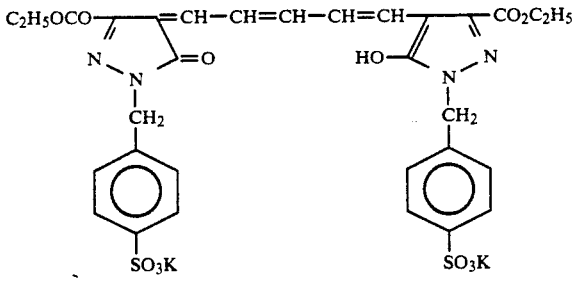
Cpd-21
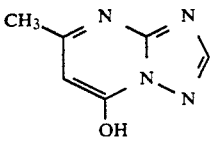
Cpd-22
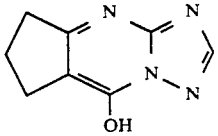

-continued
Cpd-23
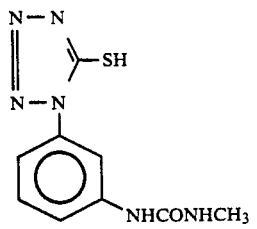
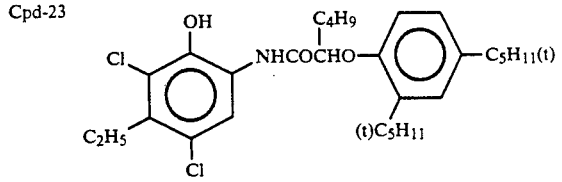
ExC-1
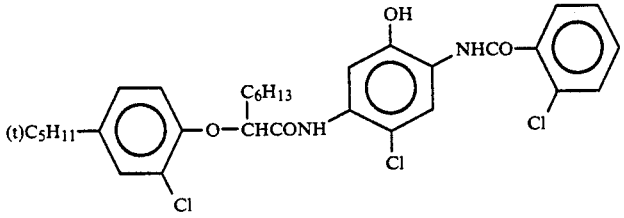
ExC-2
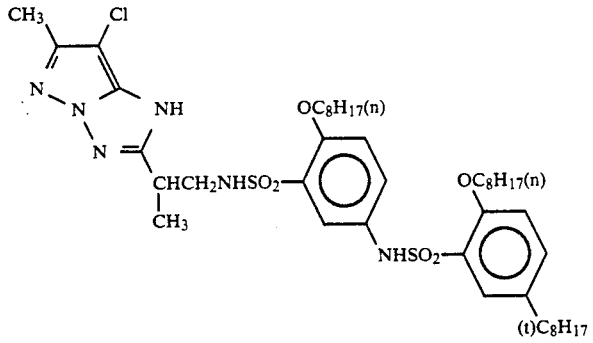
ExM-1
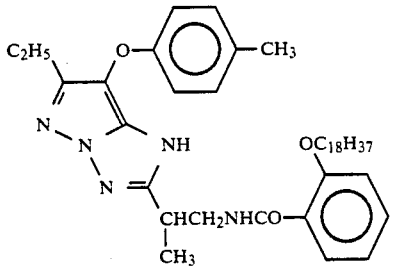
ExM-2
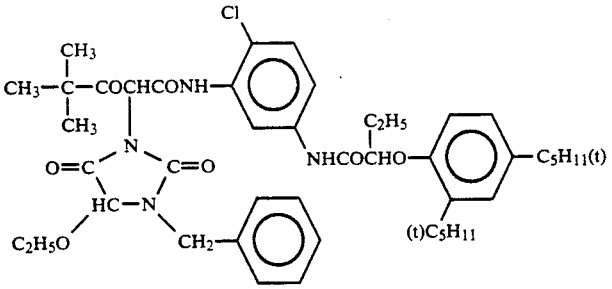
ExY-1
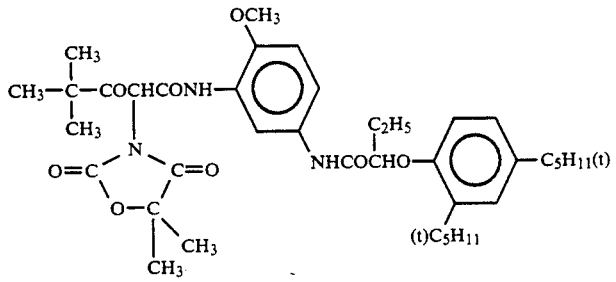
ExY-2

-continued

| | | | |
|---|---|---|---|
| Di(2-ethylhexyl) phthalate | Solv-1 | Trinonyl phosphate | Solv-2 |
| Di-(3-methylhexyl) phthalate | Solv-3 | Tricrezyl phosphate | Solv-4 |
| Dibutyl phthalate | Solv-5 | Trioctyl phosphate | Solv-6 |
| $CH_2{=}CH{-}SO_2{-}CH_2{-}CONH{-}CH_2$ <br> $CH_2{=}CH{-}SO_2{-}CH_2{-}CONH{-}CH_2$ | H-1 | 4,6-Dichlor0-2-hydroxy-1,3,5-triazine Na-salt | H-2 |

Preparation of Sample 202

Sample 202 was prepared in the same manner as Sample 201, except that coupler Y-1 and Y-24 of the present invention was added instead of coupler ExY-1 and ExY-2 in the tenth layer (high sensitivity blue-sensitive emulsion layer) in an equimolar amount.

Preparation of Sample 203

Sample 203 was prepared in the same manner as Sample 201, except that in the third layer (low sensitivity red-sensitive emulsion layer) DIR compound 1-2 of the present invention was added in an amount of 15 mg per square meter.

Other samples were prepared in the same manner as the above, except that compounds shown Table 2 were used.

Thus prepared Samples was subjected to exposure to light in pattern for measuring sharpness by using a light source of 3200° K. Exposed samples were processed according to the processing process described below.

Sharpness was evaluated by MTF-value.

Processing process

| Processing step | Temperature | Time |
|---|---|---|
| First (B&W) developing | 38° C. | 75 sec |
| Water washing | 38° C. | 90 sec |
| Reversal exposure | over 100 lux | over 60 sec |
| Color developing | 38° C. | 135 sec |
| Water washing | 38° C. | 45 sec |
| Bleach-fixing | 38° C. | 120 sec |
| Water washing | 38° C. | 135 sec |
| Drying | | |

Composition of processing solution

| | |
|---|---|
| (First developer) | |
| Pentasodium nitrilo-N,N,N-trimethylene phosphate | 0.6 g |
| Pentasodium diethylenetriamine-pentaacetate | 4.0 g |
| Potassium sulfite | 30.0 g |
| Potassium thiocyanate | 1.2 g |
| Potassium carbonate | 35.0 g |
| Potassium hydroquinone monosulfonate | 25.0 g |
| Diethylene glycol | 15.0 ml |
| 1-Phenyl-4-hydroxymethyl-4-methyl-3-pyrazolidon | 2.0 g |
| Potassium bromide | 0.5 g |
| Potassium iodide | 5.0 mg |
| Water to make (pH 9.70) | 1 liter |
| (Color developer) | |
| Benzyl alcohol | 15.0 ml |
| Diethylene glycol | 12.0 ml |
| 3,6-dithia-1,8-octane diol | 0.2 g |
| Pentasodium nitrilo-N,N,N-trimethylene phosphonate | 0.5 g |
| Pentasodium diethylenetriamine-pentaacetate | 2.0 g |
| Sodium sulfite | 2.0 g |
| Potassium carbonate | 25.0 g |
| Hydroxyamine sulfate | 3.0 g |
| N-ethyl-N-(β-methanesulfonamidoethyl)-3-methyl-4-aminoanilin sulfate | 5.0 g |
| Potassium bromide | 0.5 g |

-continued

| | |
|---|---|
| Potassium iodide | 1.0 mg |
| Water to make (pH 10.40) | 1 liter |
| (Bleach-fixing solution) | |
| 2-Mercapto-1,3,4-triazole | 1.0 g |
| Disodium ethylenediaminetetraacetate dihydrate | 5.0 g |
| Fe(III) ammonium ethylenediamine-tetraacetate monohydrate | 80.0 g |
| Sodium sulfite | 15.0 g |
| Sodium thiosulfate (700 g/l) | 160.0 ml |
| Glacial acetic acid | 5.0 ml |
| Water to make (pH 6.50) | 1 liter |

TABLE 2

| Sample No. | Coupler in 10th layer | DIR compound in 3rd layer | Sharpness 10 cycle/mm | Remarks |
|---|---|---|---|---|
| 201 | ExY-1, ExY-2 | — | 0.82 | Comparative |
| 202 | Y-1, Y-24 | — | 0.82 | Comparative |
| 203 | ExY-1, ExY-2 | I-2 | 0.89 | Comparative |
| 204 | Y-1, Y-24 | I-2 | 0.98 | This invention |
| 205 | Y-1, Y-26 | — | 0.83 | Comparative |
| 206 | Y-36, Y-24 | — | 0.82 | Comparative |
| 207 | Y-1, Y-26 | I-2 | 0.99 | This invention |
| 208 | Y-36, Y-24 | I-2 | 0.99 | This invention |
| 209 | ExY-1, ExY-2 | I-51 | 0.88 | Comparative |
| 210 | Y-1, Y-24 | I-51 | 0.98 | This invention |
| 211 | Y-1, Y-26 | I-51 | 0.97 | This invention |
| 212 | Y-36, Y-24 | I-51 | 0.97 | This invention |
| 213 | ExY-, ExY-2 | I-85 | 0.89 | Comparative |
| 214 | Y-1, Y-24 | I-85 | 0.99 | This invention |
| 215 | Y-1, Y-26 | I-85 | 0.98 | This invention |
| 216 | Y-36, Y-24 | I-85 | 0.98 | This invention |

As is apparent from the results in Table 2, the sharpness is improved largely only in the case of the combined use of the coupler of the present invention with DIR compound of the present invention.

Further, separately, Samples 201 to 216 were stored for 5 days under the atmosphere of 45° C. and 80% RH, and then the same treatment as the above described was conducted. As a result, it was found that samples of the present invention have smaller decreases in sensitivity and of maximum density.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material comprising a support having thereon at least one silver halide emulsion layer, which comprises at least one layer constituting said photographic material that contains at least one acylacetamide yellow coupler whose acyl group is represented by the following formula (Y-I):

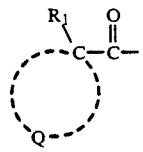

Formula (Y-I)

wherein $R_1$ represents a monovalent group and Q represents a group of nonmetallic atoms required to form together with the C a 3- to 5-membered cyclic hydrocarbon group or a 3- to 5-membered heterocyclic group, having therein at least one hetero atom selected from the group consisting of N, O, S, and P, provided that $R_1$ is a substituent other than a hydrogen atom and does not bond to Q to form a ring, and at least one layer constituting said photographic material that contains at least one compound represented by the following formula (I):

$$A\text{-}(L)_n\text{-}(G)_m\text{-}(Time)_t\text{-}X \qquad \text{Formula (I)}$$

wherein A represents an oxidation-reduction (redox) residue or its precursor, which is an atomic group that allows $-(Time)_t$ X to be released only upon oxidation during the photographic development processing, Time represents a group that will release X after being split off from the oxidized product of A, X represents a development retarder, L represents a bivalent linking group, G represents a polarizable group, and n, m, and t each are 0 or 1.

2. The silver halide color photographic material as claimed in claim 1, wherein the acylacetamide yellow coupler is represented by the following formula (Y-II):

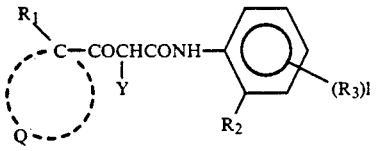

Formula (Y-II)

wherein $R_1$ represents a monovalent substituent other than hydrogen; Q represents a group of non-metallic atoms required to form together with the C a 3- to 5-membered cyclic hydrocarbon group or a 3- to 5-membered heterocyclic group having in the group at least one hetero atom selected from a group consisting of N, O, S, and P; $R_2$ represents a hydrogen atom, a halogen atom, an alkoxy group, an aryloxy group, an alkyl group, or an amino group; $R_3$ represents a group capable of substitution onto a benzene ring; Y represents a hydrogen atom or an atom or group capable of being released upon a coupling reaction with the oxidized product of primary amine developing agent; l is an integer of 0 to 4, and when l is 2 or more, the $R_3$ groups may be the same or different.

3. The silver halide color photographic material as claimed in claim 2, wherein $R_3$ in formula (Y-II) is selected from the group consisting of a halogen atom, an alkyl group having a total C-number of 1 to 30, an aryl group having a total C-number of 6 to 30, an alkoxy group having a total C-number of 1 to 30, an aryloxy group having a total C-number of 6 to 30, an alkoxycarbonyl group having a total C-number of 2 to 30, an aryloxycarbonyl group having a total C-number of 7 to 30, a carbonamido group having a total C-number of 1 to 30, a sulfonamido group having a total C-number of 1 to 30, a carbamoyl group having a total C-number of 1 to 30, a sulfamoyl group having a total C-number of 1 to 30, an alkylsulfonyl group having a total C-number of 1 to 30, a ureido group having a total C-number of 1 to 30, a sulfamoylamino group having a total C-number of 0 to 30, an alkoxycarbonylamino group having a total C-number of 2 to 30, an alkoxysulfonyl group having a total C-number of 1 to 30, a nitro group, a heterocyclic group having a total C-number of 1 to 30, a cyano group, an acyl group having a total C-number of 1 to 30, an acyloxy group having a total C-number of 2 to 30, an alkylsulfonyloxy group having a total C-number of 1 to 30, and an arylsulfonyloxy group having a total C-number of 6 to 30.

4. The silver halide color photographic material as claimed in claim 2, wherein Y in formula (Y-II) represents a 5- to 7-membered heterocyclic group bonded to the coupling active site by the nitrogen atom or an aryloxy group.

5. The silver halide color photographic material as claimed in claim 2, wherein $R_1$ in formula (Y-II) represents a halogen atom, a cyano group, an alkyl group having a total C-number of 1 to 30, an alkoxy group having a total C-number of 1 to 30, an aryl group having a total C-number of 6 to 30 or an aryloxy group having a total C-number of 6 to 30.

6. The silver halide color photographic material as claimed in claim 2, wherein the ring formed by Q together with the C is selected from the group consisting of a cyclopropane ring, a cyclobutane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring.

7. The silver halide color photographic material as claimed in claim 2, wherein Y in formula (Y-II) represents a group represented by the formula (Y-III), (Y-IV), or (Y-V) given below:

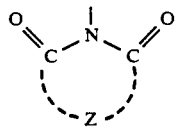

Formula (Y-III)

wherein Z represents

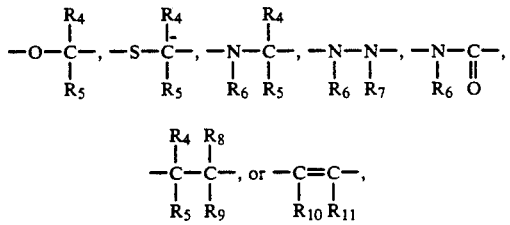

in which $R_4$, $R_5$, $R_8$, and $R_9$ each represent a hydrogen atom, an alkyl group, an aryl group, an alkoxy group, an aryloxy group, an alkylthio group, an arylthio group, an alkylsulfonyl group, an arylsulfonyl group, or an amino group, $R_6$ and $R_7$ each represent a hydrogen atom, an alkyl group, an aryl group, an alkylsulfonyl group, an arylsulfonyl group, or an alkoxycarbonyl group, $R_{10}$ and $R_{11}$ each represent a hydrogen atom, an alkyl group, or an aryl group, or $R_{10}$ and $R_{11}$ may bond together to form a benzene ring, and $R_4$ and $R_5$, $R_5$ and $R_6$, $R_6$ and $R_7$, or $R_4$ and $R_8$ may bond together to form a ring, Formula (Y-IV)

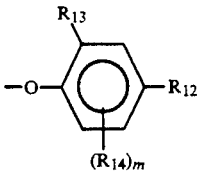

wherein at least one of $R_{12}$ and $R_{13}$ represents a group selected from the group consisting of a halogen atom, a cyano group, a nitro group, a trifluoromethyl group, a carboxyl group, an alkoxycarbonyl group, a carbonamido group, a sulfonamido group, a carbamoyl group, a sulfamoyl group, an alkylsulfonyl group, an arylsulfonyl group, and an acyl group and the other represent a hydrogen atom, an alkyl group, or an alkoxy group, $R_{14}$ has the same meaning as that of $R_{12}$ or $R_{13}$, and m is an integer of 0 to 2, Formula (Y-V)

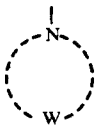

wherein W represents a group of nonmetallic atoms required to form together with the N a pyrrole ring, a pyrazole ring, an imidazole ring, or a triazole ring.

8. The silver halide color photographic material as claimed in claim 1, wherein the yellow coupler, whose acyl group is represented by formula (Y-I), is present in the range from 1.0 to $1.0\times10^{-3}$ mol per mol of silver halide.

9. The silver halide color photographic material as claimed in claim 1, wherein A in formula (I) is hydroquinone, catecol, p-aminophenol, o-aminophenol, 1,4-naphthalene-diol, 1,4-aminonaphthol, a gallic acid ester, a gallic acid amide, or hydrazine.

10. The silver halide color photographic material as claimed in claim 1, wherein L in formula (I) represents alkylene, alkenylene, arylene, oxyalkylene, oxyarylene, aminoalkyleneoxy, aminoalkenyleneoxy, aminoaryleneoxy, or an oxygen atom.

11. The silver halide color photographic material as claimed in claim 1, wherein G in formula (I) represents

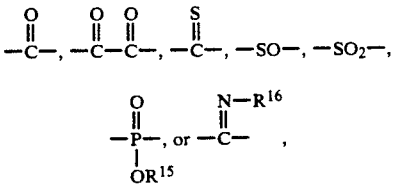

wherein $R^{15}$ represents alkyl, aryl, or a heterocyclic ring and $R^{16}$ represents a hydrogen atom or has the same meaning as $R^{15}$.

12. The silver halide color photographic material as claimed in claim 1, wherein Time in formula (I) represents a group that can release X and that has a timing-adjusting function, a coupler that can release X upon reaction with the oxidized product of a developing agent, or an oxidation-reduction group.

13. The silver halide color photographic material as claimed in claim 1, wherein X in formula (I) represents a compound having a mercapto group bonded to a heterocyclic ring represented by formula (X-1) or a heterocyclic compound capable of forming imino silver represented by formula (X-2):

Formula (X-1)

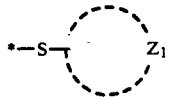

Formula (X-2)

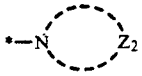

wherein $Z_1$ represents a group of nonmetallic atoms required to form a monocyclic or condensed heterocyclic ring and $Z_2$ represents a group of nonmetallic atoms required to form together with the N a monocyclic or condensed heterocyclic ring, which heterocyclic rings each may have a substituent, and * indicates the position where it is bonded to Time.

14. The silver halide color photographic material as claimed in claim 1, wherein the compound represented by formula (I) is a compound selected from the group consisting of compounds represented by the following formulae (II) and (III):

Formula (II)

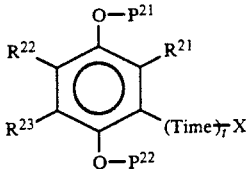

wherein $R^{21}$ and $R^{23}$ each represent a hydrogen atom or a group substitutable on the hydroquinone nucleus, $p^{21}$ and $p^{22}$ each represent a hydrogen atom or a protecting group that can be released at the time of development processing, and Time, X, and t have the same meaning as in formula (I), Formula (III)

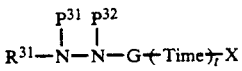

wherein $R^{31}$ represents an aryl group, a heterocyclic group, an alkyl group, an aralkyl group, an alkenyl group, or an alkynyl group, $P^{31}$ and $P^{32}$ each represent a hydrogen atom or a protecting group that can be released at the time of development processing, and G, Time, X, and t have the same meaning as in formula (I).

15. The silver halide color photographic material as claimed in claim 14, wherein the compound represented by formula (II) is a compound selected from the group consisting of compounds represented by the following formulae (IV) and (V):

Formula (IV)

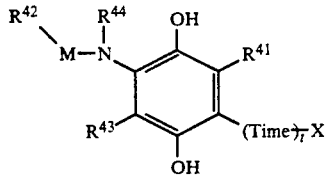

Formula (V)

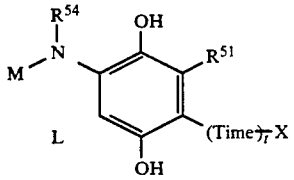

wherein $R^{42}$ represents an aliphatic group, an aromatic group, or a heterocyclic group, M represents $$-\overset{O}{\overset{\|}{C}}-,\ -SO_2-,\ -\overset{R^{45}}{\overset{|}{N}}-\overset{O}{\overset{\|}{C}}-,\ -O-\overset{O}{\overset{\|}{C}}-,\ \text{or}\ -\overset{R^{45}}{\overset{|}{N}}-SO_2-,$$

$R^{44}$, $R^{45}$, and $R^{54}$ each represent a hydrogen atom, an alkyl group, or an aryl group, L represents a bivalent linking group required to form a 5- to 7-membered ring, $R^{41}$ and $R^{51}$ each have the same meaning as $R^{21}$ in formula (II), $R^{43}$ has the same meaning as $R^{23}$ in formula (II), and $\text{-(Time)}_T\text{-X}$ has the same meaning as $\text{-(Time)}_T\text{-X}$ in formula (II).

16. The silver halide color photographic material as claimed in claim 1, wherein the compound represented by formula (I) is included in an emulsion layer of the silver halide color photographic material.

17. The silver halide color photographic material as claimed in claim 1, wherein the compound represented by formula (I) is included in a non-photosensitive layer of the silver halide color photographic material.

18. The silver halide color photographic material as claimed in claim 1, wherein the compound represented by formula (I) is added in the range from 0.001 to 0.2 mmol/$m^2$ of the silver halide color photographic material.

19. The silver halide color photographic material as claimed in claim 1, wherein the coating amount of silver halide in terms of silver is 6.0 g or below per $m^2$ of the silver halide color photographic material.

20. The silver halide color photographic material as claimed in claim 13, wherein the heterocyclic ring represented by $Z_1$ is selected from the group consisting of tetrazole, 1,2,4-triazole, 1,2,3-triazole, 1,3,4-thiadiazole, 1,3,4-oxadiazole, 1,3- thiazole, 1,3-oxazole, imidazole, benzothiazole, benzoxazole, benzimidazole, pyrrole, pyrazole, indazole, tetrazaindene, petazaindene, triazaindene, pyrimidine, triazine, pyradine, and pyridazine, and the heterocyclic ring represented by $Z_2$ is selected from the group consisting of 1,2,4-triazole, benzotriazole, 1,2,3-triazole, indazole, benzimidazole, tetrazaindene, pentazaindene, and tetrazole.

* * * * *